US006553801B2

(12) United States Patent
Chen

(10) Patent No.: US 6,553,801 B2
(45) Date of Patent: Apr. 29, 2003

(54) IMPACT RESISTANT LOCK APPARATUS WITH ANTI-THEFT LOCK CORE

(76) Inventor: Waterson Chen, 8F, No. 428, Wu-Chuan S. Rd., Taichung City (TW)

( * ) Notice: Subject to any disclaimer, the term of this patent is extended or adjusted under 35 U.S.C. 154(b) by 0 days.

(21) Appl. No.: 09/915,146

(22) Filed: Jul. 25, 2001

(65) Prior Publication Data

US 2003/0019263 A1 Jan. 30, 2003

(51) Int. Cl.[7] ..... E05B 29/08; E05B 67/00

(52) U.S. Cl. ..... 70/366; 70/365; 70/38 A; 70/38 B; 70/38 C

(58) Field of Search ..... 70/365, 366, 38 A, 70/38 B, 38 C

(56) References Cited

U.S. PATENT DOCUMENTS 4,345,447 A * 8/1982 Keung et al. ..... 292/38 A
4,551,997 A * 11/1985 Huang ..... 70/38 A
4,620,429 A * 11/1986 Quillen ..... 70/383
4,651,546 A * 3/1987 Evans ..... 70/366
4,742,703 A * 5/1988 DeWalch et al. ..... 70/366
4,838,051 A * 6/1989 Yang ..... 70/38 A
5,086,631 A * 2/1992 Agbay ..... 70/366
5,388,438 A * 2/1995 Haavikko ..... 70/366
5,394,711 A * 3/1995 Pitkanen ..... 70/38 A
5,490,405 A * 2/1996 Ramo et al. ..... 70/366
5,727,405 A * 3/1998 Cromwell ..... 70/38 B
5,931,030 A * 8/1999 Chen ..... 70/38 A
5,934,121 A * 8/1999 Chen ..... 70/365
6,155,089 A * 12/2000 Hurskainen et al. ..... 70/278.3
6,185,966 B1 * 2/2001 Chen ..... 70/366

* cited by examiner

*Primary Examiner*—Anthony Knight
*Assistant Examiner*—Christopher Boswell
(74) *Attorney, Agent, or Firm*—Merchant & Gould P.C.

(57) ABSTRACT

A lock apparatus includes a lock core device received in a lock core chamber of a lock body and having a key operable lock core, a shackle member with a leg portion inserted into a shackle insert hole in the lock body, and a catch member received in a catch chamber that extends from the lock core chamber to the shackle insert hole. The lock core device has a latch member disposed in the catch chamber and formed with a pin hole that is eccentric to an axis of the lock core. The catch member has a first end portion for engaging the shackle member, and an opposite second end portion formed with a pin which extends rotatably into the pin hole for engaging the latch member such that the catch member is movable between locking and unlocking positions during locking and unlocking movement of the latch member.

16 Claims, 42 Drawing Sheets

IMPACT RESISTANT LOCK APPARATUS WITH ANTI-THEFT LOCK CORE

BACKGROUND OF THE INVENTION

1. Field of the Invention

The present invention relates to a lock apparatus, more particularly to a lock apparatus which has an enhanced resistance to external impact and which has a lock core device that provides an enhanced anti-theft effect.

2. Description of the Related Art

U.S. Pat. No. 5,934,121 discloses block apparatus having a lock core unit and a coded key for operating the lock core unit. The lock core unit includes a stack of locking plates, each of which confines a central hole in a shape of three quarters of a circle to permit extension of the coded key therethrough. The locking plates have an outer periphery formed with engaging notches. The coded key has a cross-section in the form of a circular sector, and is formed with a plurality of key bit projections and key bit grooves which have inclined actuating surfaces at different angles to set the code of the key. The engaging notches are misaligned with one another in accordance with the code of the key when the lock core unit is in a locking position, and are aligned with one another when the lock core unit is in an unlocking position. When the key is inserted into a key hole of the lock core unit that is defined by the central holes of the locking plates, and is rotated to unlock the lock core unit, the locking plates rotate by different angles to align the engaging notches with one another to enable a locking rod of the lock core unit to extend into the aligned engaging notches and to disengage from a lock shell that houses the lock core unit so as to prevent the locking rod from hindering rotation of the lock core unit relative to a lock shell that houses the lock core unit. Misalignment of the engaging notches forces the locking rod to extend into a locking groove in the lock shell to hinder rotation of the lock core unit relative to the lock shell. Since the angles of the actuating surfaces of the key bit projections and the key bit grooves on the key can be varied in a range from 0 to 180 degrees, a relatively large number of codes can be set on the key. The lock apparatus thus has a good anti-theft effect. It is desirable to provide a lock apparatus that has a lock core unit of this type and capable of providing an enhanced anti-theft effect.

U.S. Pat. No. 5,931,030 discloses a padlock having a lock base, a lock core unit received in the lock base, and a U-shaped shackle with longer and shorter leg portions inserted removably into shackle insert holes in the lock base. A pair of catch members are disposed in a catch chamber within the lock base adjacent to the lock core unit. Each of the catch members has one end disposed adjacent to a plunger that is formed on a latch member of the lock core unit so as to be actuatable by the plunger, and an opposite end disposed adjacent to a respective one of the shackle insert holes for engaging a respective one of the longer and shorter legs of the shackle member. It is desirable to modify the connection between the catch members and the latch member to enhance the impact resistance of the catch members.

SUMMARY OF THE INVENTION

Therefore, the main object of the present invention is to provide a lock apparatus with an enhanced resistance to external impact and an enhanced anti-theft effect.

Accordingly, the lock apparatus of the present invention includes a lock body, a lock core device, a coded key, a shackle member, and a catch member. The lock body is formed with a lock core chamber, a lock core opening for access to the lock core chamber, and a shackle insert hole. The lock core chamber has a section formed as a catch chamber which is adjacent to and is communicated with the shackle insert hole. The lock core device is received in the lock core chamber via the lock core opening. The lock core device includes a cylindrical and axially rotatable lock core which is provided with a latch member that is disposed in the catch chamber. The latch member has an end face which is transverse to an axis of the lock core and which is formed with a pin hole that is eccentric to the axis of the lock core. The key is insertible into the lock core device via the lock core opening, and is operable for rotating the lock core and the latch member between locking and unlocking positions. The shackle member has a leg portion which is formed with a shackle groove and which is inserted into the shackle insert hole in the lock body. The catch member is disposed in the catch chamber of the lock body. The catch member has a shackle engaging end portion for engaging the shackle groove in the leg portion of the shackle member, and a latch engaging end portion opposite to the shackle engaging end portion and formed with a pin which extends rotatably into the pin hole in the latch member for engaging the latch member such that the catch member is movable between locking and unlocking positions when the latch member moves between the locking and unlocking positions. The shackle engaging end portion of the catch member extends into the shackle insert hole for engaging the shackle groove in the leg portion of the shackle member when the catch member is disposed in the locking position. The shackle engaging end portion is retracted into the catch chamber for disengaging from the leg portion of the shackle member to permit removal of the shackle member from the shackle insert hole when the catch member is disposed in the unlocking position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
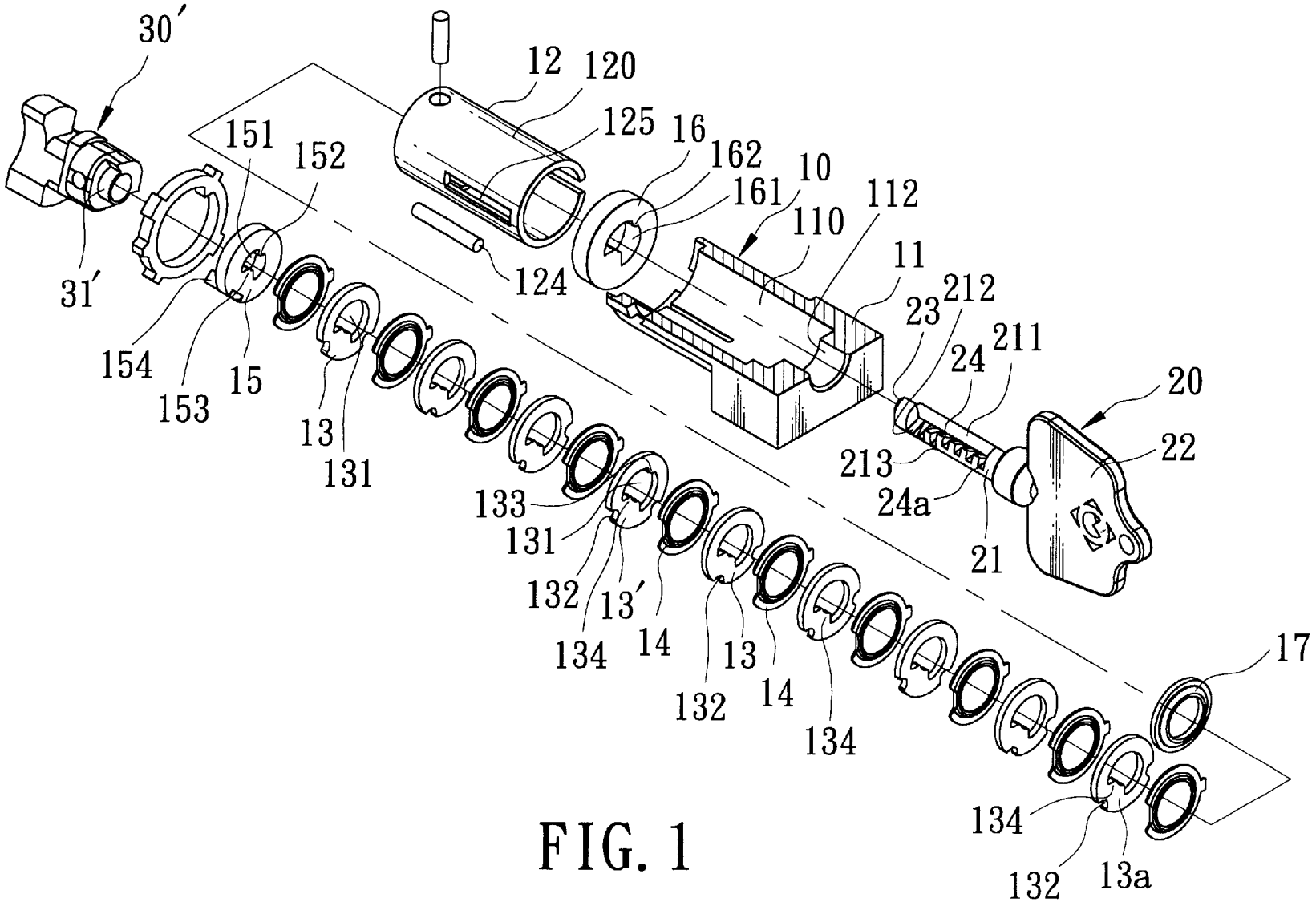
FIG. 1 is an exploded perspective view showing a lock core device and a key of a lock apparatus of a first preferred embodiment of the present invention.

Before the present invention is described in greater detail, it should be noted that like elements are denoted by the same reference numerals throughout the disclosure.

Figure 2:
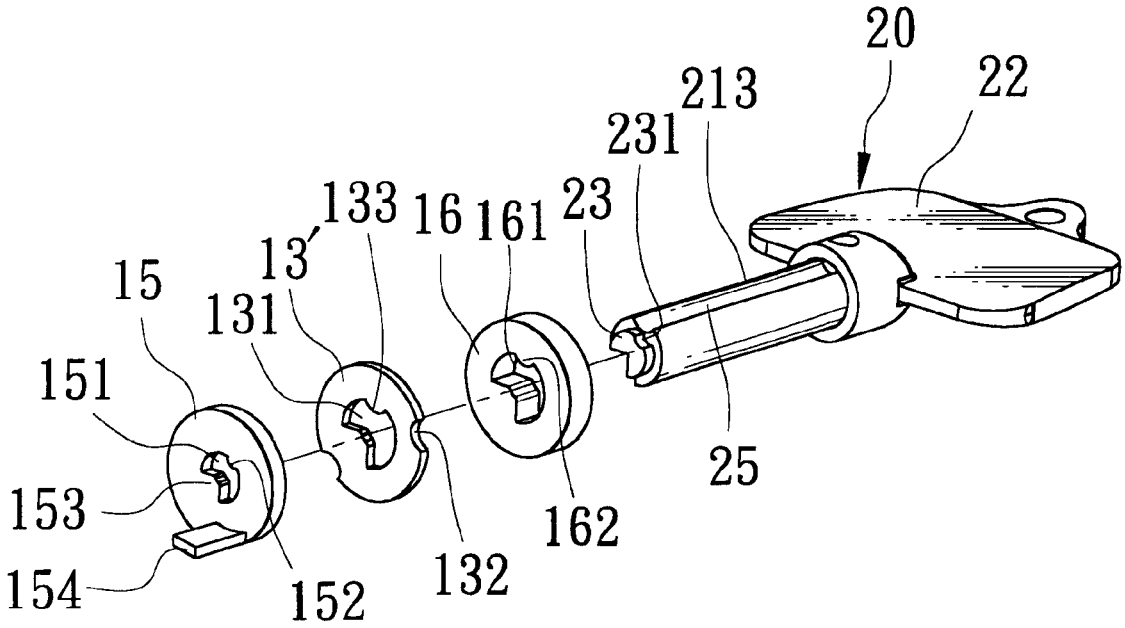
FIG. 2 is an exploded perspective view illustrating how the key engages a protective plate, a locking plate and a drive plate of the lock core device of the first preferred embodiment.
Figure 3:
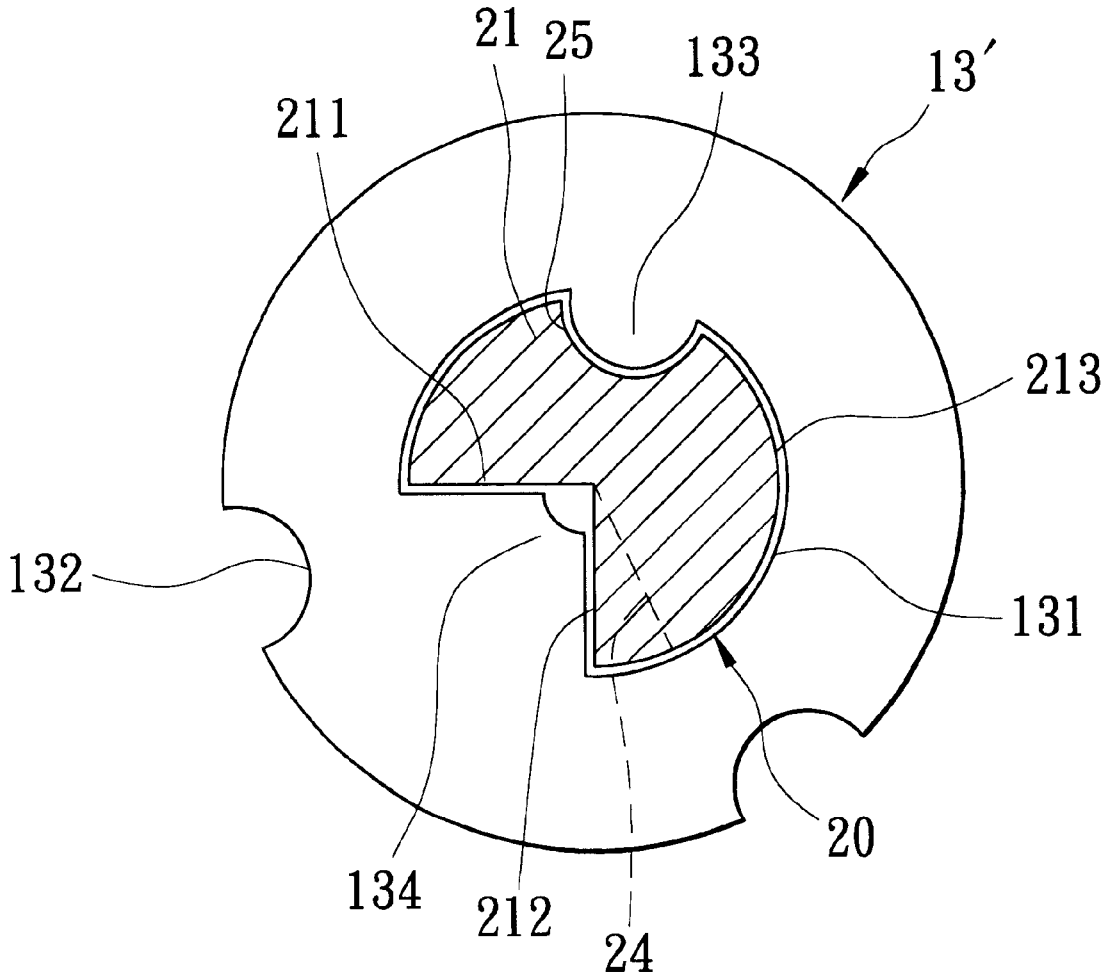
FIG. 3 is a cross-sectional view illustrating the engagement between the key and the locking plate.

Referring to FIGS. 1 to 3, in a preferred embodiment of the lock apparatus according to the present invention, a lock core device 10 is shown to include a lock casing 11 with an inner surface that confines a cylindrical chamber 110 for receiving an axially rotatable lock core 12. The lock core 12 includes a cylindrical inner shell 120, a stack of annular locking plates 13, 13', 13*a* received in the inner shell 120, a plurality of annular spacer plates 14 disposed among the locking plates 13, 13', 13*a*, a locking rod 124 received in an axially extending slot 125 formed in the inner shell 120, an annular drive plate 15 received in the inner shell 120 at a rear end of the inner shell 120, and a latch member 30' connected to the rear end of the inner shell 120. Each of the locking plates 13, 13', 13*a* has an inner periphery formed with a radial inward key engaging protrusion 134 so as to define a central hole 131 that has an arc length equal to three quarters of a circle. Each of the locking plates 13, 13', 13*a* further has an outer periphery formed with at least one engaging notch 132. The central holes 131 of the locking plates 13, 13', 13*a* cooperatively confine a keyhole aligned with a key access hole 112 formed in a front end of the lock casing 11. The drive plate 15 has an inner periphery which confines a key engaging hole 151 and which is formed with a key actuatable projection 153 that projects radially and inwardly. The drive plate 15 has a drive projection 154 which extends axially and rearwardly toward the latch member 30'. The latch member 30' has an actuatable section 31' which is driven by the drive projection 154 such that rotation of the drive plate 15 can result in corresponding rotation of the latch member 30' between locking and unlocking positions. A coded key 20 is insertible into the key access hole 112 and into the keyhole defined by the central holes 131 of the locking plates 13, 13', 13*a*. The key 20 has a handle portion 22 and a shank portion 21 extending from the handle portion 22. The shank portion 21 has a cross-section formed as a circular sector, a flat first radial surface 211 extending along the length of the shank portion 21, a second radial surface 212 constituted by a plurality of key bit portions 24, 24*a* which are arranged along the length of the shank portion 21 and which have radial key bit surfaces that form different angles with the flat first radial surface 211 to set a code of the key 20, and a curved surface 213 that extends along the length of the shank portion 21 and that extends circumferentially between the first and second radial surfaces 211, 212. The shank portion 21 further has a distal end formed as an actuating tip portion 23 that is extendible into the key engaging hole 151 in the drive plate 15 for engaging the key actuatable projection 153 so as to enable co-rotation of the drive plate 15 with the key 20. Considering that a base portion with a cross-section in the form of a quarter of a circle is to be maintained on the key 20, the angles of the actuating surfaces on the key bit portions 24, 24*a* relative to the first radial surface 211 can be varied in a range from 0 to 180 degrees. As such, a relatively large number of codes can be selected for the key 20.

With further reference to FIGS. 2 and 3, in the present embodiment, the inner periphery of one of the locking plates 13' is further formed with a radial inward engaging protrusion 133. The shank portion 21 of the key 20 is formed with an axially extending engaging groove 25 on the curved surface 213. The engaging groove 25 extends along the length of the shank portion 21 for engaging the engaging protrusion 133. In other embodiments, the engaging protrusion 133 may be formed on the shank portion 21 of the key 20, while the engaging groove 25 may be formed on one of the locking plates. The shape of the engaging protrusion 133 is not limited to that shown in FIGS. 2 and 3. Moreover, the angular position of the engaging groove 25 on the curved surface 213 can be varied. An improved anti-theft effect is thus achieved.

Figure 4:
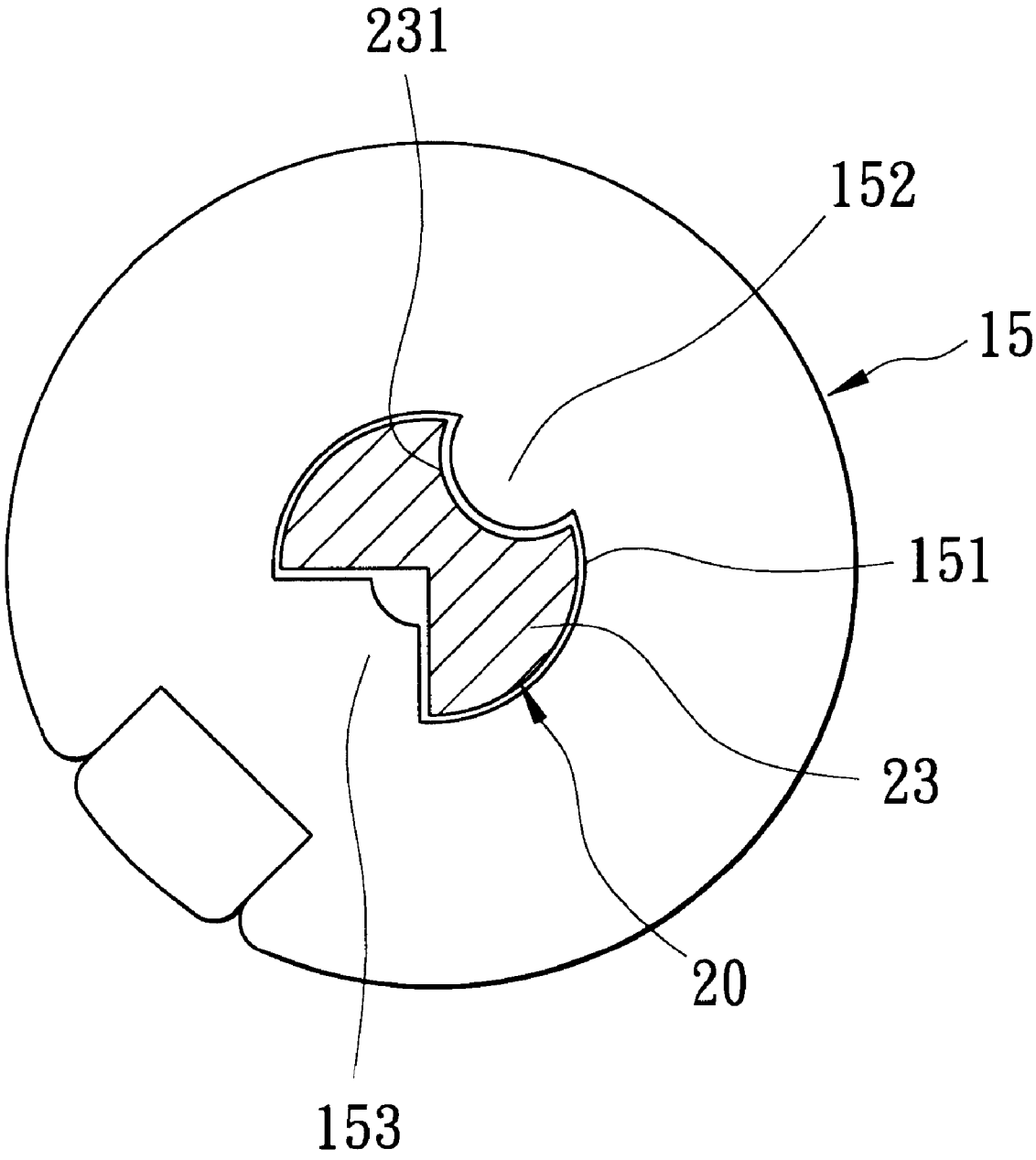
FIG. 4 is a cross-sectional view illustrating the engagement between a distal end of the key and the drive plate.

Referring to FIGS. 2 and 4, the inner periphery of the drive plate 15 is further formed with a radial inward engaging protrusion 152. The actuating tip portion 23 of the key 20 is formed with an engaging groove 231 for engaging the engaging protrusion 152. Likewise, the position of the engaging protrusion 152 on the inner periphery of the locking plate 15 can be varied to further improve the anti-theft effect of the lock core device 10.

Referring back to FIGS. 1 and 2, an annular protective plate 16 is received rotatably in the cylindrical chamber 110 of the lock casing 11 between the key access hole 112 and a front end of the inner shell 120. The protective plate 16 has an inner periphery that confines a key passage hole 161 with a shape of three quarters of a circle to permit extension of the shank portion 21 of the key 20 therethrough. Before the key 20 is inserted into the key access hole 112, the protective plate 16 is fully rotatable within the cylindrical chamber 110. When a drill extends into the key access hole 112 and works on the protective plate 16 for the purpose of damaging the lock core device 10, the protective plate 16 will rotate idly relative to the lock casing 11, thereby preventing the drill from reaching the interior of the lock core device 10. In order to withstand a drilling action, the protective plate 16 is preferably made from a high strength metal alloy. In the present embodiment, the inner periphery of the protective plate 16 is formed with a radial inward engaging protrusion 162 for engaging the engaging groove 25 on the curved surface 213 of the shank portion 21 of the key 20, thereby providing the lock core device 10 with an improved anti-theft effect.

Preferably, one of the locking plates 13*a* that is disposed at a selected position within the inner shell 120 is increased in thickness relative to the remaining ones of the locking plates 13, 13'. Accordingly, a selected one of the key bit portions 24*a* that is corresponding to the thicker locking plate 13*a* is increased in width measured in a longitudinal direction of the shank portion 21.

Figure 5:
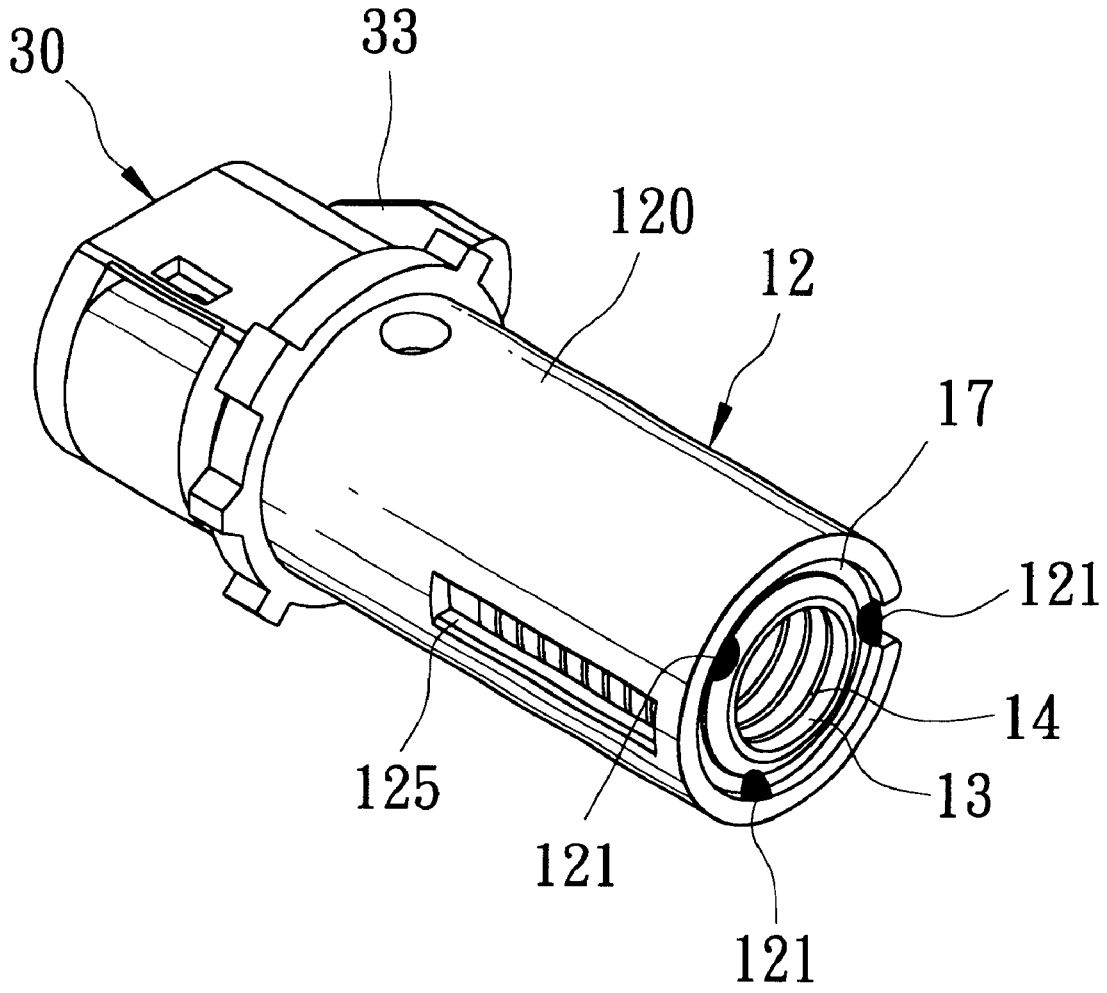
FIG. 5 is a perspective view illustrating a lock core of a second preferred embodiment of the lock apparatus of the present invention.
Figure 6:
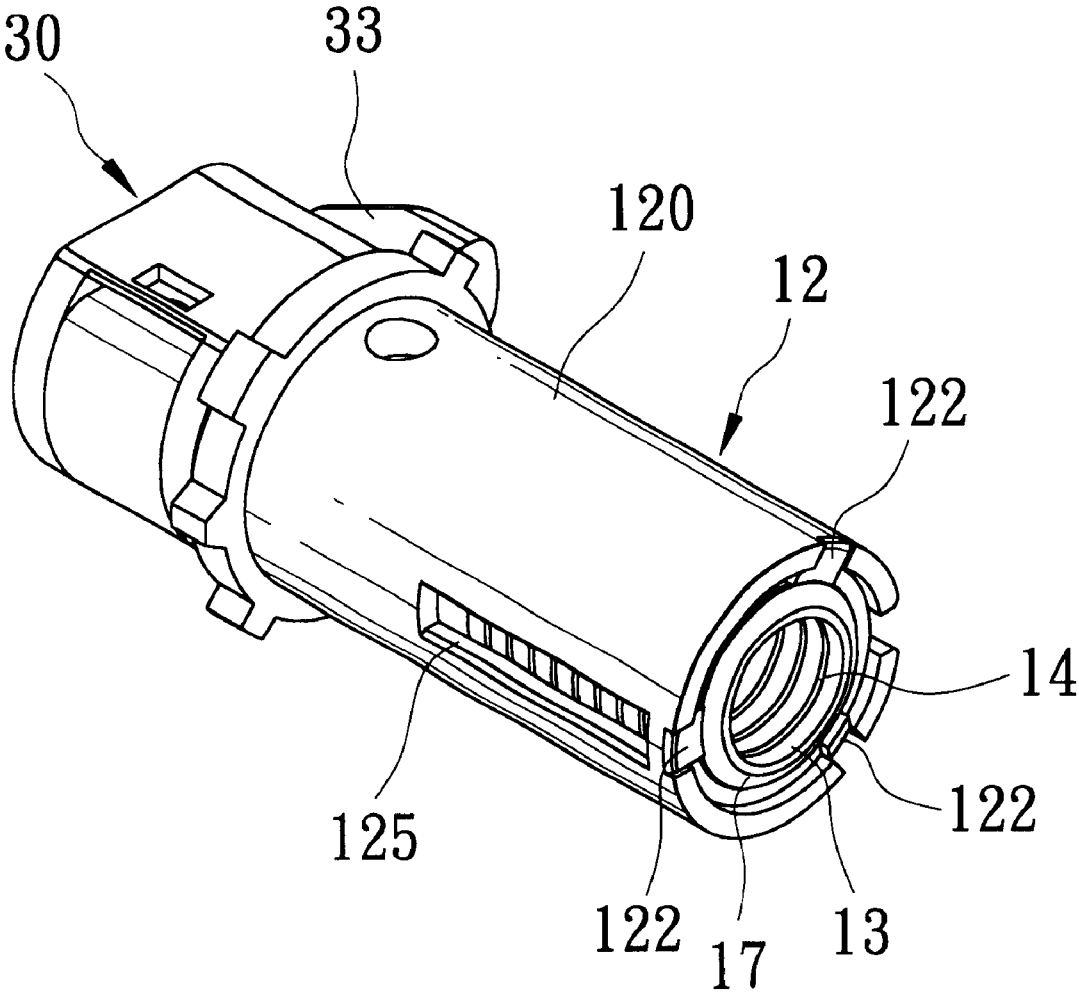
FIG. 6 is a perspective view illustrating a lock core of a third preferred embodiment of the lock apparatus of the present invention.
Figure 7:
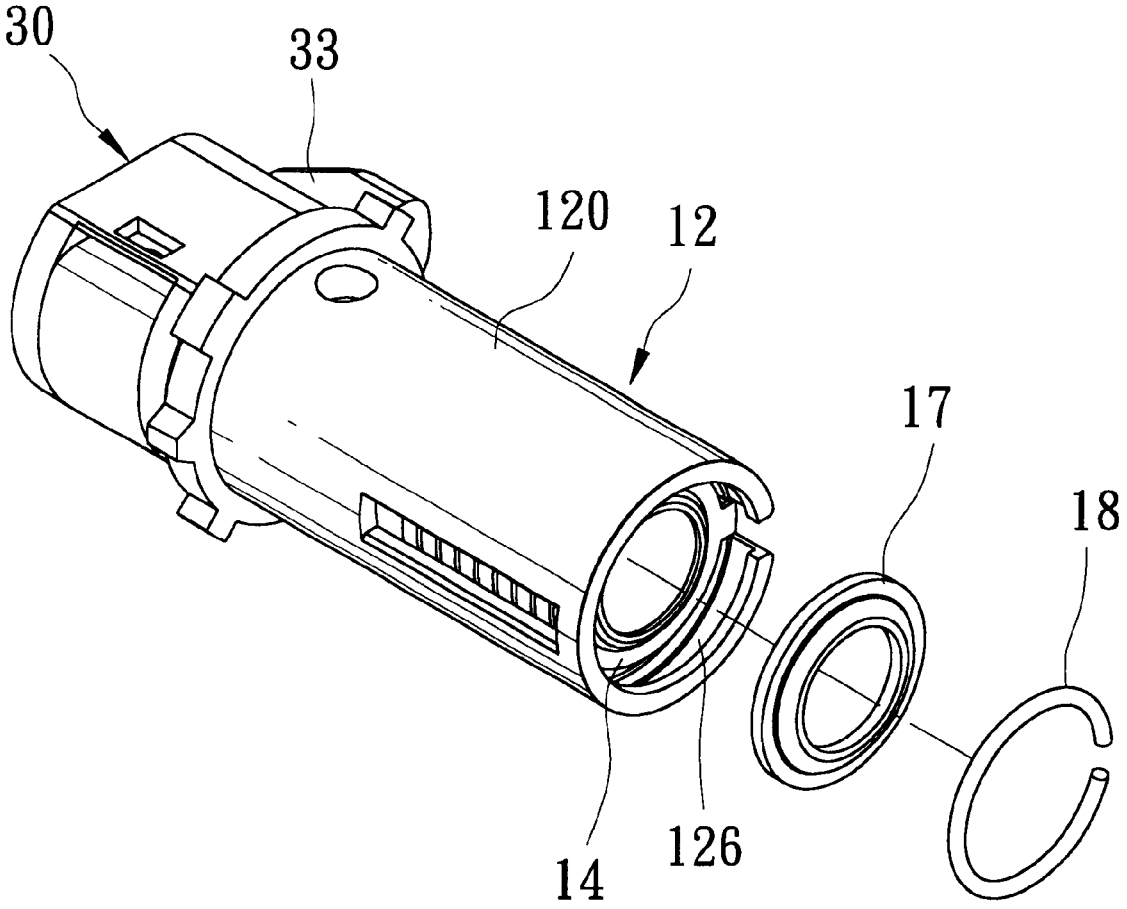
FIG. 7 is a partly-exploded perspective view illustrating block core of a fourth preferred embodiment of the lock apparatus of the present invention.

In order to diminish noise generated during rotation of the locking plates 13, 13', 13*a* and the spacer plates 14, an annular positioning plate 17 is secured to the front end of the inner shell 120 to reduce spaces formed among the locking plates 13, 13', 13*a* and the spacer plates 14. The positioning plate 17 may be welded to the inner shell 120 at three points 121 on its outer periphery, as shown in FIG. 5. In another embodiment, the front end of the inner shell 120 may be formed with three angularly displaced stop members 122 which are bent to extend radially and inwardly for retaining the positioning plate 17 within the inner shell 120 at the front end of the inner shell 120, as shown in FIG. 6. Alternatively, with reference to FIG. 7, the inner shell 12 is formed with an annular groove 126 on its inner surface at the front end. The positioning plate 17 is first received in the inner shell 120 adjacent to the annular groove 126. Then, a C-shaped resilient ring 18 is disposed in the annular groove 126 anteriorly of and adjacent to the positioning plate 17. The resilient ring 18 normally expands to engage the inner shell 120 for retaining the positioning plate 17 in the inner shell 120 at the front end of the latter.

Figure 8:
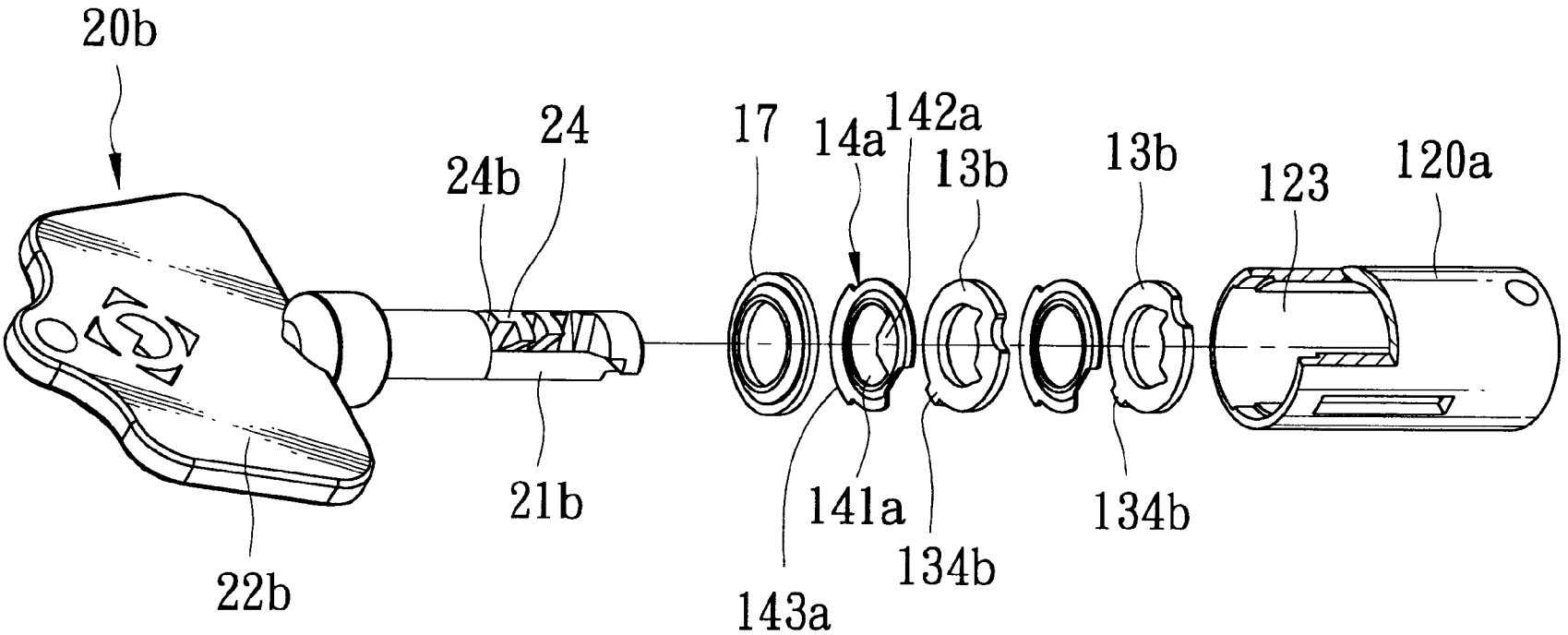
FIG. 8 is a fragmentary exploded perspective view illustrating a key and a lock core device of a fifth preferred embodiment of the lock apparatus of the present invention.

Referring to FIG. 8, in another preferred embodiment of the lock apparatus according to the present invention, a limiting groove 123 is formed on an inner surface of the inner shell 120*a* of the lock core device to limit rotation of the locking plates 13*b* within the inner shell 12*a* so as to facilitate operation of the key 20*b*. The limiting groove 123 extends longitudinally along the length of the inner shell 120*a*, and extends circumferentially on the inner surface along a curved line. The curved line can be designed to have an arc length of 180 degrees, greater than 180 degrees or smaller than 180 degrees. The outer periphery of at least one of the locking plates 13*b* is formed with a radial limiting projection 134*b* which projects into the limiting groove 123 to limit rotation of the locking plate 13*b* within an angle defined by the arc length of the limiting groove 123 during operation of the key 20*b*. When the arc length of the limiting groove 123 is short, the locking plates 13*b* are rotatable within a small angular range, and are thus actuatable by the key 20 within a short amount of time for unlocking the lock core device. On the other hand, when the arc length of the limiting groove 123 is long, the locking plates 13*b* are rotatable within a large angular range. A longer amount of time would be required for actuating the locking plates 13*b* by operating the key 20*b* to unlock the lock core device.

Figure 9:
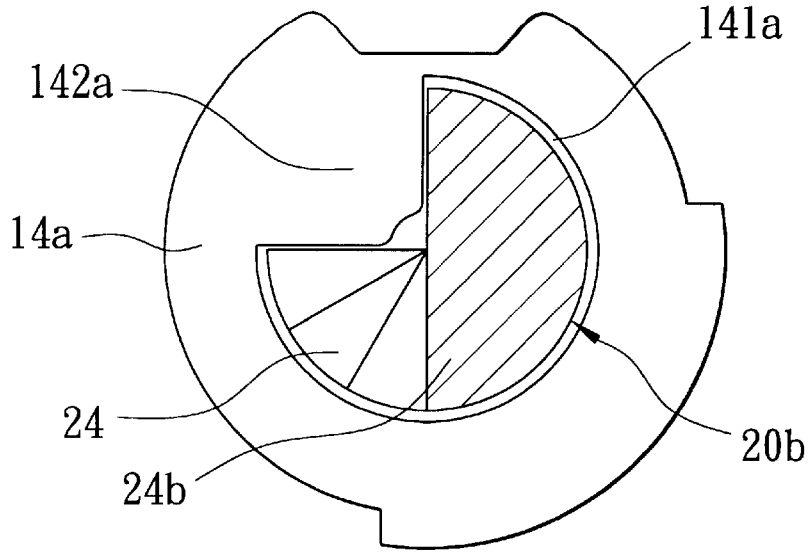
FIGS. 9 and 10 are cross-sectional views of the fifth preferred embodiment, illustrating how the key is retained in the lock core device by a retaining plate.
Figure 10:
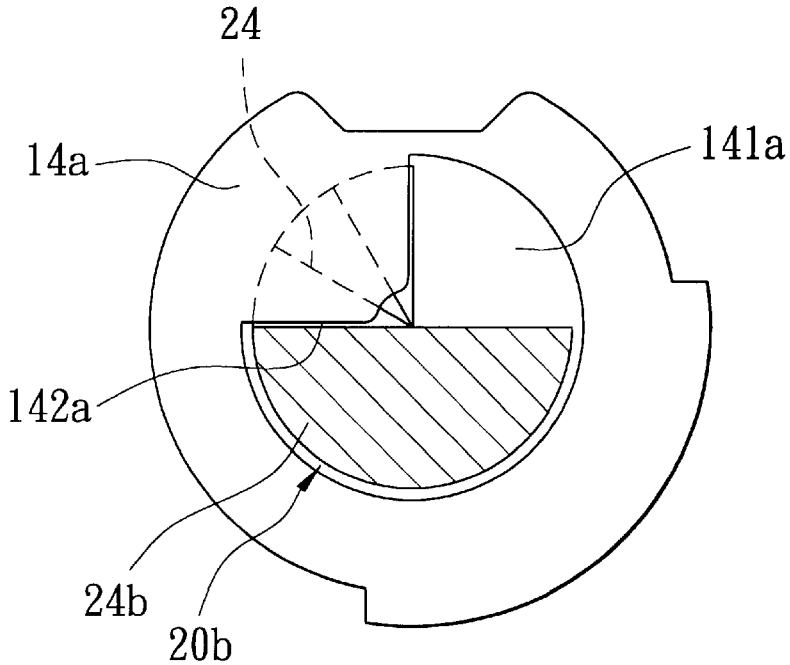
Figure 11:
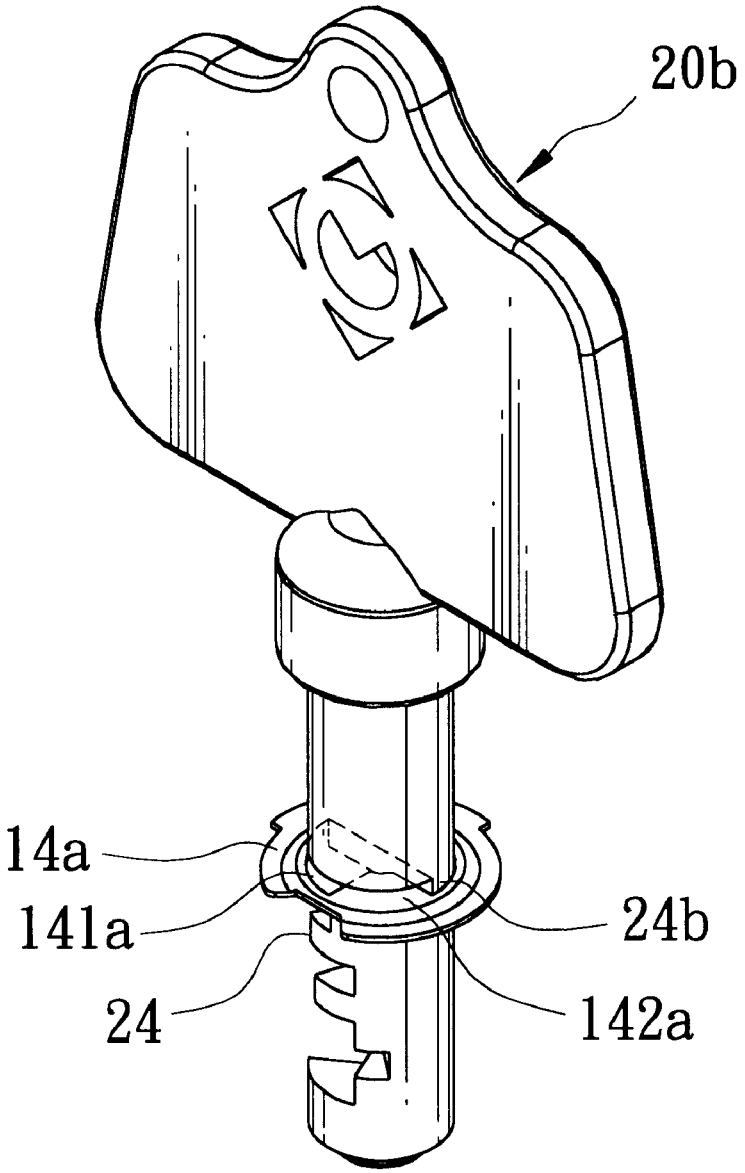
FIG. 11 is a perspective view illustrating the engagement between the key and the retaining plate in the fifth preferred embodiment.

In the present embodiment, an annular retaining plate 14*a* is received in the inner shell 120*a* proximate to the front end of the inner shell 120*a*, and is disposed between the positioning plate 17 and one of the locking plates 13*b* that is disposed proximate to the front end of the inner shell 120*a*. The retaining plate 14*a* has an outer periphery formed with a fan-shaped retaining projection 143*a* that extends fittingly into the limiting groove 123 in the inner shell 120*a*. The retaining plate 14*a* further has an inner periphery formed with a radial inward blocking protrusion 142*a* and defining a key passage hole 141*a* in the shape of three quarters of a circle. The shank portion 21*b* of the key 20*b* has a retainer section 24*b* which is formed between the key bit portions 24 and the handle portion 22*b* of the key 20*b* and is disposed immediately adjacent to the key bit portions 24. The retainer section 24*b* has a semi-circular cross-section. As shown in FIG. 9, the retainer section 24*b* extends into the key passage hole 141*a* of the retaining plate 14*a* when the key 20*b* is inserted into the keyhole. The key bit portions 24 are blocked by the blocking protrusion 142*a* on the retaining plate 14*a* when the key 20*b* is rotated in the keyhole, as best illustrated in FIGS. 10 and 11. In this manner, untimely removal of the key 20*b* from the lock core device can be prevented during operation of the key so as to facilitate operation of the key 20*b* within the keyhole.

Figure 12:
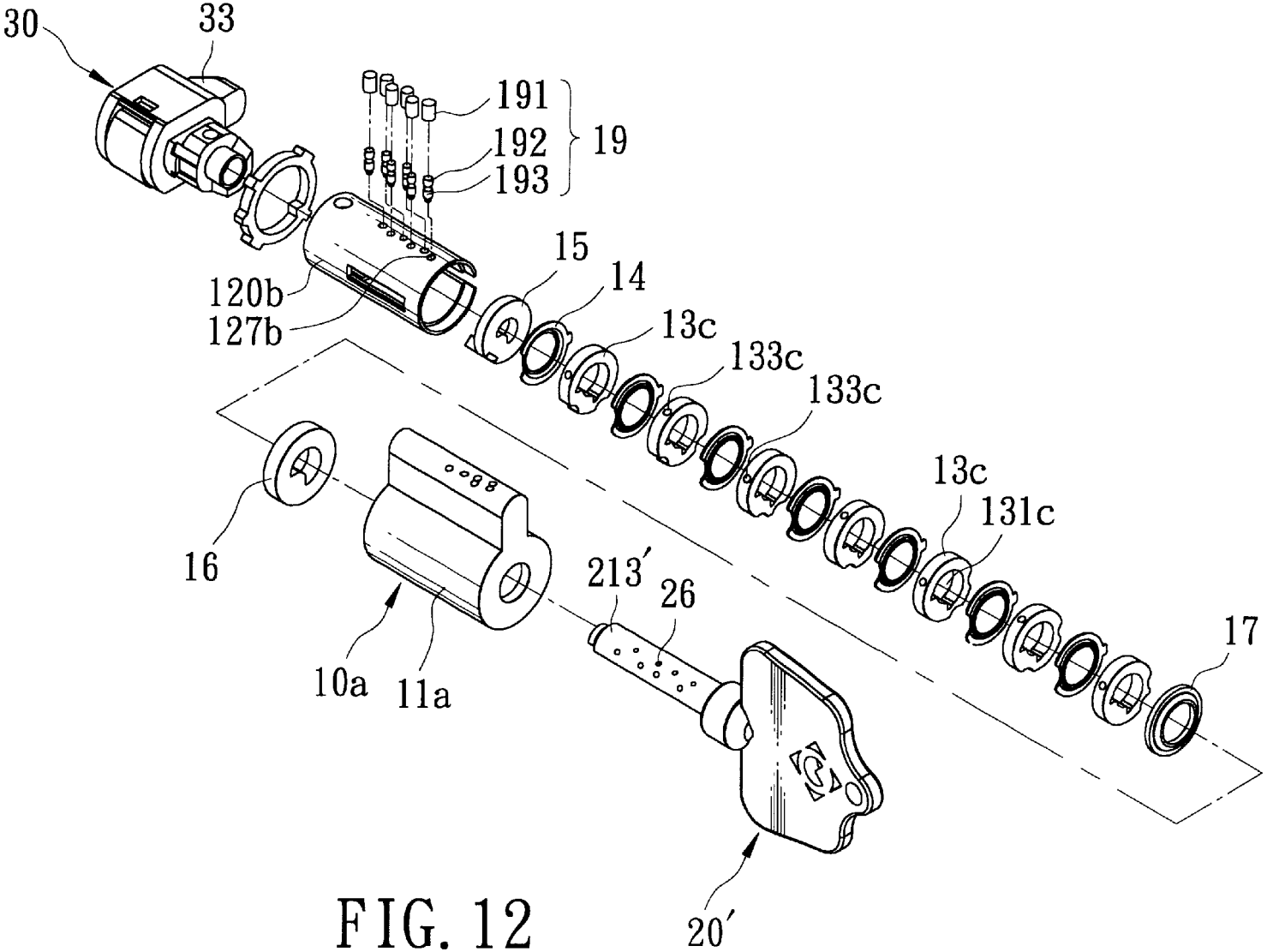
FIG. 12 is an exploded perspective view illustrating a key and a lock core device of a sixth preferred embodiment of the lock apparatus of the present invention.
Figure 13:
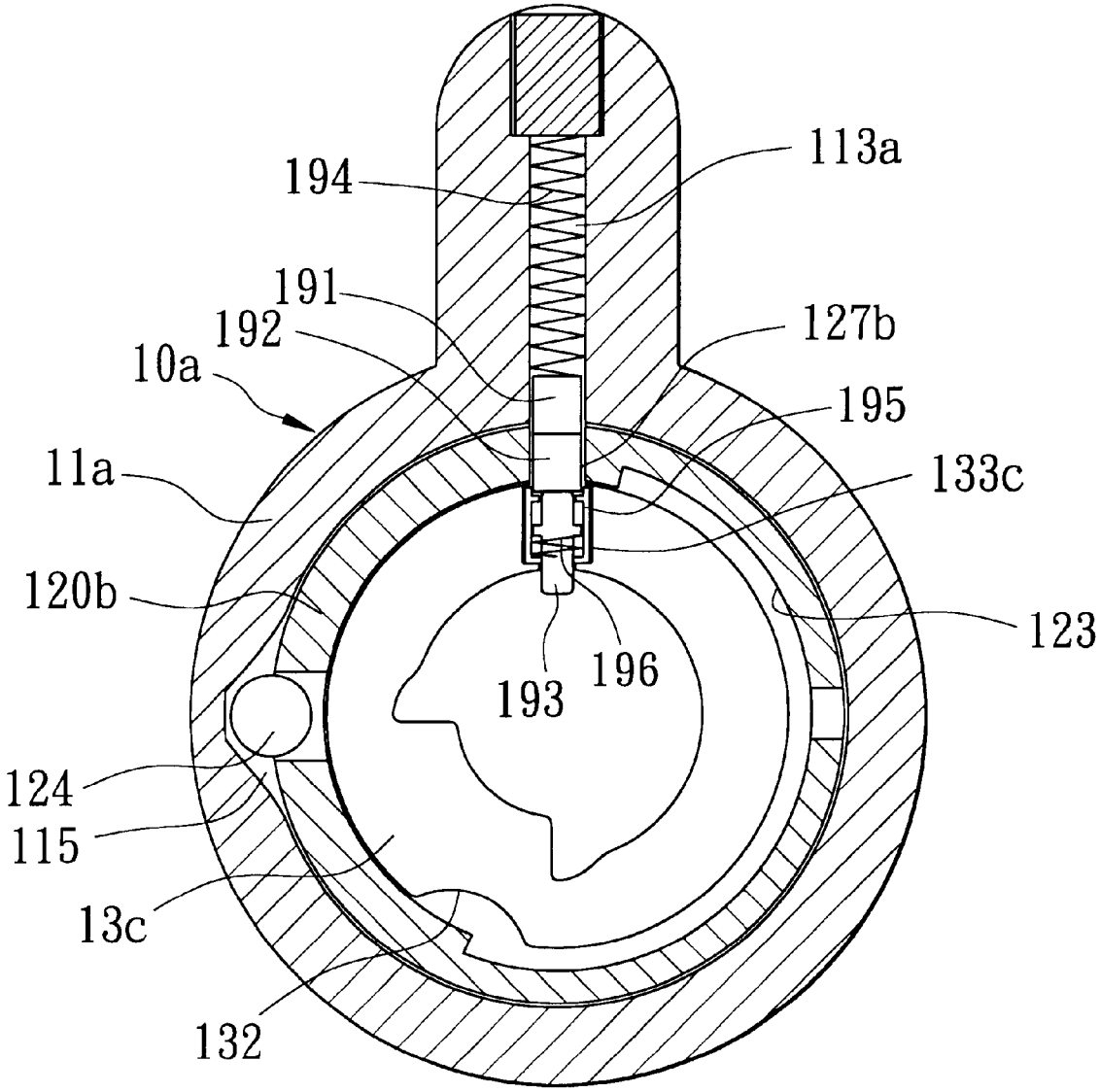
FIG. 13 is a cross-sectional view illustrating the lock core device of the sixth preferred embodiment prior to insertion of the key into the lock core device.
Figure 14:
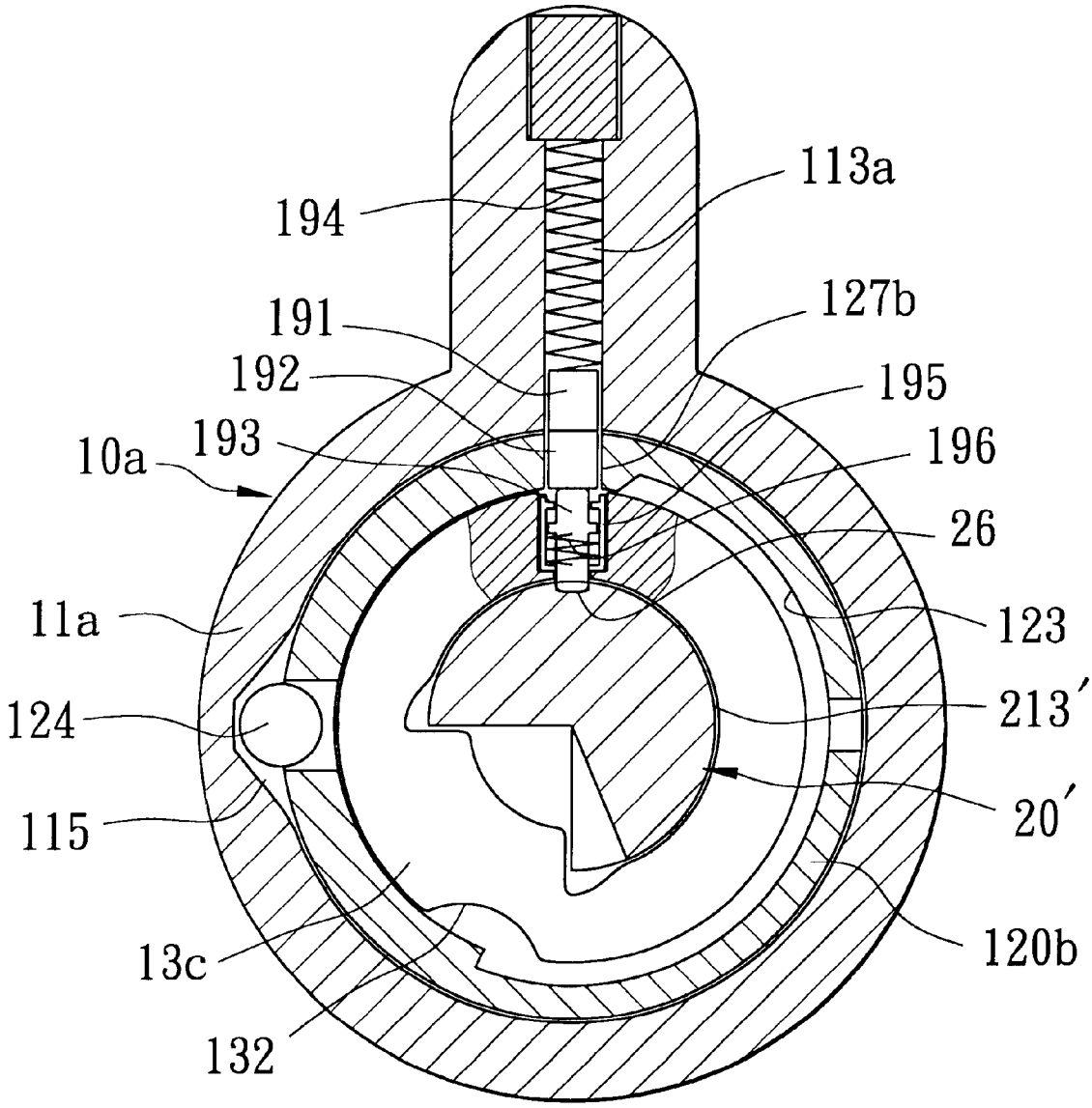
FIG. 14 is a cross-sectional view of the lock core device of the sixth preferred embodiment, where the key is inserted into the lock core device and engages a third tumbler member.
Figure 15:
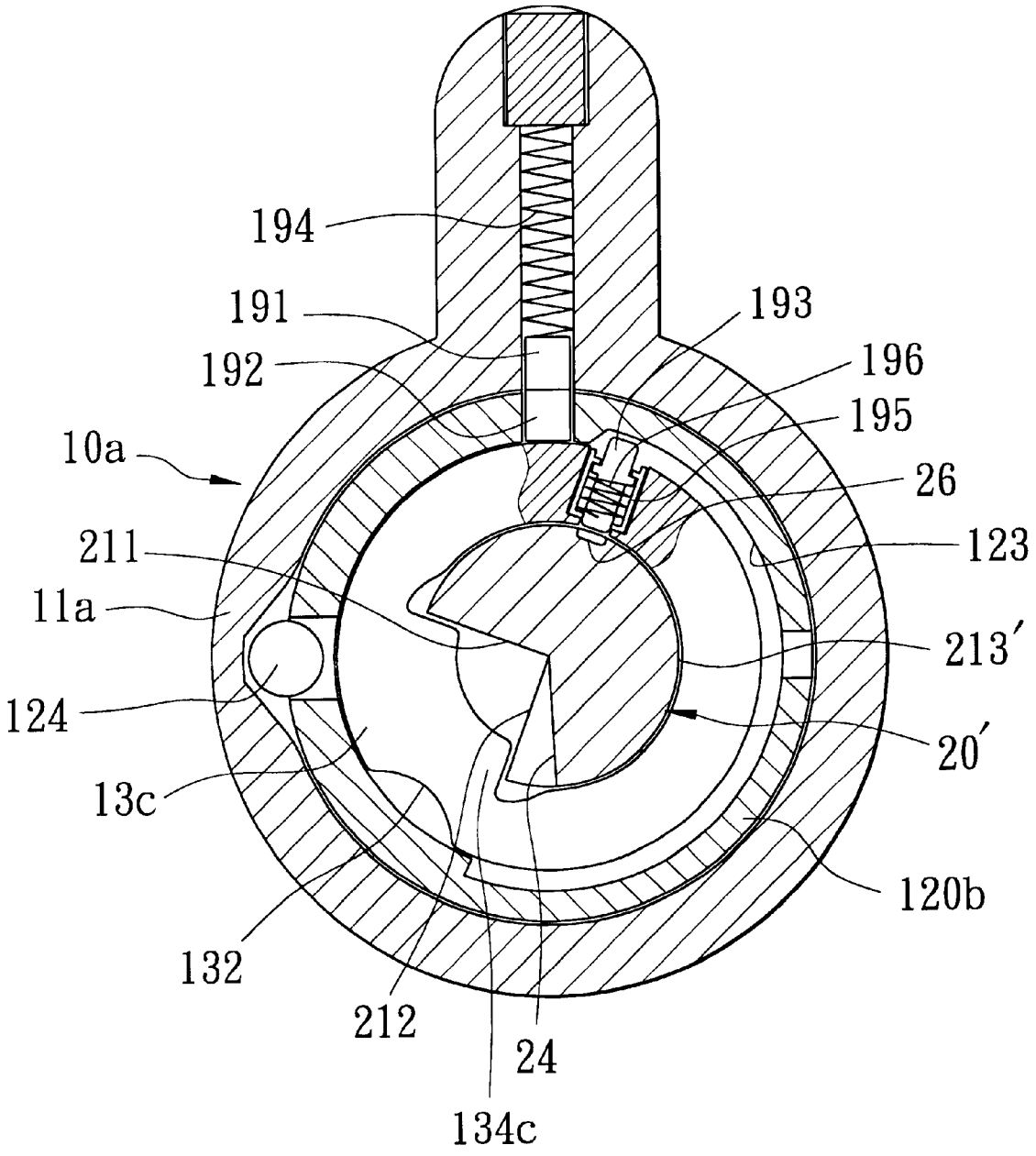
FIG. 15 is a cross-sectional view of the lock core device of the sixth preferred embodiment when the key is rotated in the lock core device, where the key is rotated and the third tumbler member is disengaged from the key.
Figure 16:
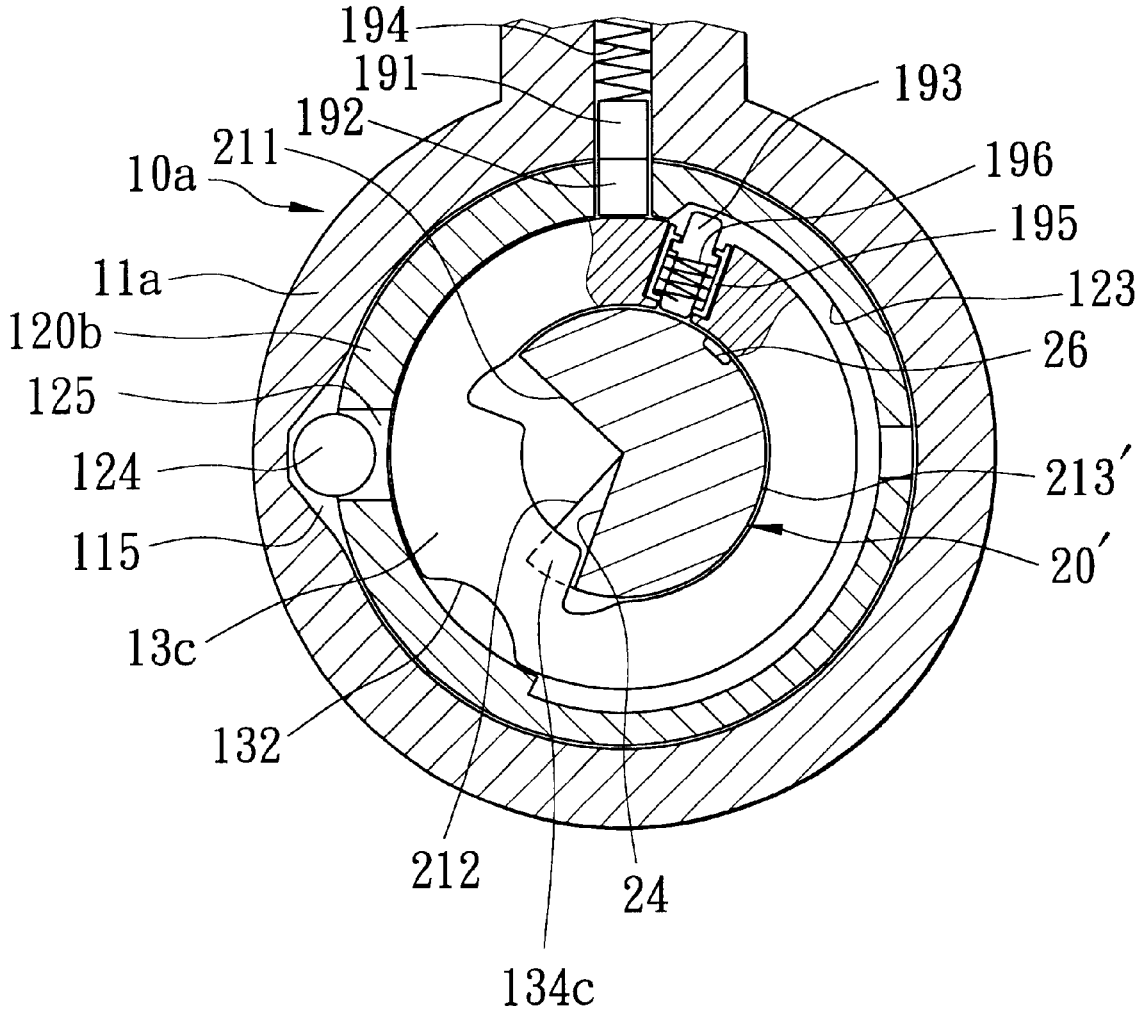
FIG. 16 is a cross-sectional view of the lock core device of the sixth preferred embodiment, where the key continues to rotate independently of a corresponding locking plate.
Figure 17:
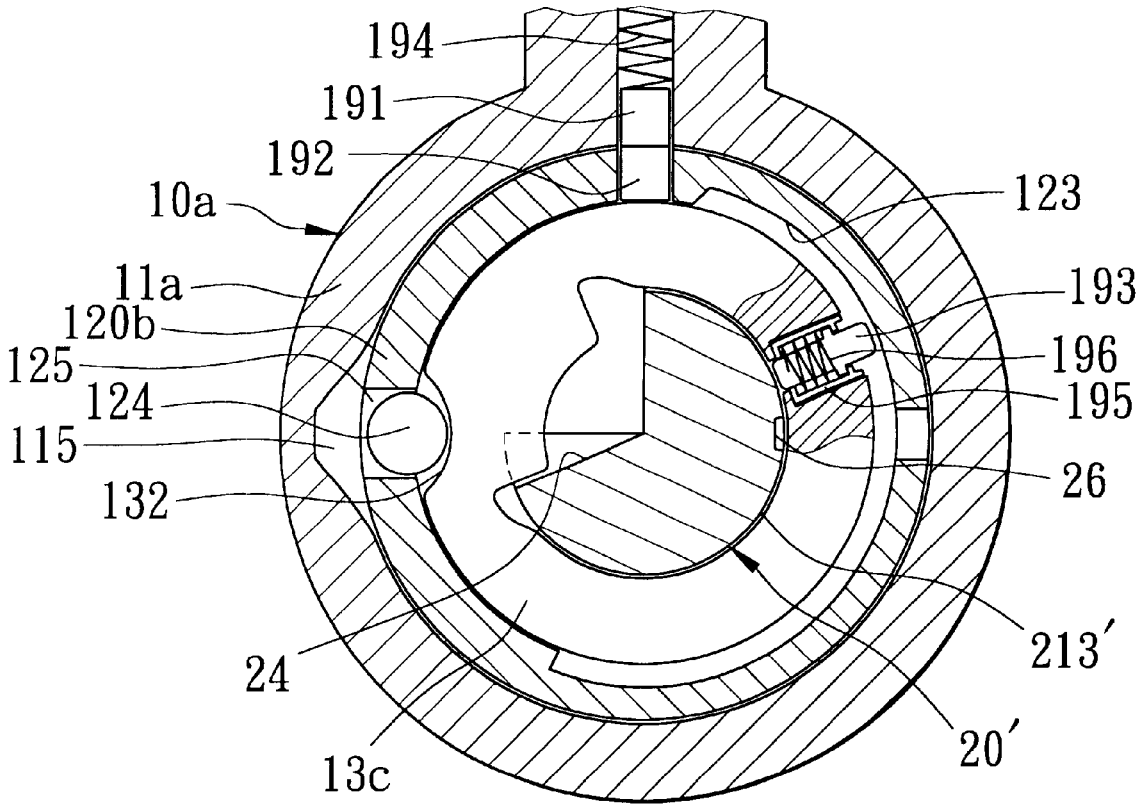
FIG. 17 is a cross-sectional view of the lock core device of the sixth preferred embodiment, where the key is rotated to unlock the lock core device.

Referring to FIGS. 12 and 13, in another preferred embodiment of the lock apparatus of the present invention, a plurality of spring-loaded tumbler units 19 are installed in the lock core device 10*a*. The lock casing 11*a* of the lock core device 10*a* is formed with a plurality of radial first tumbler holes 113*a*. The inner shell 120*b* is formed with a plurality of radial second tumbler holes 127*b*. Each of the locking plates 13*c* is formed with a radial third tumbler hole 133*c* that extends through inner and outer peripheries thereof. Each of the tumbler units 19 includes a first compression spring 194 and a first tumbler member 191 which are received in a respective one of the first tumbler holes 113*a* in the lock casing 11*a*, a second tumbler member 192 received in a respective one of the second tumbler holes 127*b* in the inner shell 120*b*, and a third tumbler member 193 and a second compression spring 196 which are received in the third tumbler hole 133*c* in a respective one of the locking plates 13*c*. Before insertion of the key 20*b* into the keyhole of the lock core device 10*a*, the first tumbler holes 113*a* are aligned respectively with the second tumbler holes 127*b* and with the third tumbler holes 133*c* in radial directions. In each of the tumbler units 19, the first compression spring 194 biases the first, second and third tumbler members 191, 192, 193 to move radially and inwardly so as to enable the first tumbler member 191 to project into a respective one of the second tumbler holes 127*b* in the inner shell 120*b*, to enable the second tumbler member 192 to project into the third tumbler hole 133*c* in a respective one of the locking plates 13*c*, and to enable the third tumbler member 193 to project radially from the inner periphery of the respective locking plate 13*c*. The third tumbler hole 133*c* in each of the locking plates 13*c* is provided with a mounting sleeve 195 within which the second compression spring 196 is installed. The second compression spring 196 biases the third tumbler member 193 in a radial outward direction toward the inner surface of the inner shell 120*b*. The curved surface 213' on the shank portion of the key 20' is formed with a plurality of tumbler recesses 26, each of which is defined by a recessed tumbler push wall. As shown in FIG. 13, before the key 20' is inserted into the keyhole, the engaging notches 132 on the locking plates 13*c* are misaligned with one another, and the locking rod 124 is forced by the outer peripheries of the locking plates 13*c* to extend into an axially extending locking groove 115 formed on the inner surface of the lock casing 11*a* in order to hinder rotation of the inner shell 120*b* relative to the lock casing 11*a*. Referring to FIG. 14, when the key 20' is inserted into the keyhole, the third tumbler member 193 of each of the tumbler units 19 projects into a respective one of the tumbler recesses 26 on the shank portion of the key 20'. Each of the tumbler recesses 26 has a predetermined depth such that the third tumbler member 193 of each of the tumbler units 19 is pushed by the tumbler push wall of the respective tumbler recess 26 in a radial outward direction against biasing action of the first compression spring 194 so as to retract the second tumbler member 192 into the second tumbler hole 127*b* in the inner shell 120*b* and to retract the first tumbler member 191 into the first tumbler hole 113*a*. At this time, engagement of the third tumbler member 193 with the respective tumbler recess 26 enables co-rotation of the respective locking plate 13*c* with the key 20'. Since the second tumbler member 192 ceases to hinder rotation of the respective locking plate 13*c* relative to the inner shell 120*b*, the locking plate 13*c* rotates with the key 20' by a certain angular range when the key 20' is rotated, such as in a clockwise direction shown in FIG. 15. The third tumbler member 193 then extends into the limiting groove 123 formed on the inner surface of the inner shell 120*b*, and is disengaged from the corresponding tumbler recess 26 and from the key 20' due to biasing action of the second compression spring 196. The key 20' continues to rotate relative to the locking plate 13*c* until the actuating surface of the key bit portion 24 that corresponds to the respective locking plate 13*c* is in contact with the key engaging protrusion 134*c* on the respective locking plate 13*c*, as shown in FIG. 16. Co-rotation of the key 12' and the respective locking plate 13*c* occurs once again at this moment due to the engagement between the key engaging protrusion 134*c* and the actuating surface of the corresponding key bit portion 24 on the key 20'. After the actuating surfaces of the key bit portions 24 on the key 20' drive the locking plates 13*c* to rotate by different angles to align the engaging notches 132 of the locking plates 13*c* with the axially extending slot 125 of the inner shell 120*b*, the locking rod 124 is extendible into the aligned engaging notches 132 and is disengaged from the locking groove 115, thereby permitting rotation of the inner shell 120*b* relative to the lock casing 11', as shown in FIG. 17.

Figure 18:
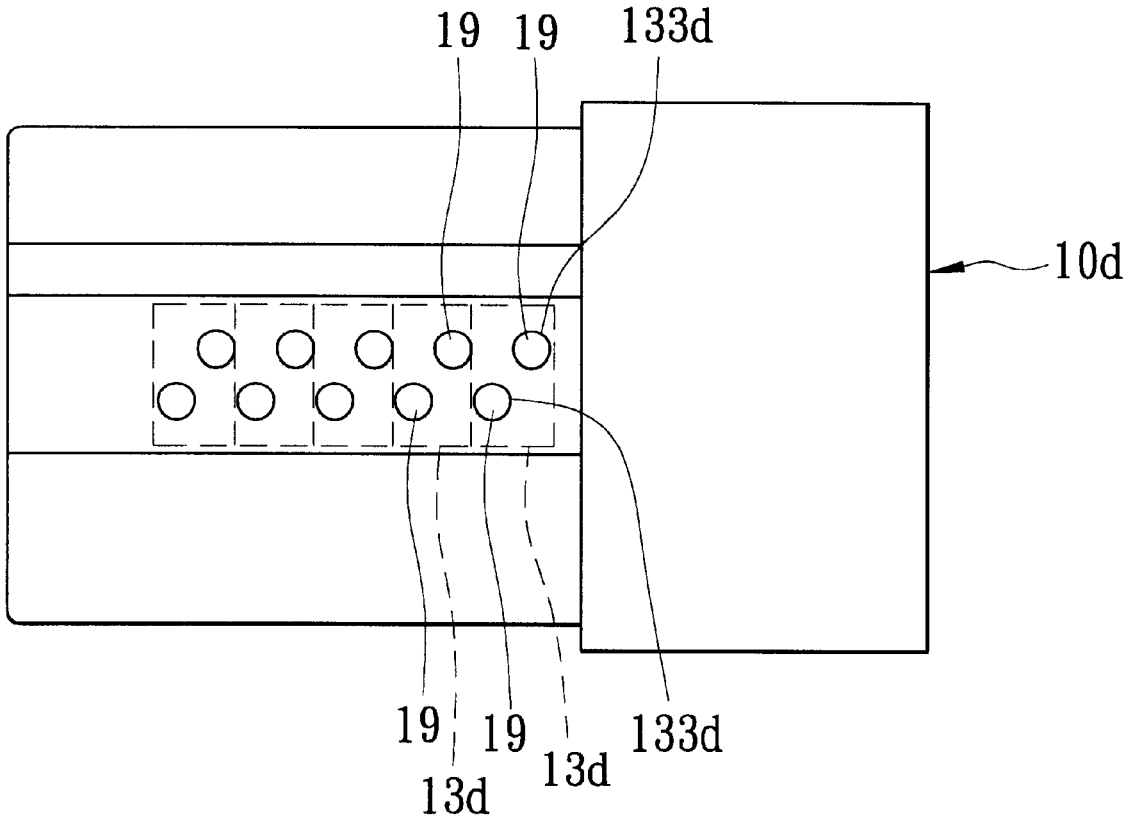
FIG. 18 is a schematic plan view of a lock core device of a seventh preferred embodiment of the lock apparatus of the present invention.
Figure 19:
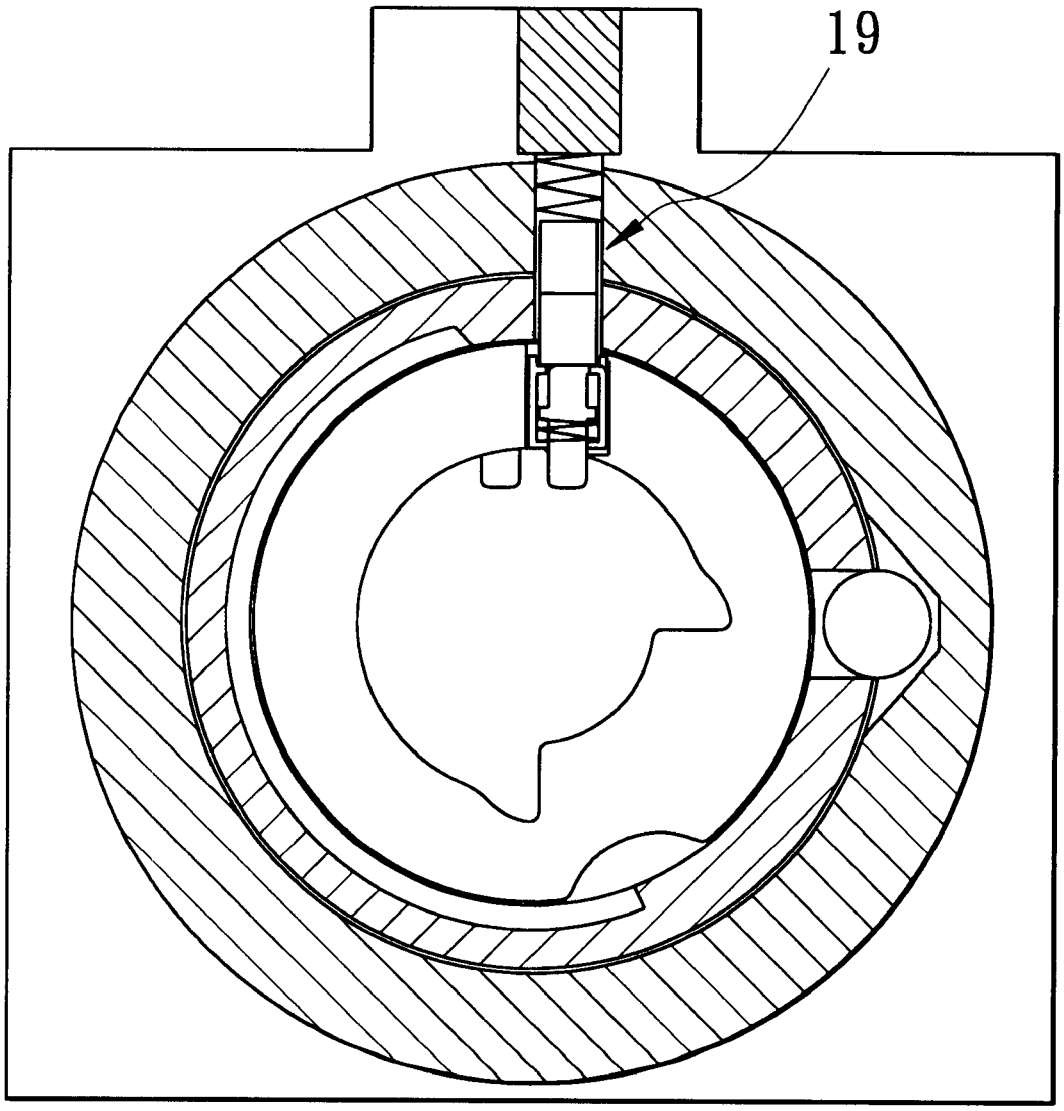
FIG. 19 is a cross-sectional view of the lock core device of the seventh preferred embodiment.

Referring to FIGS. 18 and 19, in another embodiment, a plurality of pairs of tumbler units 19 are installed in the lock core device 10*d*, in which each locking plate 13*d* has a thickness sufficient to form two tumbler holes 133*d* which are angularly and axially displaced from each other for receiving a respective pair of the tumbler units 19. When one of the pairs of the tumbler units 19 on one of the locking plates 13*d* is damaged, there remain one other tumbler unit 19 which engages said one of the locking plates 13*d* with the lock casing. An enhanced anti-theft effect can thus be achieved. Under this condition, the number of the locking plates 13*d* required in the lock core device 10*d* may be reduced, and the length of the lock core device 10*d* may be shortened.

Figure 20:
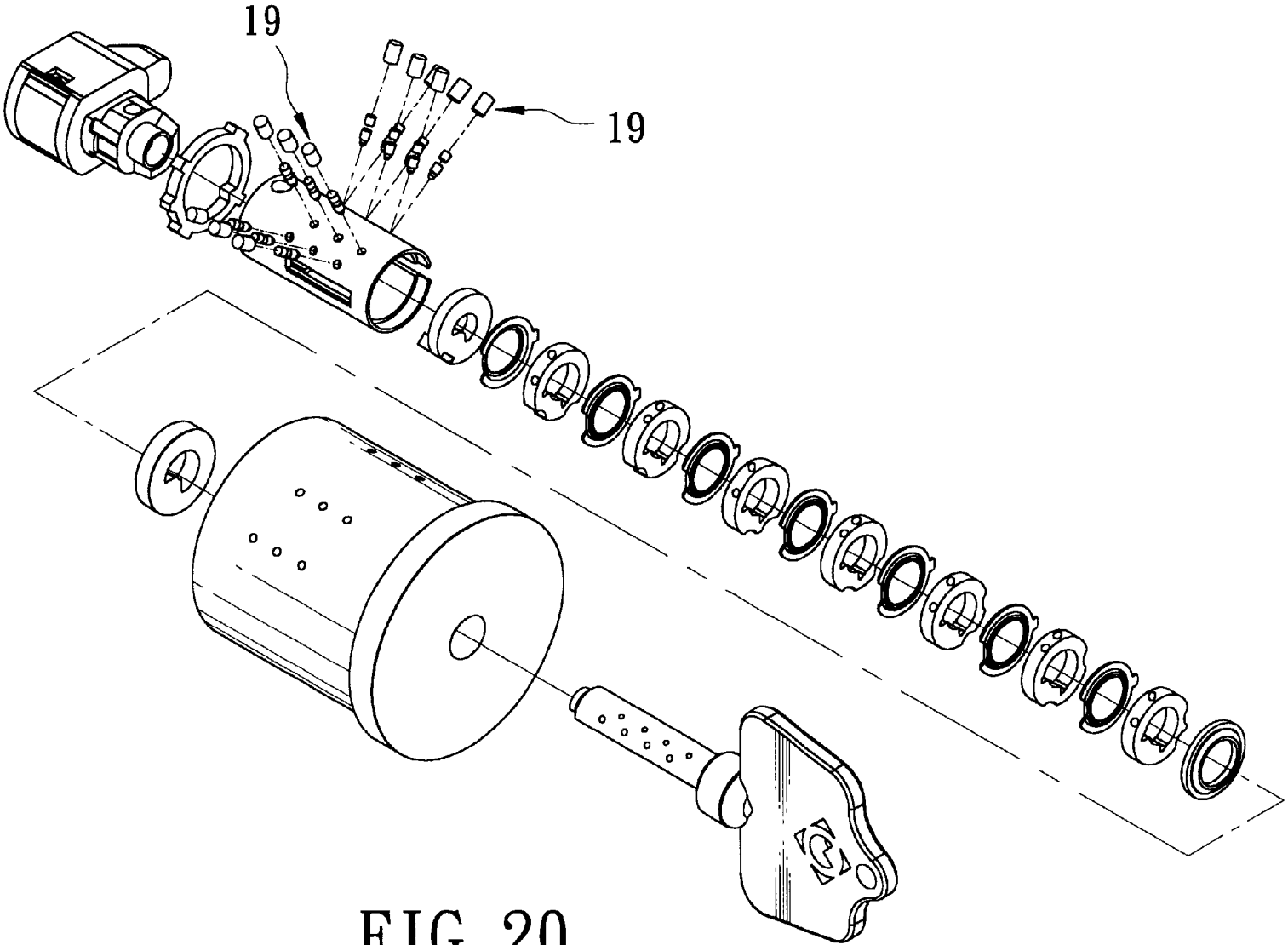
FIG. 20 is an exploded perspective view of a key and a lock core device of an eighth preferred embodiment of the lock apparatus of the present invention.
Figure 21:
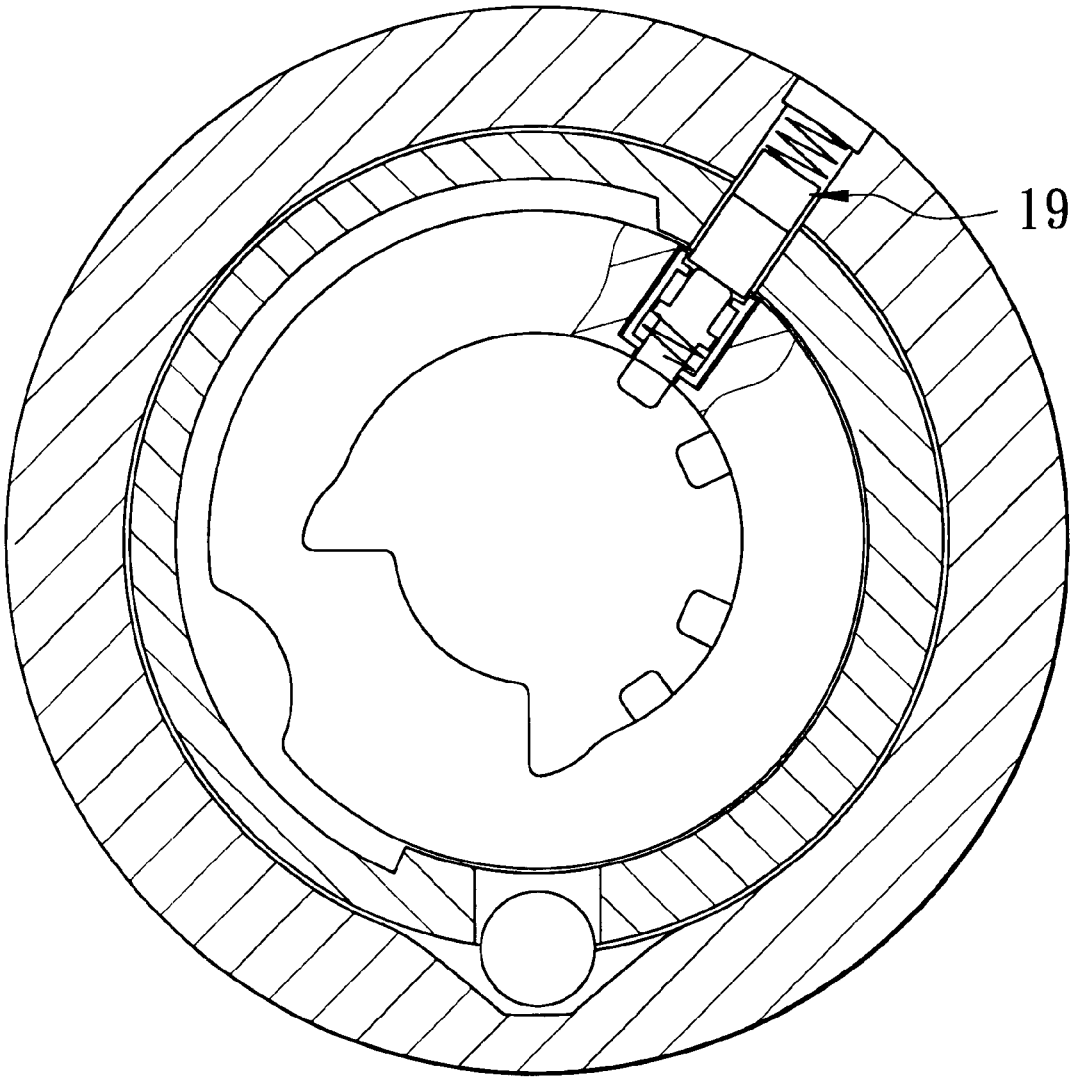
FIG. 21 is a cross-sectional view of a lock core device of a ninth preferred embodiment of the lock apparatus of the present invention.

In other embodiments, a plurality of tumbler units 19 are installed in a lock core device and are displaced angularly by predetermined angles. Examples of the lock core device of this type are shown in FIGS. 20 and 21.

The key 20 shown in FIGS. 1 and 2 is formed with key bit portions 24, 24*a* and an axially extending groove 25, and thus works to operate the lock core device 10, which is installed with the locking plates 13, 13', 13*a*, the drive plate 15, and the protective plate 16 that are each formed with the radial inward protrusion 133, 152, 162. The key 20' shown in FIG. 12 is formed with tumbler recesses 26 on its curved surface 213', and thus works to operate the lock core device 10*a* that is installed with the tumbler units 19. As such, a key of the type that is formed with the key bit portions 24, 24*a*, the engaging groove 25, and the tumbler recesses 26 work for operating any of the lock core devices described above.

Figure 22:
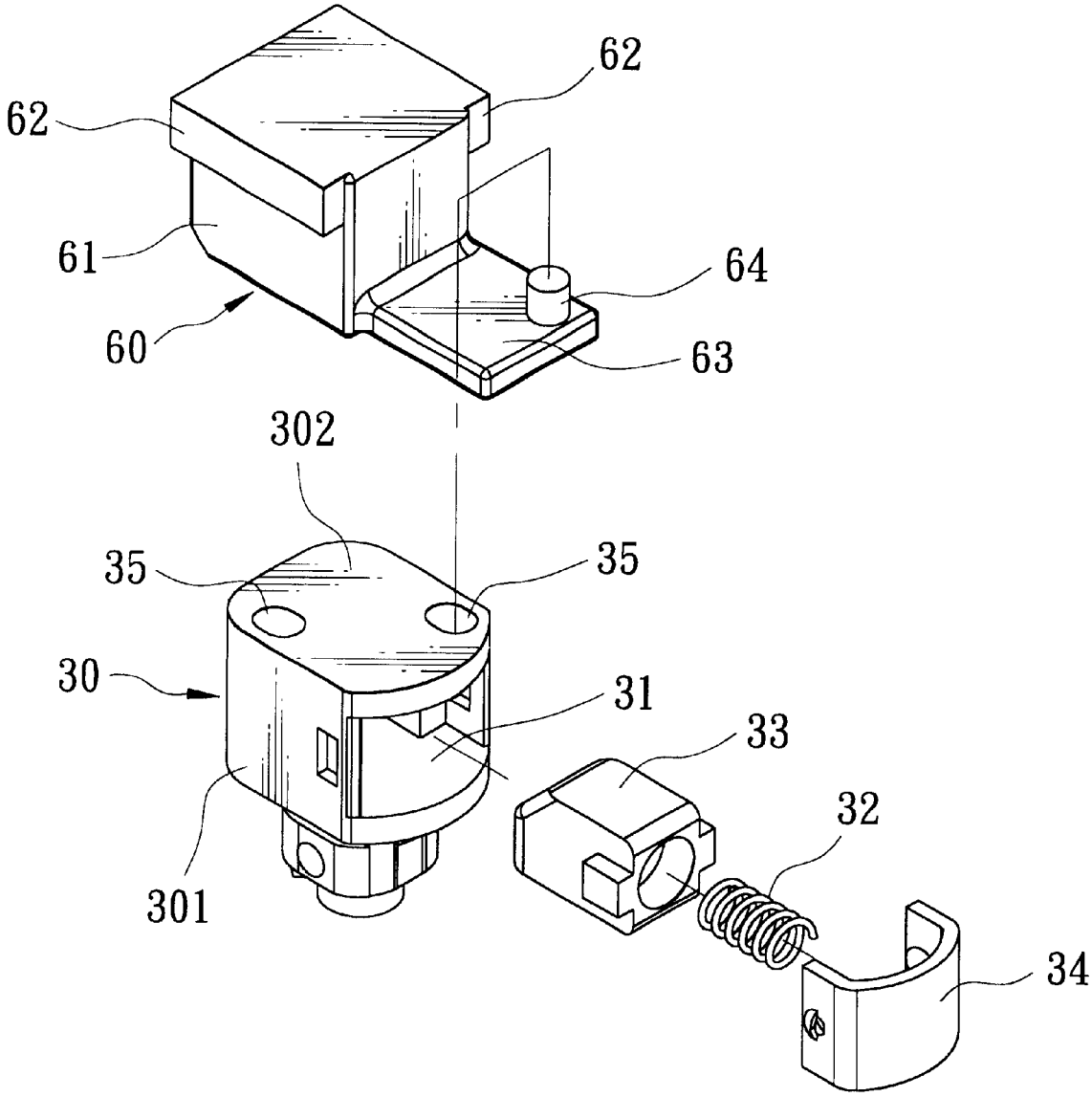
FIG. 22 is an exploded perspective view showing a latch member and a catch member of a tenth preferred embodiment of the lock apparatus of the present invention.
Figure 23:
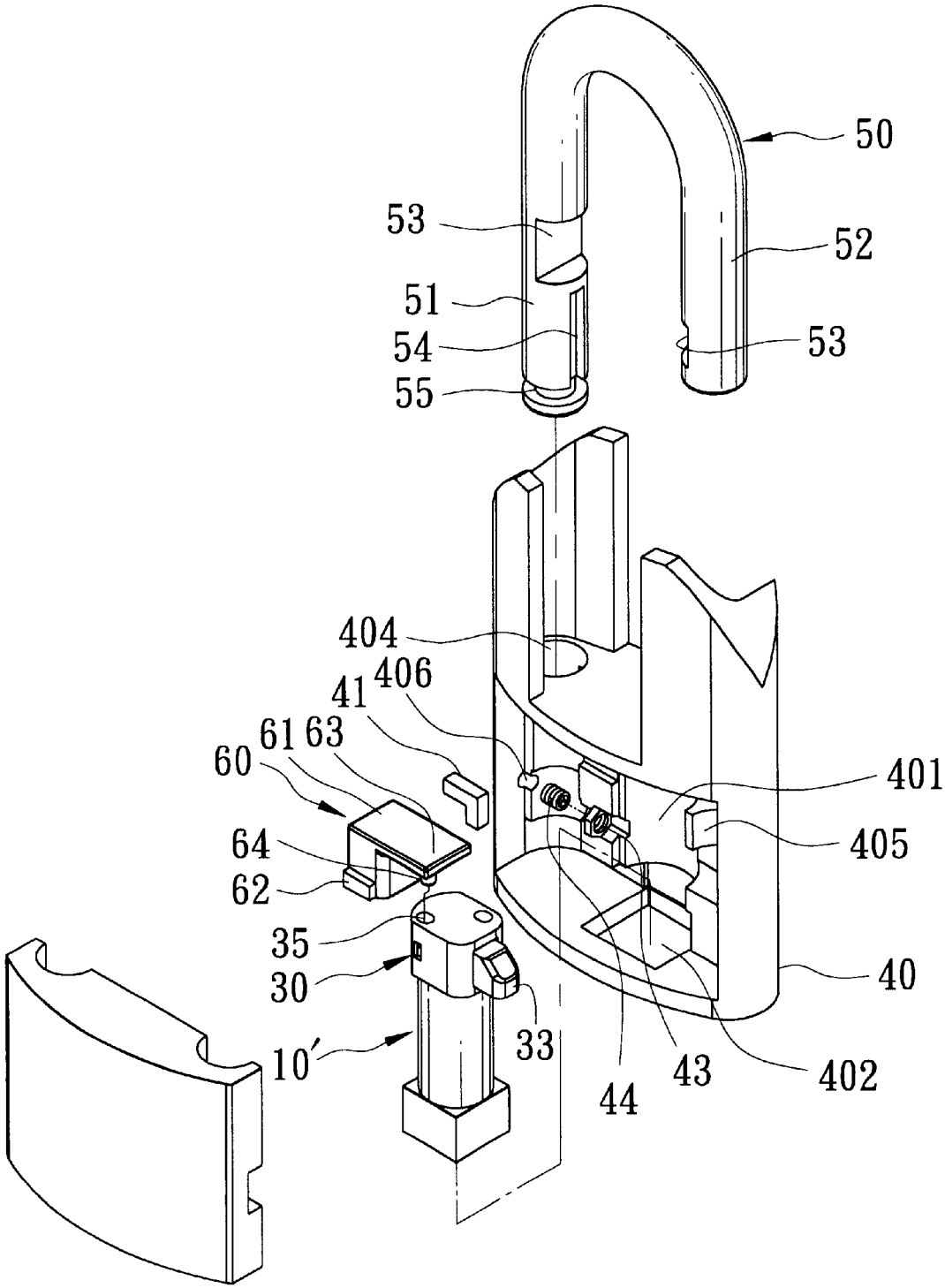
FIG. 23 is an exploded perspective view of the tenth preferred embodiment.
Figure 30:
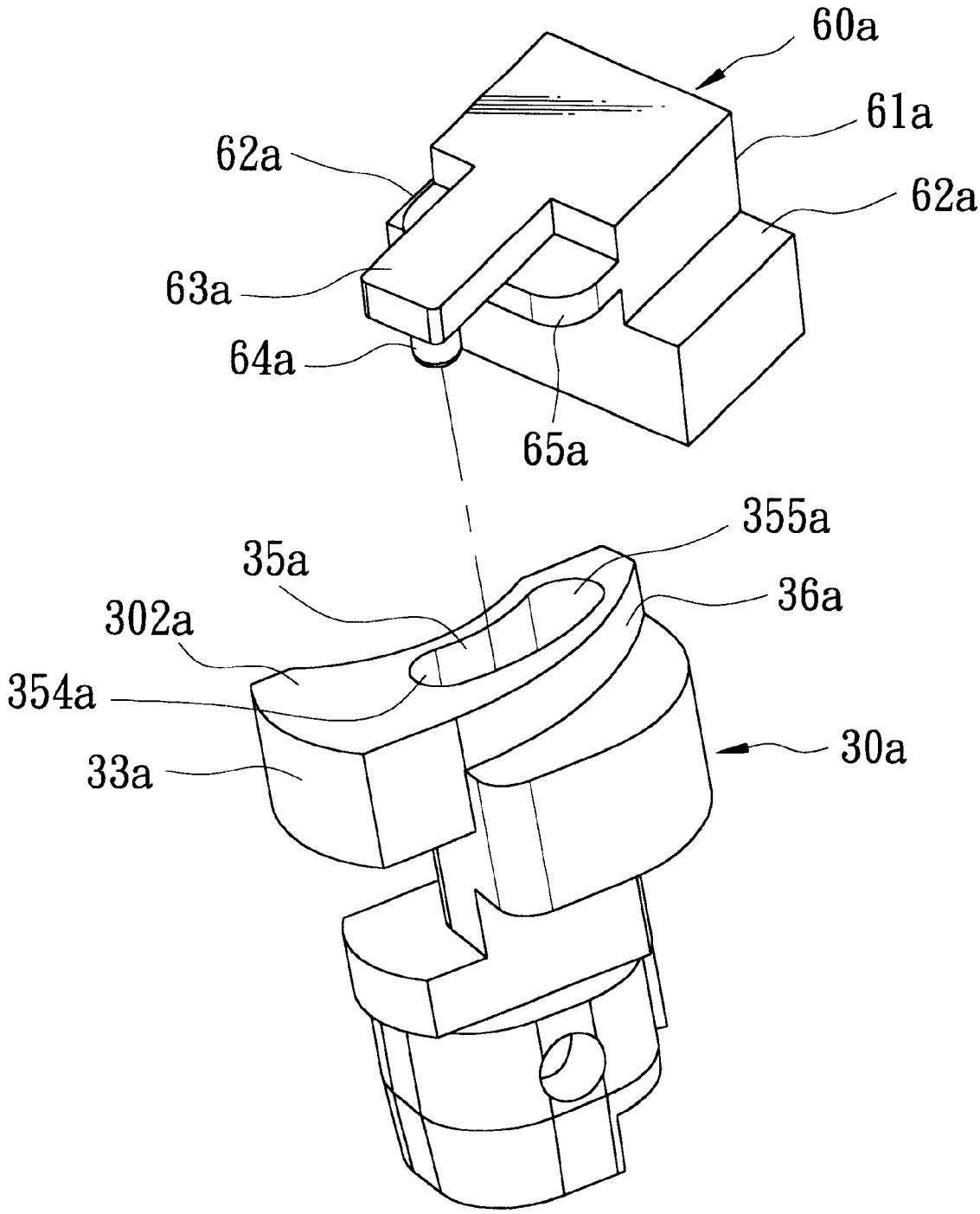
FIG. 30 is an exploded perspective view illustrating a catch member and a latch member of a fourteenth preferred embodiment of the lock apparatus of the present invention.

In the lock apparatus of the present invention, the latch member mounted on the rear end of the inner shell of the lock core may be one formed integrally with a plunger, such as the latch member 30' shown in FIG. 1 and the latch member 30*a* shown in FIG. 30, or one mounted resiliently with a plunger, such as the latch member 30 shown in FIG. 22. Referring to FIGS. 22 and 23, in another preferred embodiment, the latch member 30 is provided on a lock core device 10' and includes a latch base 301 which is formed with a cavity 31. A plunger 33 is installed in the cavity 31 in the latch base 301. A cover plate 34 is mounted on the latch base 301 for closing one end of the cavity 31. A compression spring 32 is disposed in the cavity 31 between the plunger 33 and the cover plate 34 for biasing the plunger 33 to extend out of the cavity 31 via an open end of the cavity 31 that opens in a direction transverse to the axis of the lock core device 10'. The latch member 30 has a distal end face 302 which is transverse to the axis of the lock core device 10' and which is formed with a pair of circular pin holes 35 that have axes eccentric to the axis of the lock core device 10' and that are symmetric to each other with respect to the axis of the lock core device 10'. A catch member 60 has a latch engaging end portion 63 formed with a pin 64 that extends rotatably into and that engages one of the pin holes 35 in the latch member 30, and a shackle engaging end portion 61 opposite to the latch engaing end portion 63. The catch member 60 has a pair of side walls, each of which has a sliding block 62 projecting therefrom. The sliding block 62 extends in a direction from the shackle engaging end portion 61 toward the latch engaging end portion 63.

Figure 24B:
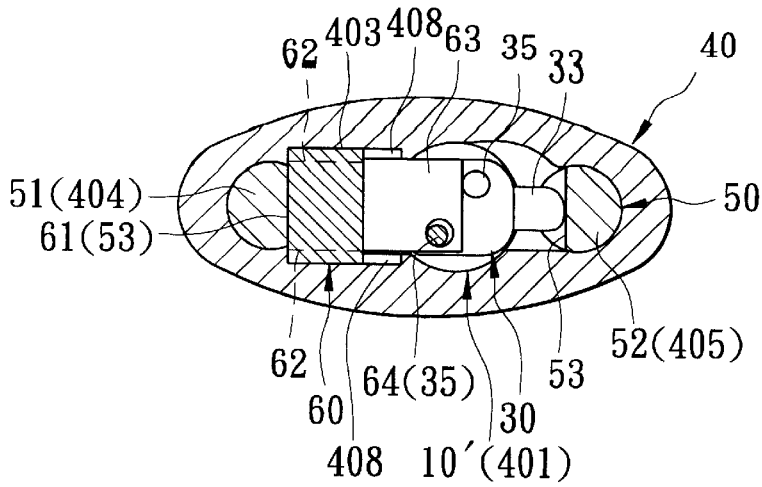
FIG. 24B is a cross-sectional view of the lock apparatus of FIG. 23 in the locking state.
Figure 24A:
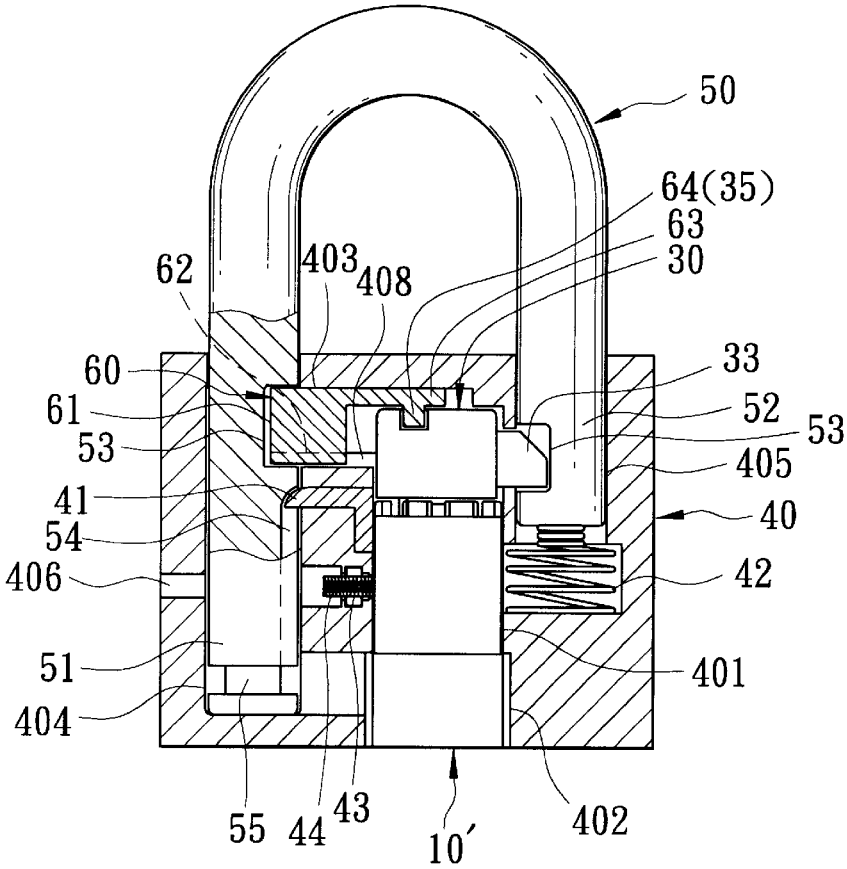
FIG. 24A is a sectional view of the lock apparatus of FIG. 23 in a locking state.
Figure 25B:
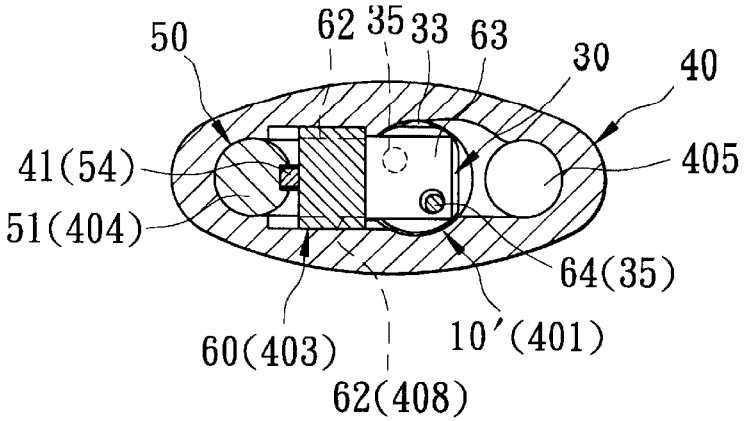
FIG. 25B is a cross-sectional view of the lock apparatus of FIG. 23 in the unlocking state.
Figure 25A:
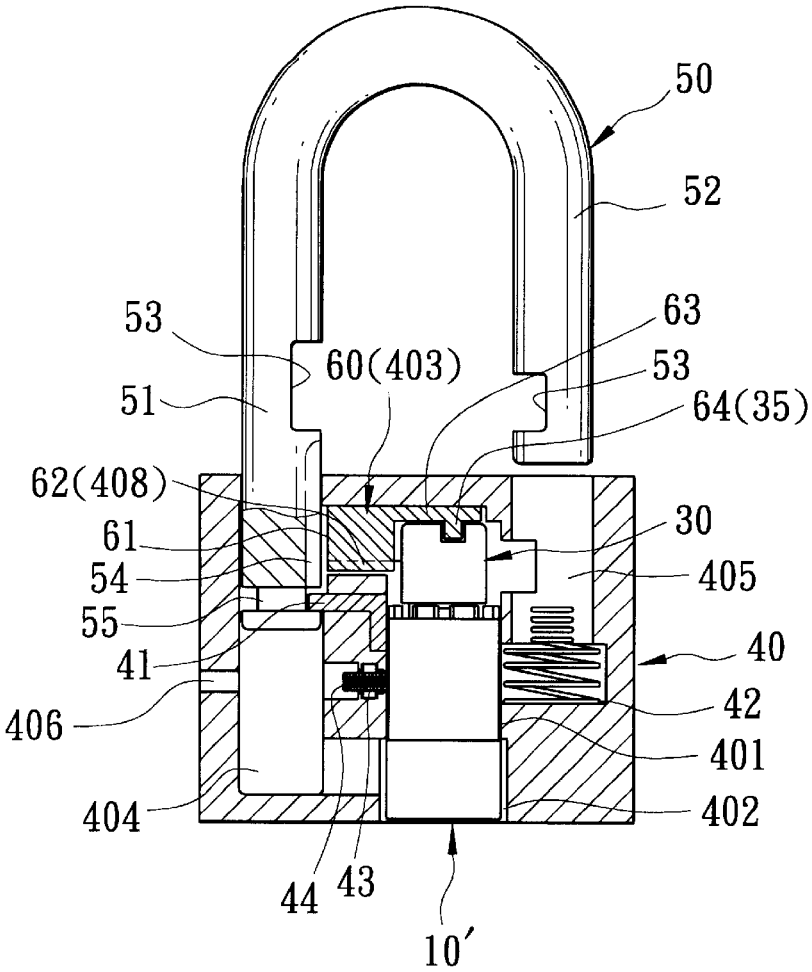
FIG. 25A is a sectional view of the lock apparatus of FIG. 23 in an unlocking state.

Referring to FIGS. 23, 24A and 24B, the lock apparatus of the present embodiment is in the form of a padlock which includes a lock body 40 formed with a lock core chamber 401 that extends from a bottom end of the lock body 40 toward a top end of the same for receiving a lock core device 10', and first and second shackle insert holes 404, 405 which extend from the top end toward the bottom end of the lock body 40. The lock core chamber 401 has an upper section formed as a catch chamber 403 which extends between and which is communicated with the first and second shackle insert holes 404, 405 for accommodating the latch member 30 and the catch member 60. A rectangular lock core opening 402 is formed in a bottom wall of the lock body 40 for access to the lock core chamber 401. A shackle member 50 with an inverted U-shaped configuration has longer and shorter leg portions 51, 52 extending respectively into the first and second shackle insert holes 404, 405. Each of the longer and shorter leg portions 51, 52 is formed with a shackle groove 53. The longer leg portion 51 is further formed with a longitudinally extending retaining groove 54 and an annular groove 55 adjacent to a distal end of the longer leg portion 51 and communicated with the retaining groove 54. The retaining groove 54 does not extend to the shackle groove 53 on the longer leg portion 51 such that the shackle member 50 has an increased strength to resist an external pulling force. The lock body 40 is installed with an L-shaped retaining member 41 which has one end extending into the retaining groove 54. A compression spring 42 is disposed deep within a bottom end of the second shackle insert hole 405 for biasing the shorter leg portion 52 upwardly. When the lock core device 10' is in a locking position shown in FIGS. 24A and 24B, the shackle engaging end portion 61 of the catch member 60 extends into the first shackle insert hole 404 for engaging the shackle groove 53 on the longer leg portion 51, and the plunger 33 extends into the second shackle insert hole 405 for engaging the shackle groove 53 on the shorter leg portion 52. Referring to FIGS. 25A and 25B, when the lock core device 10' is operated to dispose the latch member 30 in the unlocking position, the plunger 33 turns with the latch member 30 to retract into the catch chamber 403, and the latch member 30 pulls the catch member 60 so as to retract the shackle engaging end portion 61 of the catch member 60 into the catch chamber 403. The shackle member 50 is thus disengaged from the catch member 60 and the plunger 33, and springs upwardly due to biasing action of the compression spring 42, thereby permitting removal of the shorter leg portion 52 from the second shackle insert hole 405. At this time, the retaining member 41 extends into the annular groove 55 to prevent removal of the longer leg portion 51 from the lock body 40.

The engagement between the pin 64 on the catch member 60 and the pin hole 35 in the latch member 30 provides the catch member 60 and the padlock with an increased impact strength such that the catch member 60 is not susceptible to undesired displacement within the lock body 40 and undesired disengagement from the latch member 30 when the padlock is subjected to strong impact.

Referring back to FIG. 23, the lock body 40 is mounted fixedly with a nut 43 which is disposed within the lock body 40 between the lock core chamber 401 and the first shackle insert hole 404. A threaded rod 44 extends threadedly through the nut 43 and has one end abutting tightly against an outer surface of the lock core device 10' for retaining the lock core device 10' in the lock core chamber 401. The lock body 40 has a lateral side wall adjacent to the first shackle insert hole 404 and formed with an aperture 406 that is communicated with the first shackle insert hole 404 and that is aligned with the threaded rod 44. When the padlock is in the locking state, as shown in FIG. 24A, the aperture 406 is blocked by the longer leg portion 51 to prevent access to the threaded rod 44. When the padlock is in the unlocking state, as shown in FIG. 25A, the threaded rod 44 is accessible by a tool (not shown) extending into the aperture 406 and is operable by the tool for disengaging from the lock core device 10' so as to permit removal of the lock core device 10' from the lock body 40 for replacement of the lock core device 10'.

Referring again to FIGS. 24A and 24B, the catch chamber 403 is formed in the lock body 40 between confronting front and rear walls, each of which is formed with a slide groove 408 for receiving a respective one of the sliding blocks 62 on the catch member 60. The sliding blocks 62 are slidable along the slide grooves 408 when the catch member 60 is pushed by the latch member 30 to move to the locking position shown in FIGS. 24A and 24B, and when the catch member 60 is pulled by the latch member 30 to move to the unlocking position shown in FIGS. 25A and 25B. The provision of the slide grooves 408 in the lock body 40 and the sliding blocks 62 on the catch member 60 further enhances impact resistance of the padlock, and increases strength of the padlock to resist external pulling forces applied in opposite directions to the shackle member 50 and the lock body 40, respectively.

Figure 26B:
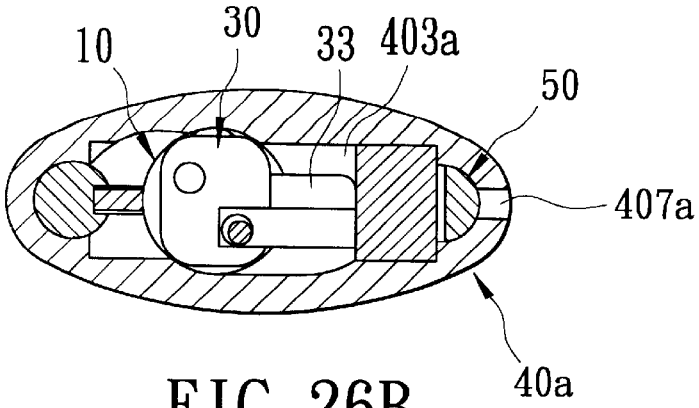
FIG. 26B is a cross-sectional view of the eleventh preferred embodiment in the locking state.
Figure 26A:
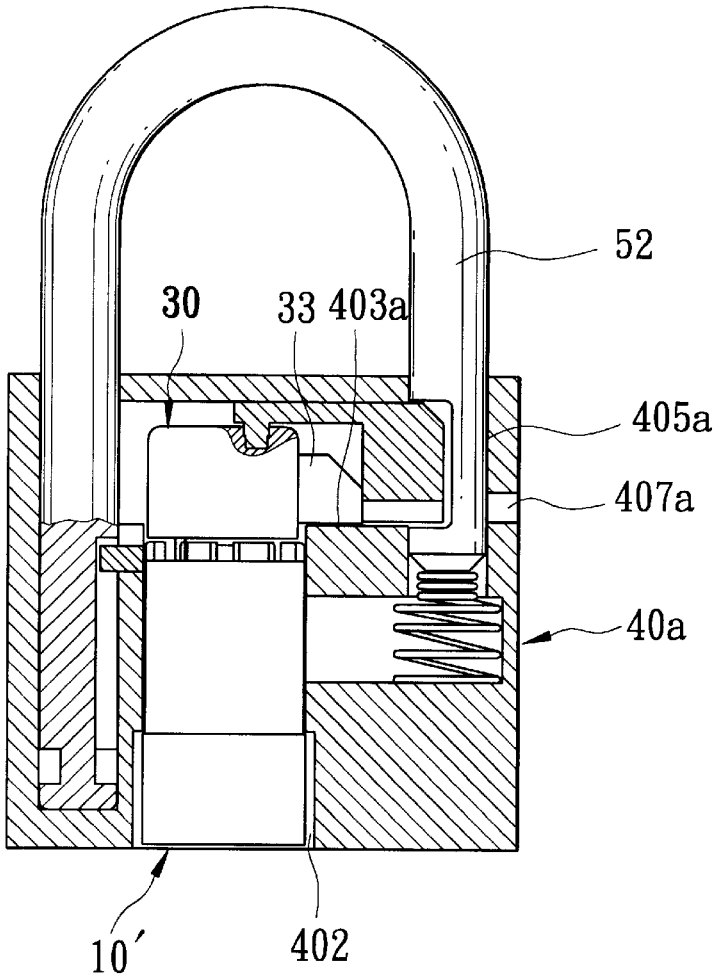
FIG. 26A is a sectional view of a eleventh preferred embodiment of a lock apparatus of the present invention in a locking state.

Referring to FIGS. 26A and 26B, in another embodiment of the present invention, the plunger 33 engages resiliently an inner side wall 403*a* in a catch chamber of a lock body 40*a* to prevent removal of the lock core device 10' from the lock body 40*a*. An aperture 407*a* is formed in a lateral side wall of the lock body 40*a* and is communicated with the second shackle insert hole 405*a*. To remove the lock core device 10' for replacement purposes, the lock core device 10' is first operated to unlock the padlock so as to permit removal of the shorter leg portion 52 from the second shackle insert hole 405*a*. Then, a tool (not shown) is extended into the aperture 407*a* to depress the plunger 33 for retracting the plunger 33 into the cavity 31 (see FIG. 22) in the latch base 301 of the latch member 30. The latch member 30 is thus disengaged from the inner side wall 403*a* of the lock body 40*a* to permit removal of the lock core device 10' from the lock body 40*a* via the lock core opening 402.

Figure 27A:
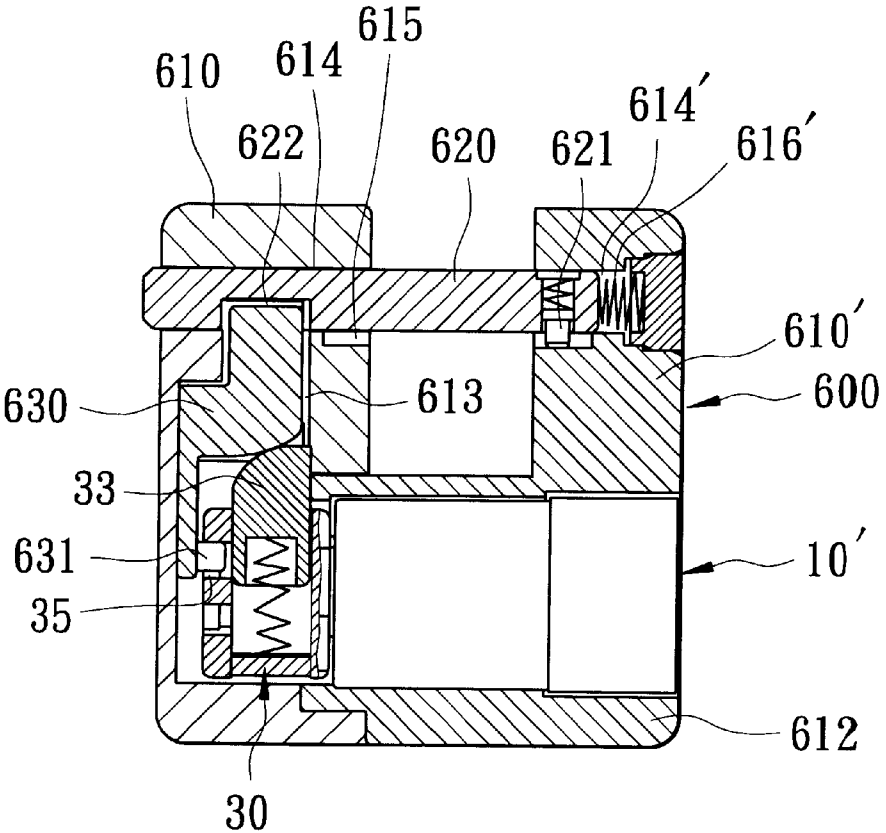
FIG. 27A is a sectional view of a twelfth preferred embodiment of the lock apparatus of the present invention in a locking state.
Figure 27B:
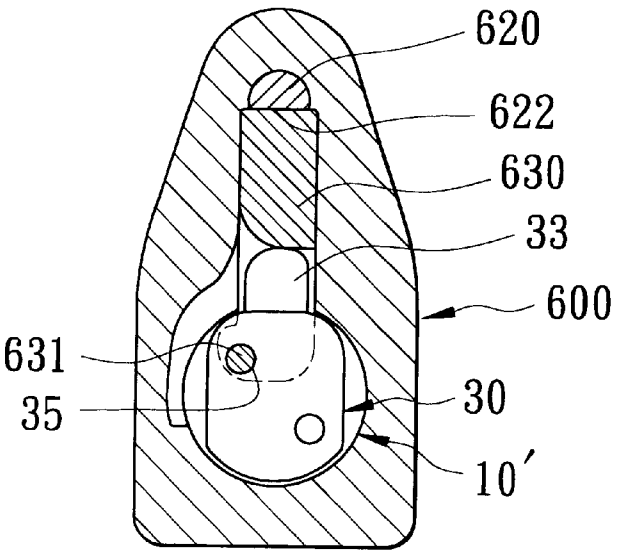
FIG. 27B is a cross-sectional view of the twelfth preferred embodiment in the locking state.

Referring to FIGS. 27A and 27B, yet another preferred embodiment of the lock apparatus of the present invention is shown to be in the form of a padlock with a U-shaped lock body 600 that has a lock core mounting portion and parallel first and second shackle mounting portions 610, 610' which extend upwardly from the lock core mounting portion 612 and which are spaced-apart from each other. The lock core device 10' is received in a lock core chamber formed in the lock core mounting portion 612. A catch member 630 has a pin 631 engaging one of the pin holes 35 in the latch member 30. The catch member 630 and the latch member 30 are disposed in a catch chamber 613 that extends from one end of the lock core chamber into the first shackle mounting portion 610 and that is communicated with a shackle insert hole 614 formed through the first shackle mounting portion 610. When the padlock is in a locking state, a shackle bar 620 extends transversely between shackle insert holes 614, 614' formed in the first and second shackle mounting portions 610, 610', and has a shackle groove 622 that engages the shackle engaging end portion of the catch member 630. When the lock core device 10' is operated to rotate the latch member 30 to the unlocking position, the catch member 630 is pulled by the latch member 30 to retract into the catch chamber 613 for disengaging from the shackle groove 622 in the shackle bar 620. The shackle bar 620 springs leftwardly due to biasing action of a compression spring 616 installed in the shackle insert hole 614' in the second shackle mounting portion 610', and is removed from the second shackle mounting portion 610'. The shackle bar 620 is provided with a spring-loaded stop member 621 which engages a retaining groove 615 formed in the first shackle mounting portion 610 to prevent removal of the shackle bar 620 from the lock body 600 when the padlock is unlocked.

Figure 28B:
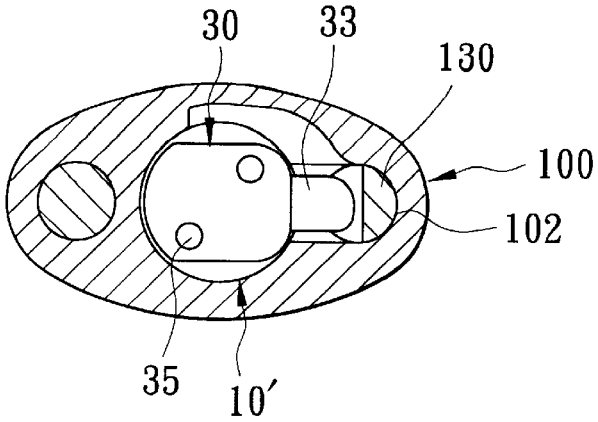
FIG. 28B is a cross-sectional view of the padlock of FIG. 28A.
Figure 28A:
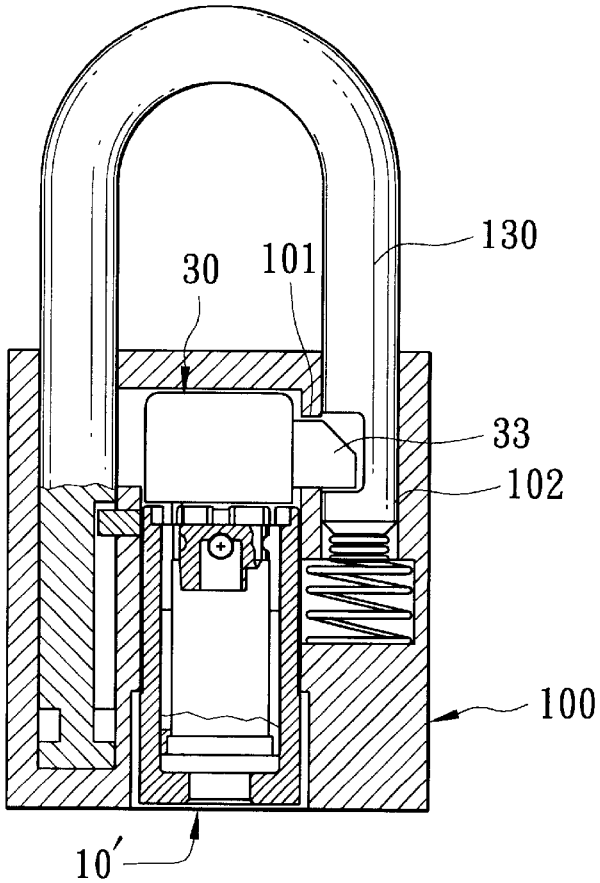
FIG. 28A is a sectional view of a padlock incorporating a lock core device of the twelfth preferred embodiment.

It is noted that the lock core device 10 in the lock apparatus of the present invention is also useful in a conventional lock apparatus which does not includes a catch member, such as a padlock 100 shown in FIGS. 28A and 28B. As shown, the plunger 33 projects resiliently from the latch member 30 in a direction transverse to the axis of the lock core device 10'. When the lock core device 10' is in the locking position, the plunger 33 extends through a plunger passage 101 between a lock core chamber and a shackle insert hole 102 of a lock body of the padlock 100, and projects into the shackle insert hole 102 for engaging the shorter leg portion 130 of a shackle member. By operating the lock core device 10' to rotate the latch member 30 to the unlocking position, the plunger 33 turns with the latch member 30 and moves into the lock core chamber to disengage from the shorter leg portion 130, thereby unlocking the padlock 100.

Figure 29:
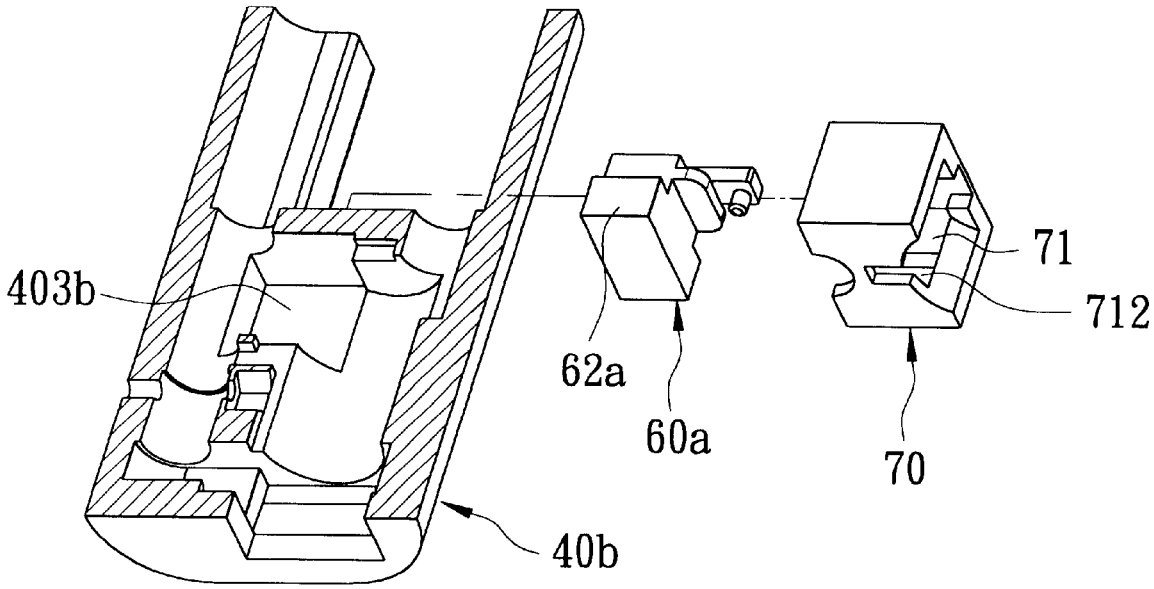
FIG. 29 is a fragmentary, partly sectioned, exploded perspective view showing a thirteen preferred embodiment of the lock apparatus of the present invention.

Referring to FIG. 29, in another embodiment of the lock apparatus according to the present invention, the lock body 40*b* is provided with a protective sleeve 70 which is disposed fittingly in the catch chamber 403*b*. The protective sleeve 70 has an inner surface that defines a cavity 71 with opposite open ends for receiving a catch member 60*a*, and that is formed with a pair of confronting slide grooves 712 which extend between the opposite open ends of the cavity 71. The sliding blocks 62*a* on the catch member 60*a* extend respectively into the slide grooves 712 and are slidable along the slide grooves 712. The protective sleeve 70 is preferably formed from a high strength metal alloy to protect the catch member 60*a* from being damaged by a drilling action.

Referring to FIG. 30, in still another embodiment of the lock apparatus of the present invention, a latch member 30*a* is shown to be formed integrally with a plunger 33*a*, and has a distal end face 302*a* formed with a pin hole 35*a* which is in the form of a curved slot extending along a curved line on the end face 302*a* and which has opposite first and second ends 354*a*, 355*a*. The latch member 30*a* has a curved pushing surface 36*a* which is adjacent and transverse to the end face 302*a* of the latch member 30*a*. A catch member 60*a* has a latch engaging end portion 63*a* which is formed with a pin 64*a* that extends into the pin hole 35*a* in the latch member 30*a*, a shackle engaging end portion 61*a* opposite to the latch engaging end portion 63*a*, and two opposite side walls formed with sliding blocks 62*a* that extend in a direction from the shackle engaging end portion 61*a* toward the latch engaging end portion 63*a*. The catch member 60*a* is formed with an abutment wall 65*a* to contact the pushing surface 36*a* of the latch member 30*a* so as to be actuated thereby.

Figure 31B:
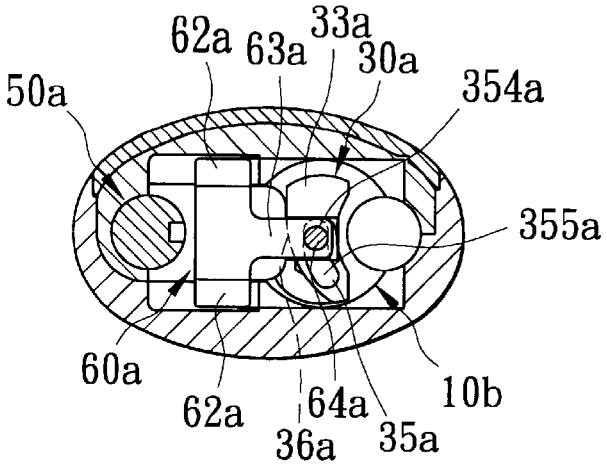
FIG. 31B is a cross-sectional view of the lock apparatus of the fourteenth preferred embodiment in the unlocking state.
Figure 31A:
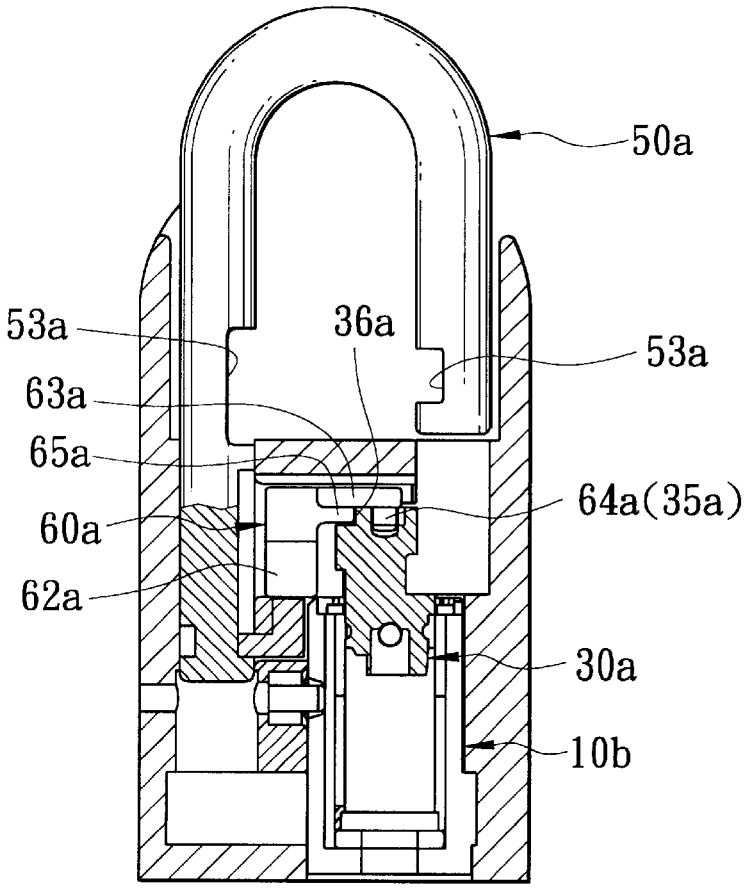
FIG. 31A is a sectional view of the lock apparatus of the fourteenth preferred embodiment in an unlocking state.
Figure 32B:
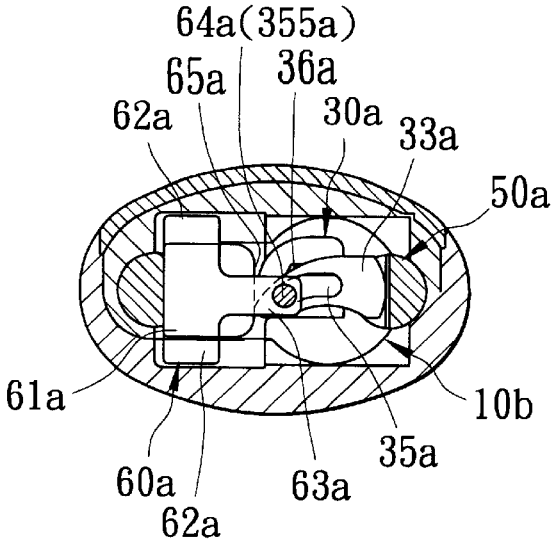
FIG. 32B is a cross-sectional view of the lock apparatus of the fourteenth preferred embodiment in the locking state.
Figure 32A:
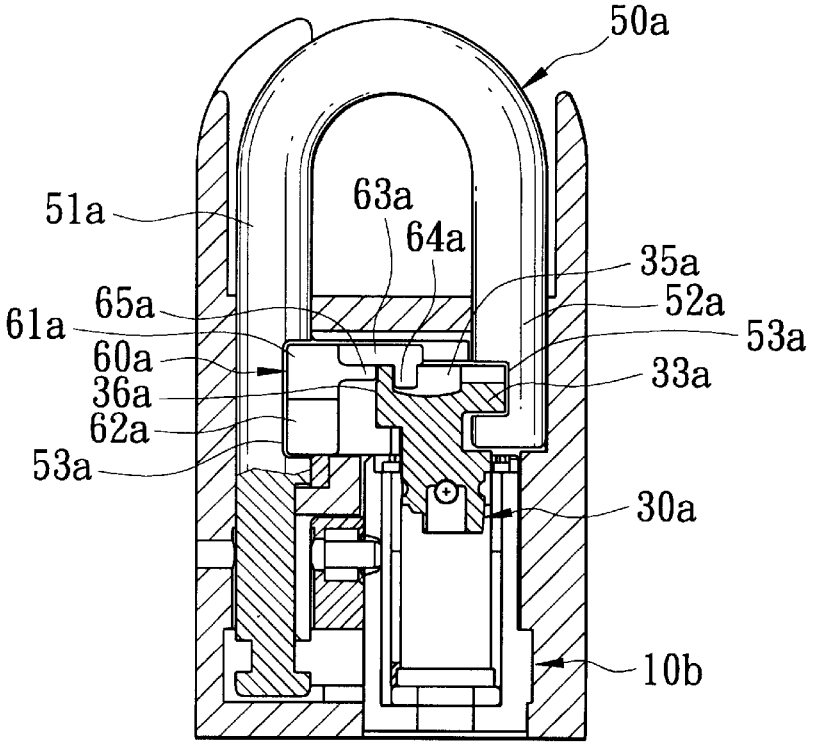
FIG. 32A is a sectional view of the lock apparatus of the fourteenth preferred embodiment in a locking state.

Referring to FIGS. 31A and 31B, in the present embodiment, the lock apparatus of the present invention is formed as a padlock with a lock body formed with a lock core chamber that has the lock core device 10*b* received therein. The latch member 30*a* and the catch member 60*a* are received in a catch chamber that is communicated with first and second shackle insert holes of the lock body. When the lock core device 10*b* is operated to rotate the latch member 30*a* to the unlocking position, the plunger 33*a* turns with the latch member 30*a* and retracts into the catch chamber for disengaging from the shorter leg portion 52*a* of a shackle member 50*a*, and the latch member 30*a* pulls the catch member 60*a* so as to retract the catch member 60*a* into the catch chamber for disengaging from the longer leg portion 51*a* of the shackle member 50*a*. At this time, the pin 64*a* of the catch member 60*a* is disposed at the first end 354*a* of the pin hole 35*a*. Referring to FIGS. 32A and 32B, when the lock core device 10*a* is operated to rotate the latch member 30*a* to the unlocking position, the plunger 33*a* turns with the latch member 30*a* and extends into the second shackle insert hole for engaging the shackle groove 53*a* in the shorter leg portion 52*a* of the shackle member 50*a*. The curved pushing surface 36*a* of the latch member 30*a* pushes the abutment wall 65*a* of the catch member 60*a* and forces the catch member 60*a* to move apart from the latch member 30*a*, thereby enabling the shackle engaging end portion 61*a* of the catch member 60*a* to extend into the first shackle insert hole to engage the shackle groove 53*a* in the longer leg portion 51*a* of the shackle member 50*a*, and thereby moving the pin 64*a* to the second end 355*a* of the pin hole 35*a*.

Figure 33:
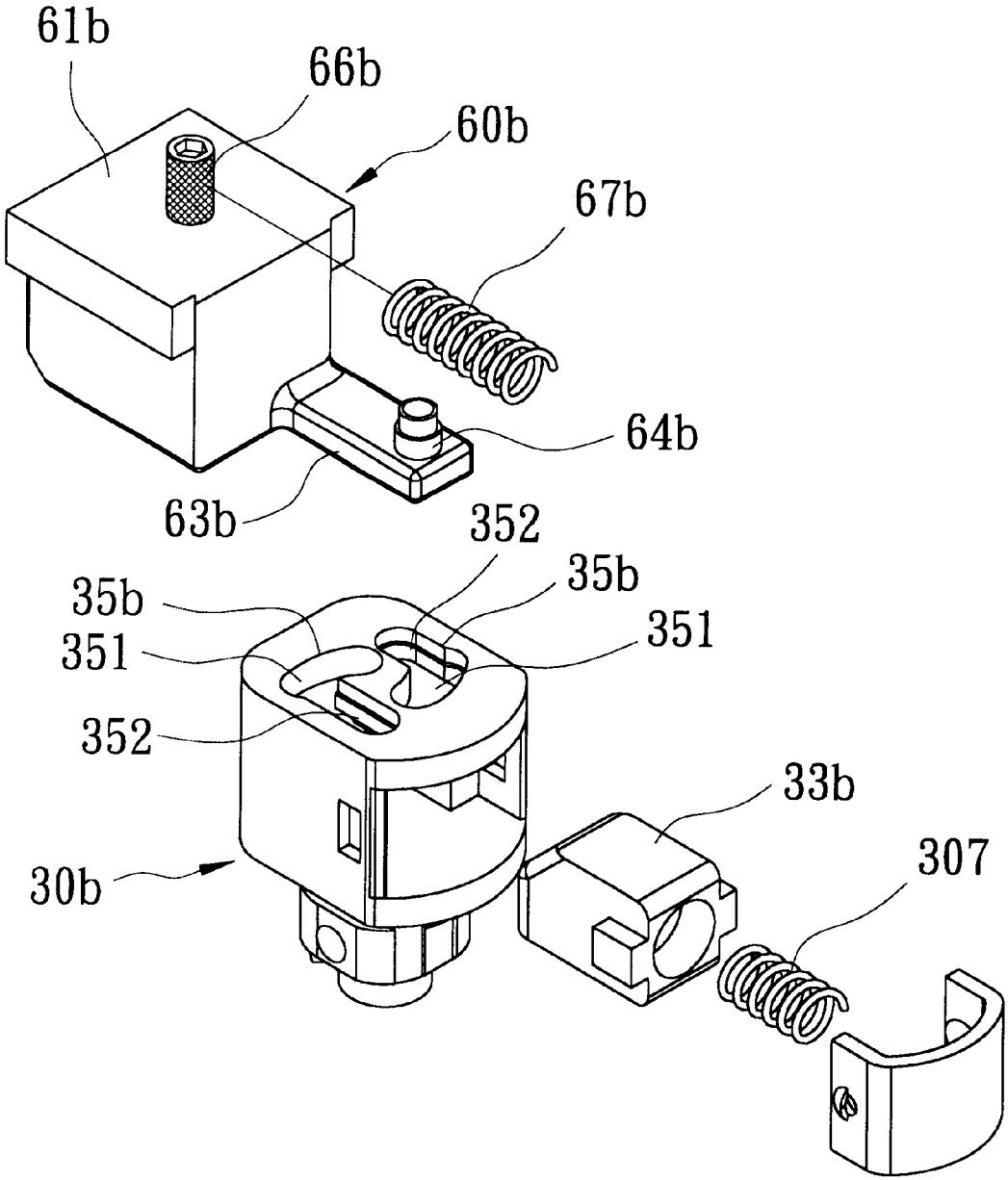
FIG. 33 is an exploded perspective view illustrating a catch member and a latch member of a fifteenth preferred embodiment of the lock apparatus of the present invention.
Figure 34:
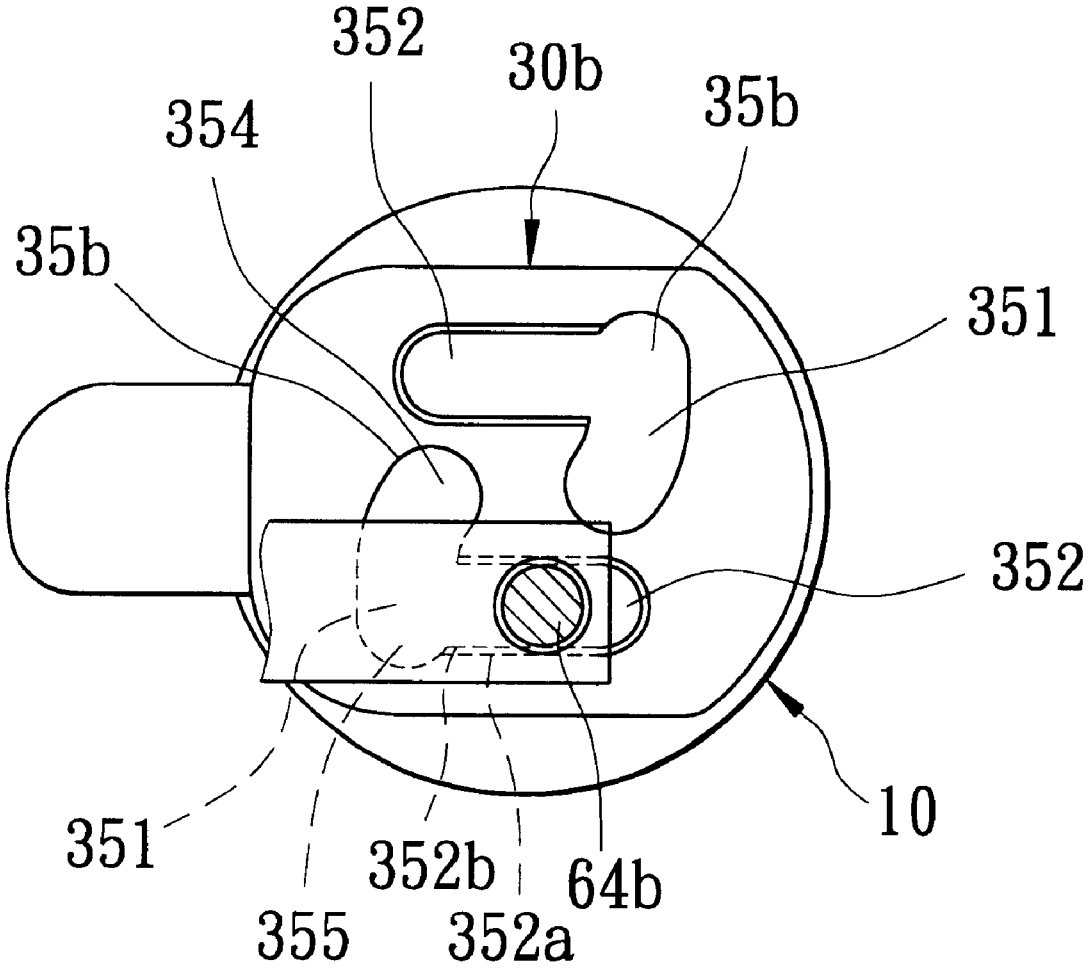
FIG. 34 is a top view of the latch member of FIG. 33.
Figure 35:
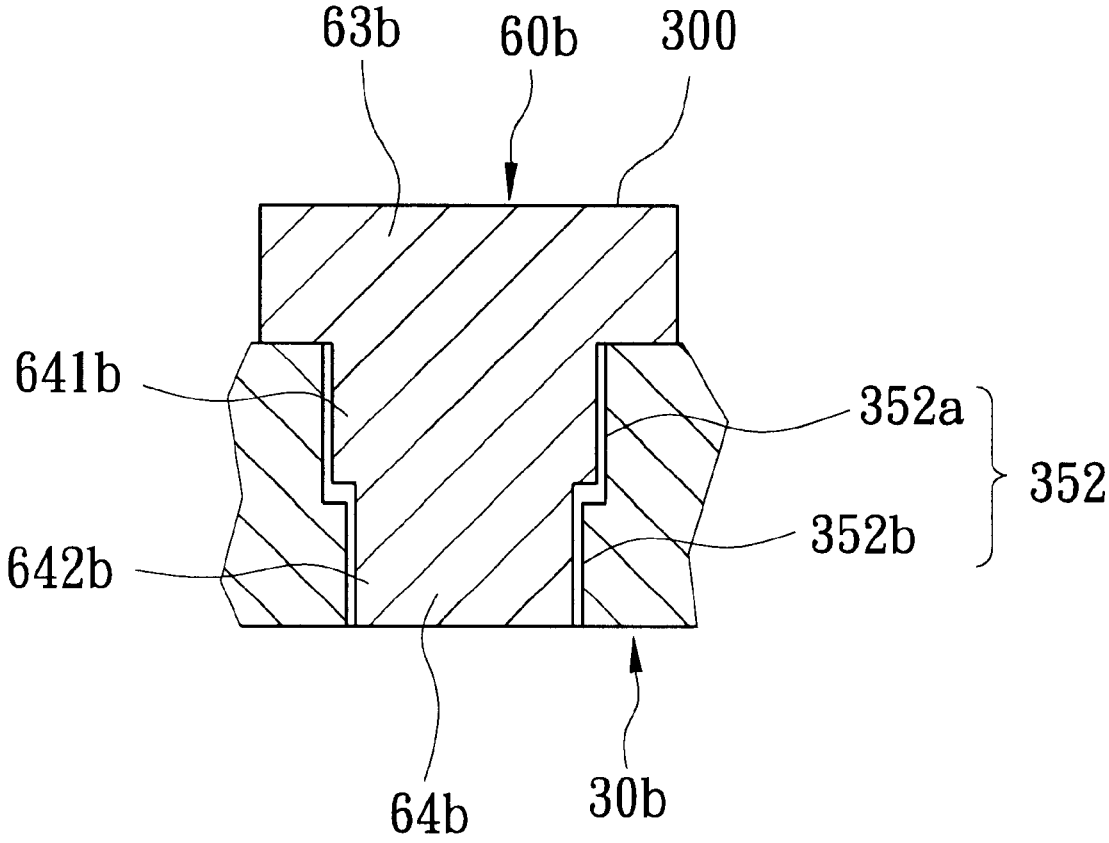
FIG. 35 is a fragmentary sectional view of the latch member and the catch member of FIG. 33, illustrating engagement between a pin on the latch member and a stepped straight hole section of a pin hole in the latch member.

Referring to FIGS. 33 and 34, in another embodiment of the lock apparatus of the present invention, a latch member 30*b* is formed with a pair of pin holes 35*b* on its distal end face 300. Each of the pin holes 35*b* includes a curved hole section 351 that extends along a curved line on the end face 300 and that has opposite first and second ends 354, 355, and a straight hole section 352 that extends along a straight line on the end face 300 and that extends transversely from the second end 355 of the curved hole section 351. As shown in FIG. 35, the straight hole section 352 is defined by a stepped hole defining wall and is formed to include a wider hole portion 352*a* proximate to the end face 300, and a narrower hole portion 352*b* adjacent to the wider hole portion 352*a*. Both the wider and narrower hole portions 352*a*, 352*b* extend along the length of the straight hole section 352 and are communicated with the second end 355 of the curved hole section 351. The latch member 30*b* engages a pair of catch members 60*b* (only one is shown in FIG. 33), each of which has a latch engaging end portion 63*b* formed with a pin 64*b*, and a shackle engaging end portion 61*b* formed with a spring abutment stud 66*b* for abutting against a compression spring 67*b*. As shown in FIGS. 33 and 35, the pin 64*b* has adjacent wider and narrower sections 641*b*, 642*b* which are extendible respectively into the wider and narrower hole portions 352*a*, 352*b* of the straight hole section 352 of a respective one of the pin holes 35*b* when the pin 64*b* extends into the straight hole section 352.

Figure 36B:
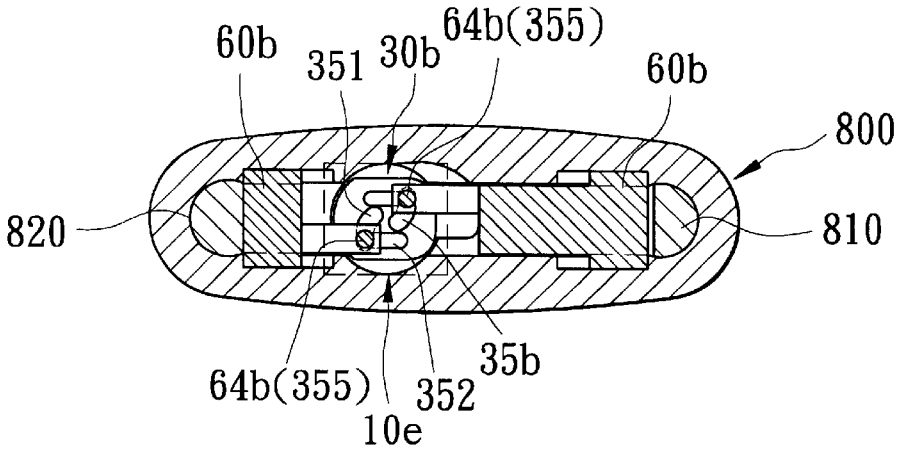
FIG. 36B is a cross-sectional view of the lock apparatus of the fifteenth preferred embodiment in the locking state.
Figure 36A:
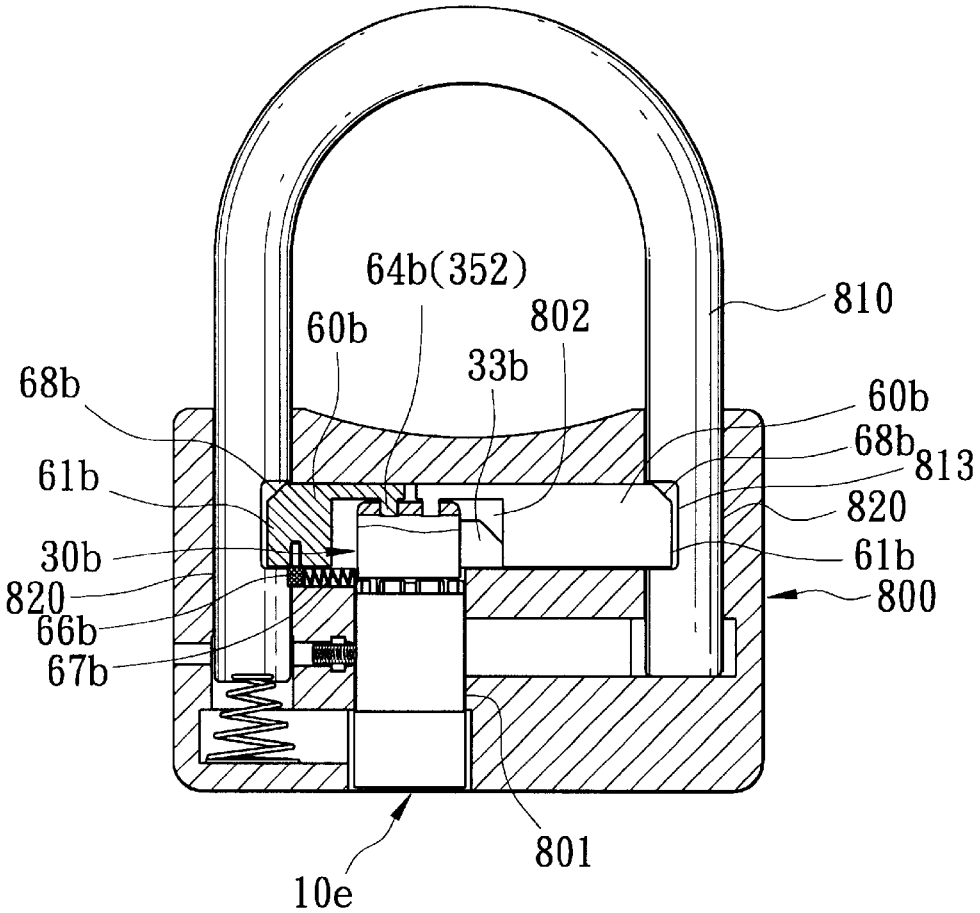
FIG. 36A is a sectional view of the lock apparatus of the fifteenth preferred embodiment in a locking state.
Figure 37:
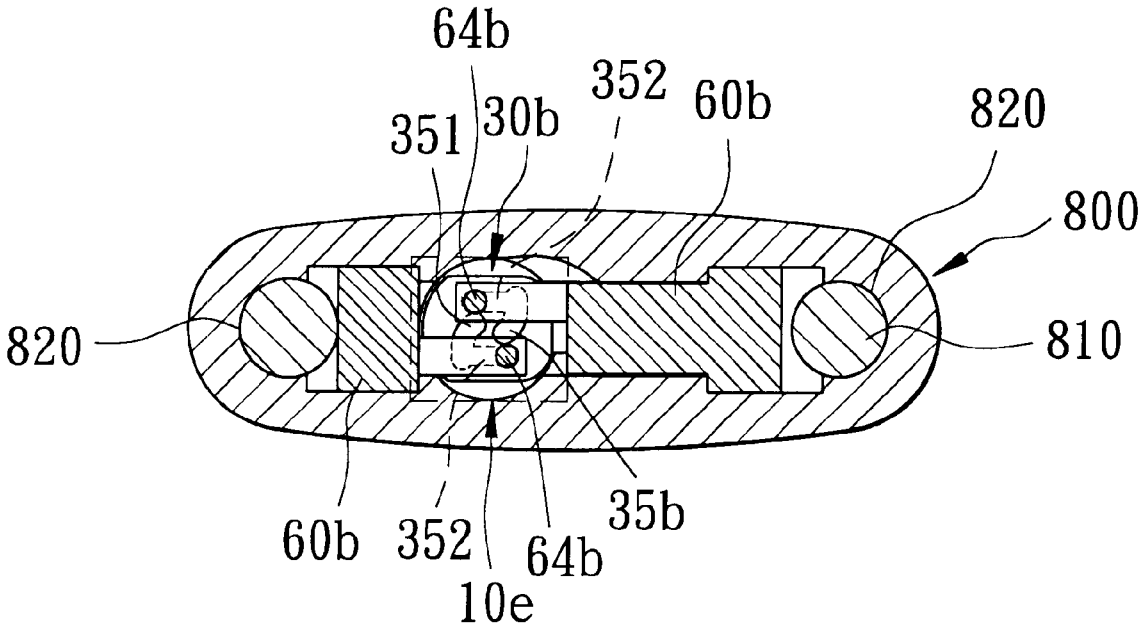
FIG. 37 is a cross-sectional view of the fifteenth preferred embodiment, where leg portions of a shackle member are inserted into a pair of shackle insert holes in a lock body of the lock apparatus.

Referring to FIGS. 36A and 36B, the lock apparatus in the present embodiment is in the form of a padlock which includes a lock body 800, a lock core device 10*e* received in a lock core chamber 801 of the lock body 800, and a U-shaped shackle member 810 mounted in a pair of shackle insert holes 820 of the lock body 800. The lock core device 10*e* is mounted with the latch member 30*b* of FIG. 33. The latch member 30*b* and the catch members 60*b* are disposed in a catch chamber 802 formed between the shackle insert holes 820 of the lock body 800. The compression spring 67*b* has one end abutting against an outer surface of the lock core device 10*e*, and another end abutting against the spring abutment stud 66*b* on a respective one of the catch members 60*b* for biasing the catch member 60*b* in a direction away from the latch member 30*b*. FIGS. 36A and 36B show the padlock in a locking state, in which the shackle engaging end portion 61*b* of each of the catch members 60*b* extends into a respective one of the shackle insert holes 820 to engage a respective leg portion of the shackle member 810, and in which the pin 64*b* of each of the catch members 60*b* is disposed in the second end 355 of the curved hole section 351 of a respective one of the pin holes 35*b* immediately adjacent to the straight hole section 352. The shackle engaging end portion 61*b* of each of the catch members 60*b* has a tapered guiding wall 68*b* confronting an opening in a respective one of the shackle insert holes 820. To unlock the padlock, the lock core device 10*e* is operated to rotate the latch member 30*b* to the unlocking position, thereby pulling the catch members 60*b* inwardly toward each other for disengaging the catch members 60*b* from the leg portions of the shackle member 810. The shackle member 810 can be entirely removed from the lock body. In this embodiment, the latch member 30*b* is designed to be normally disposed in the locking position. When the leg portions of the shackle member 810 are once again inserted into the shackle insert holes 820 of the lock body 800, the leg portions push the catch members 60*b* at the tapered guiding wall 68*b* and depress the catch members 60*b* for retracting the catch members 60*b* into the catch chamber 802 against biasing action of the compression spring 67*b* to enable the pins 64*b* to move into and slide along the straight slot sections 352 of the pin holes 35b, respectively, as best illustrated in FIG. 37. When the shackle grooves 813 on the leg portions of the shackle member 810 are subsequently registered with the catch chamber 802, the compression spring 67*b* expand to enable the shackle engaging end portions 61*b* of the catch members 60*b* to extend into the shackle insert holes 820 and into the shackle grooves 813 and to enable the pins 64 to move back to the second ends 355 of the curved hole sections 351, as shown in FIG. 36B. In this manner, the catch members 60*b* operate automatically to lock the shackle member 810 on the lock body 800 when the shackle member 810 is inserted into the shackle insert holes 820 without the use of a key.

Figure 38:
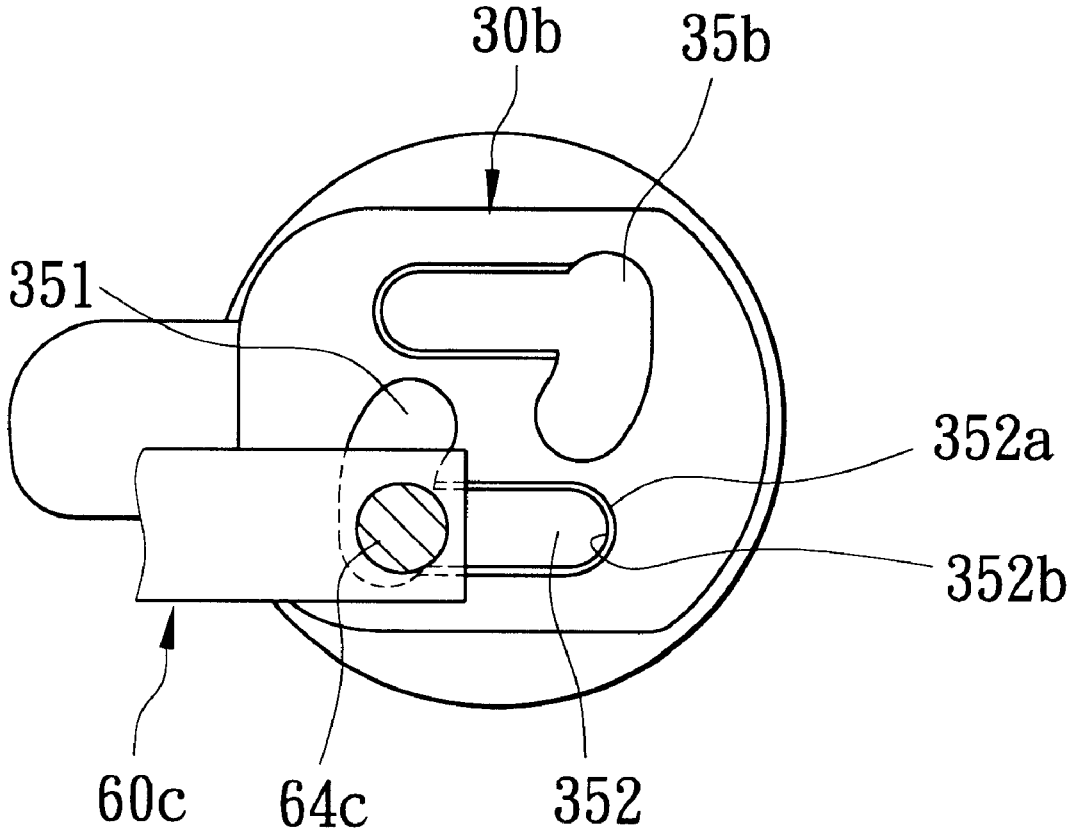
FIG. 38 is a schematic view illustrating the engagement between a latch member and a catch member of a sixteenth preferred embodiment of the lock apparatus of the present invention.

Referring to FIG. 38, in a modified embodiment, the pin 64*b* on each of the catch members 60*c* maybe designed to have a cross-section larger than the narrower hole portion 352*b* of the straight hole section 352 of the pin hole 35*b* such that the pin 64*c* is prevented from moving into the straight hole section 352, thereby preventing retraction of the catch members 60*c* into the catch chamber 802 (see FIG. 36A) and preventing insertion of the leg portions of the shackle member 810 into the shackle insert holes 820 when the latch member 30*b* is in the locking position. In this case, insertion of the leg portions of the shackle member into the shackle insert holes is allowed only after the lock core unit has been operated by a correct key to dispose the latch member 30*b* in the unlocking position.

Figure 39:
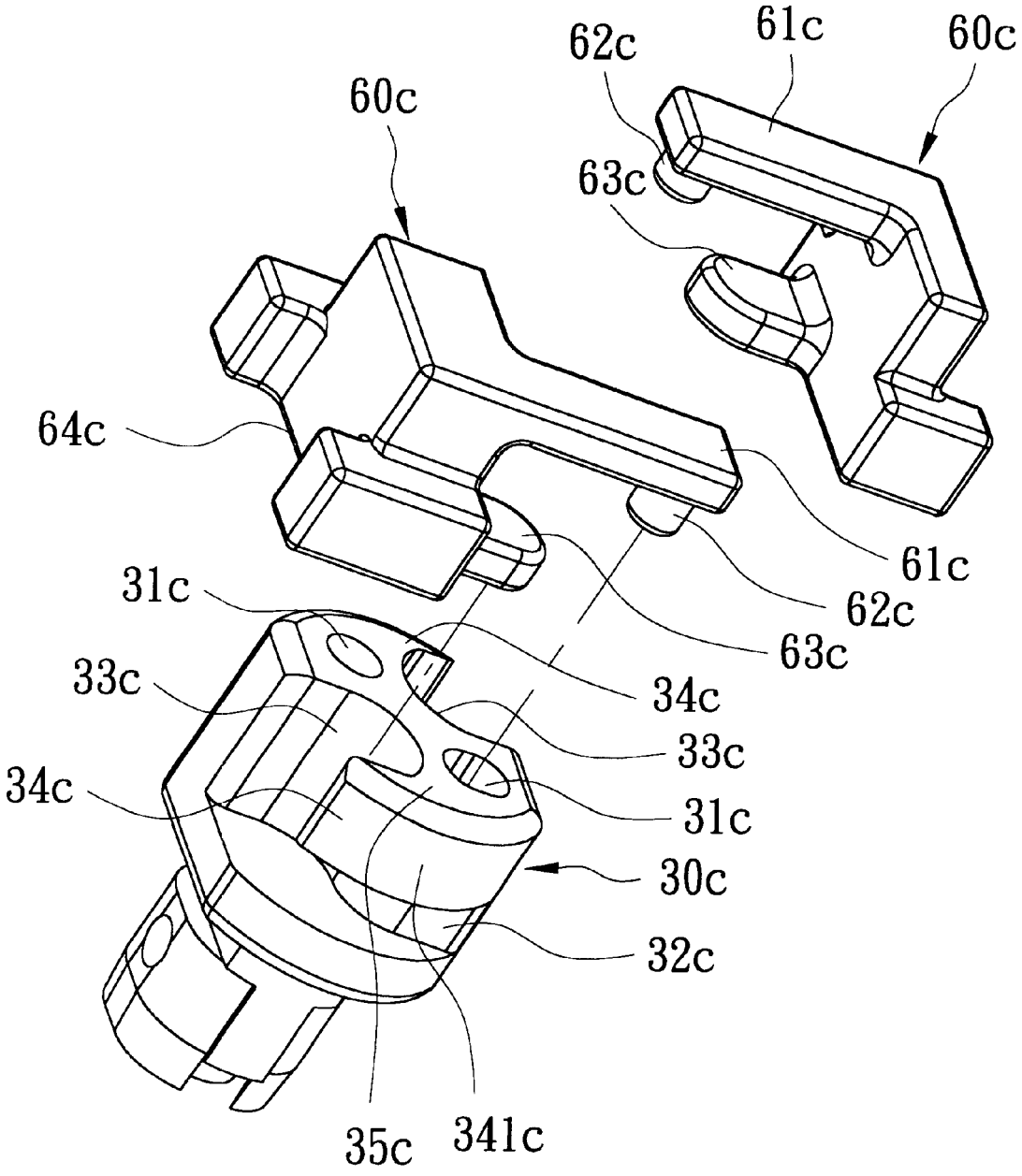
FIG. 39 is an exploded perspective view illustrating a latch member and a catch member of a seventeenth preferred embodiment of the lock apparatus of the present invention.

Referring to FIG. 39, in another preferred embodiment, the latch member 30*c* has a distal end face 35*c* formed with a pair of circular pin holes 31*c* which are eccentric to an axis of the lock core device 10*c* (see FIG. 42) on which the latch member 30*c* is mounted, and which are symmetric to each other with respect to the axis of the lock core device 10*c*. The latch member 30*c* has a pair of opposite side walls 34*c* transverse to the distal end face 35*c*. Each of the side walls 34*c* is formed with a slide slot 32*c* that extends along a plane parallel to the end face 35*c*, and a communicating hole 33*c* that extends parallel to the axis of the lock core device 10*c* from the end face 35*c* to the slide slot 32*c* to communicate with the slide slot 32. A curved stop flange 341*c* is formed on a respective side wall 34*c* between the slide slot 32*c* and the end face 35*c*. The latch member 30*c* engages a pair of catch members 60*c*, each of which has a latch engaging end portion 61*c* formed with a cylindrical pin 62*c*, and a shackle engaging end portion 64*c* opposite to the latch engaging end portion 61*c*. Each of the catch members 60*c* is further formed with a stop projection 63*c* which extends in a direction transverse to the pin 62*c* from the shackle engaging end portion 64*c* toward the latch engaging end portion 61*c*. The pin 62*c* on each of the catch members 60*c* extends rotatably into a respective one of the pin holes 31*c* in the latch member 30*c*. The stop projection 63*c* passes through an adjacent one of the communicating holes 33*c* during assembly of the respective catch member 60*c* to the latch member 30*c*, and is disposed in a corresponding one of the slide slots 32*c* of the latch member 30*c*.

Figure 40:
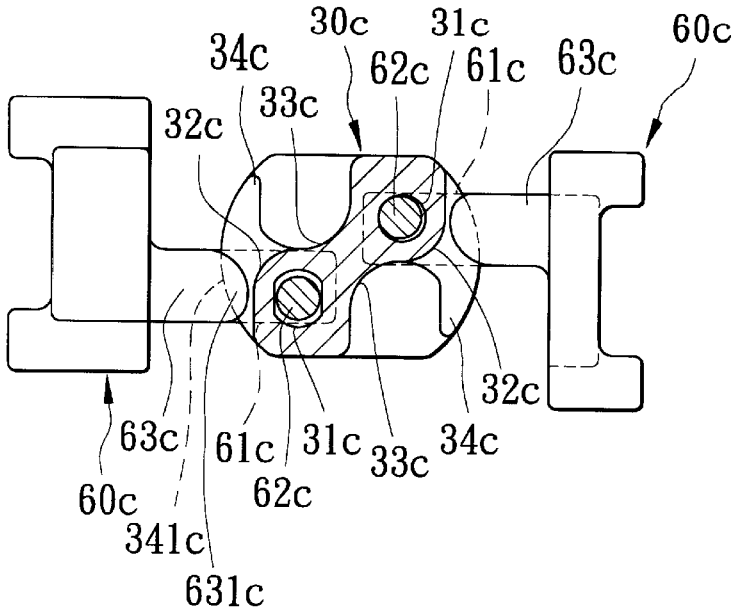
FIG. 40 is a schematic view illustrating relative positions of the latch member and a pair of the catch members of the lock apparatus of the seventeenth preferred embodiment in a locking state.
Figure 42:
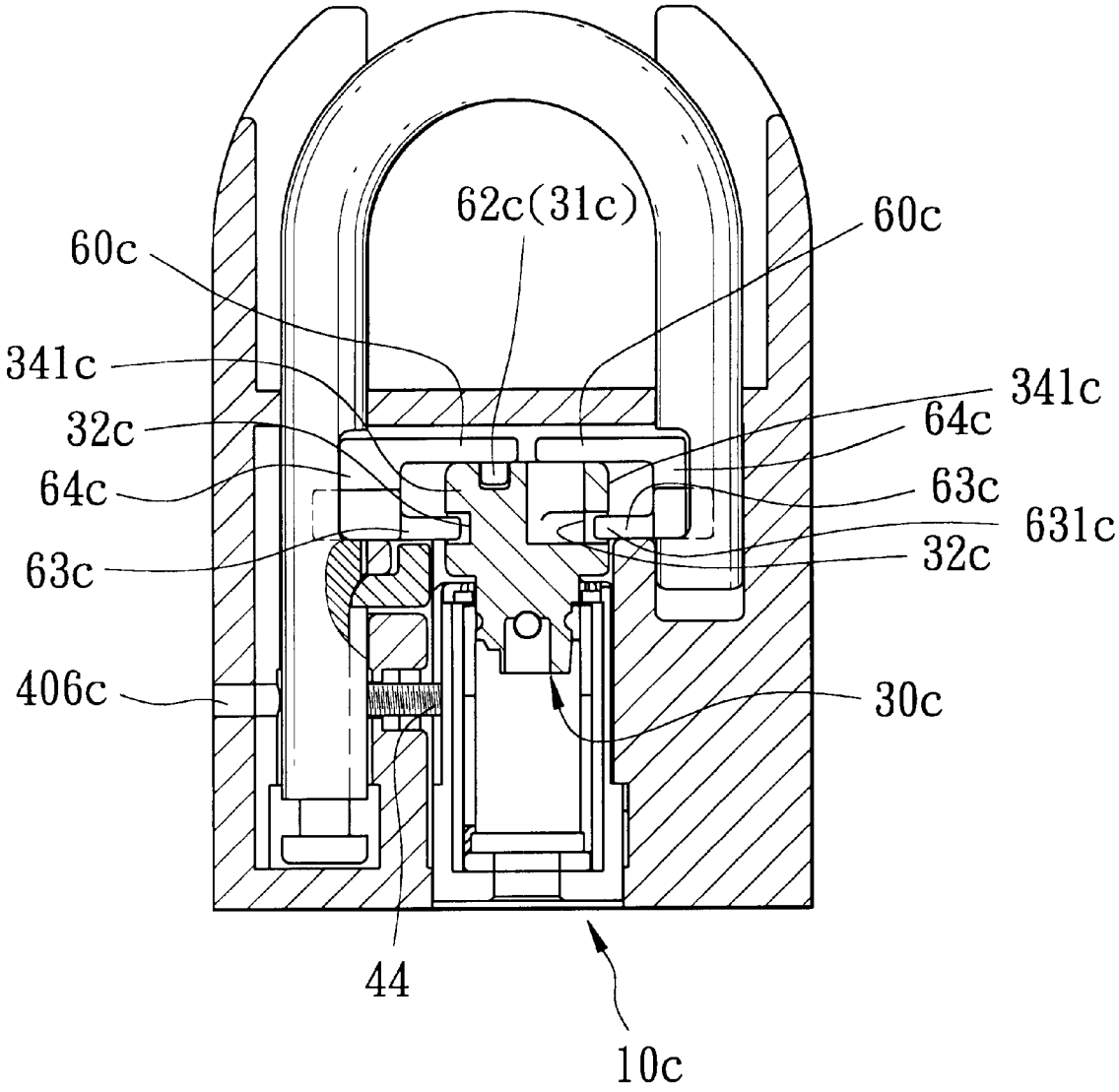
FIG. 42 is a sectional view of the lock apparatus of the seventeenth preferred embodiment in the locking state.

Referring to FIGS. 40 and 42, the present embodiment is in the form of a padlock which has a lock body formed with a lock core chamber that is installed with the lock core device 10*c*. The latch member 30*c* and the catch members 60*c* are received in a catch chamber that extends between a pair of shackle insert holes of the lock body. When the lock core device 10*c* is in a locking position, the catch members 60*c* are pushed apart from each other toward the shackle insert holes for engaging longer and shorter leg portions of the shackle member. At this time, as shown in FIG. 40, a distal end 631*c* of the stop projection 63*c* on each of the catch members 60*c* is registered with the curved stop flange 341*c* on a respective one of the side walls 34*c* of the latch member 30*c*. Since the stop projections 63*c* of the catch members 60*c* are blocked respectively by the stop flanges 341*c* of the latch member 30*c*, removal of the catch members 60*c* from the latch member 30*c* in the direction along the axis of the lock core device 10*c* can be prevented. This increases the strength of the engagement between the catch members 60*c* and the latch member 30*c*. The catch members 60*c* do not easily disengage from the latch member 30*c* even when the padlock is subjected to strong impact.

Figure 41:
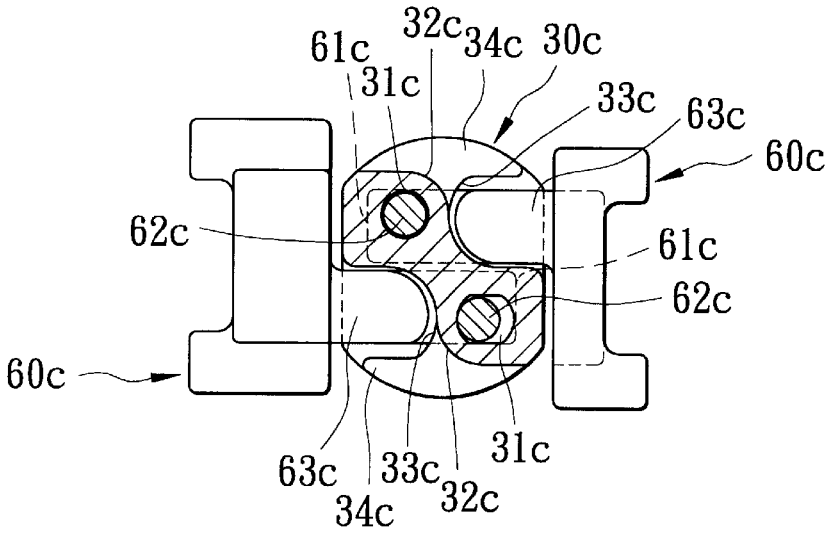
FIG. 41 is a schematic view illustrating relative positions of the latch member and the catch members of the lock apparatus of the seventeenth preferred embodiment in an unlocking state.

Referring to FIGS. 41 and 42, when the lock core device 10*c* is in the unlocking position, the latch member 30*c* turns by an angle of 90 degrees, and the catch members 60*c* are pulled inwardly toward each other for disengaging the shackle engaging end portions 64*c* from the leg portions of the shackle member. At this time, the stop projections 63*c* of the catch members 60*c* are aligned respectively with the communicating holes 33*c* in the latch member 30*c*. In this state, after the threaded rod 44 is operated by a tool extending into the lock body via the aperture 406*c*, and is unthreaded for disengaging from the lock core device 10*c*, the lock core device 10*c* can be removed from the lock body and the catch members 60*c* in a direction along axis thereof.

Figure 43:
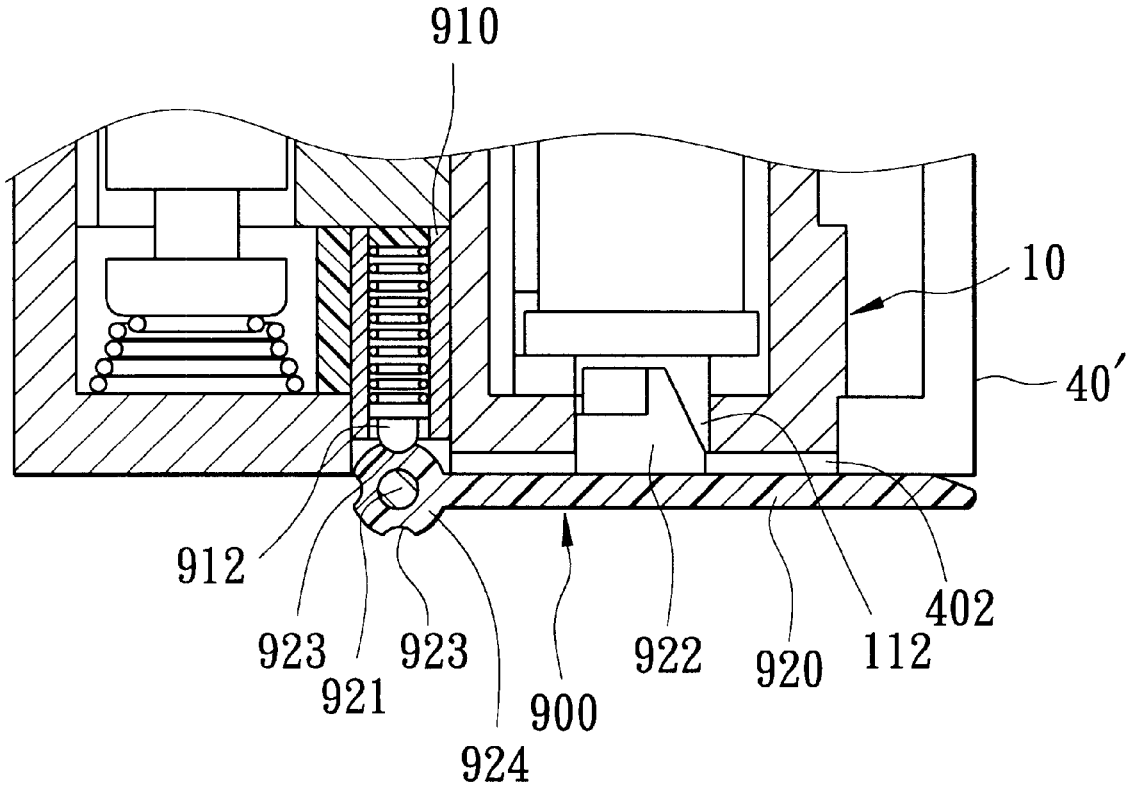
FIG. 43 is a fragmentary sectional view of an eighteenth preferred embodiment of the lock apparatus of the present invention, where a cover unit is shown to be in a closed position.
Figure 44:
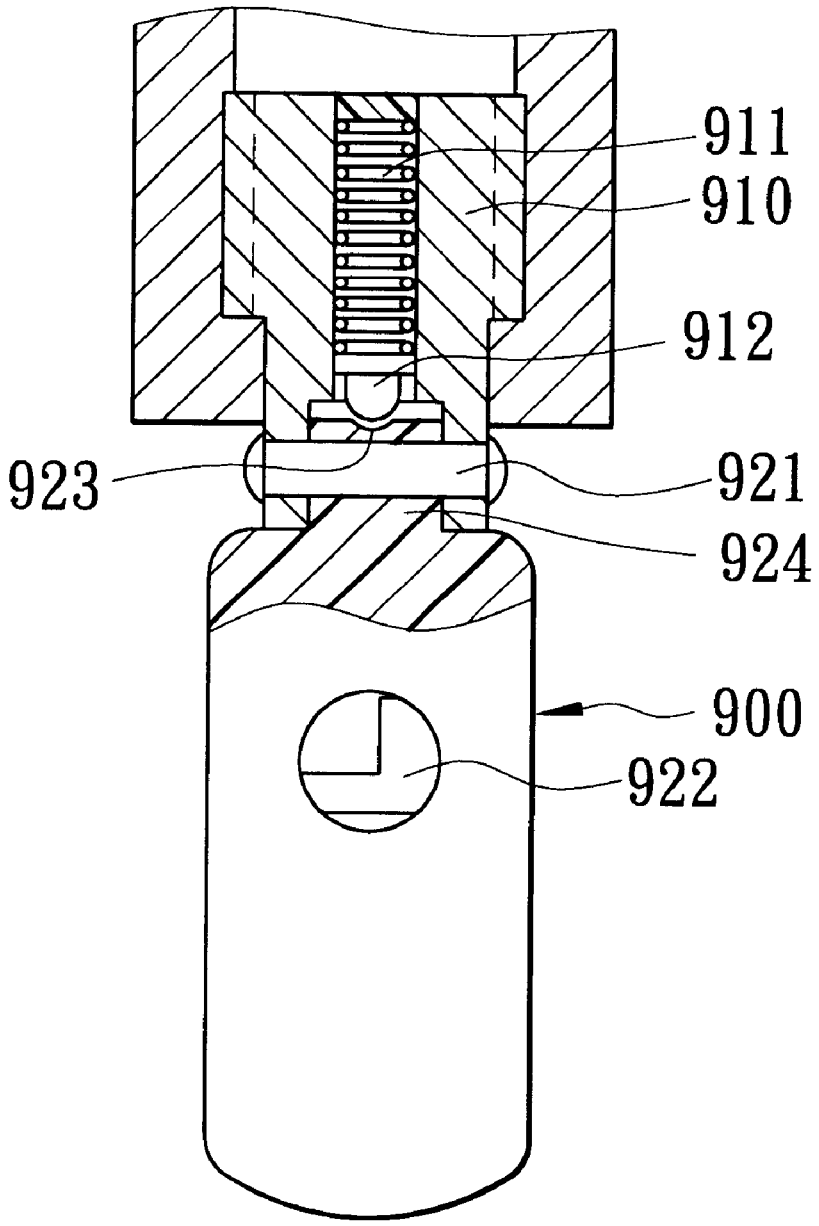
FIG. 44 is a fragmentary sectional view of the lock apparatus of the eighteenth preferred embodiment, where the cover unit is shown to be in an open position.

Referring to FIGS. 43 and 44, preferably, a cover unit 900 is provided for covering the lock core opening 402 of the lock body 40' and the key access hole 112 of the lock core device 10. The cover unit 900 includes a mounting seat 910 mounted on a bottom wall of the lock body 40' adjacent to the lock core opening 402. The mounting seat 910 is provided with a spring-loaded ball member 912. A cover flap 920 has a hinge end portion 924 disposed adjacent to the ball member 912 and hinged to the lock body 40' by means of a pivot shaft 921 such that the cover flap 920 is pivotable toward the lock core opening 402 to a closed position shown in FIG. 43 for covering the lock core opening 402, and away from the lock core opening 402 to an open position shown in FIG. 44 to permit access to the lock core opening 402. The ball member 912 is biased toward the hinge end portion 924 of the cover flap 920. The hinge end portion 924 has an annular outer periphery formed with three angularly displaced ball retaining grooves 923 for engaging resiliently the ball member 912 so as to retain the cover flap 920 releasably at a selected one of the open and closed positions. As shown, the cover flap 920 is formed with a plug 922 which extends fittingly into the key access hole 112 to prevent entry of dust and moisture into the interior of the lock core-device 10.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A lock apparatus comprising:

a lock body formed with a lock core chamber, a lock core opening for access to said lock core chamber, and a shackle insert hole, said lock core chamber having a section formed as a catch chamber which is adjacent to and which is communicated with said shackle insert hole;

a lock core device received in said lock core chamber via said lock core opening, said lock core device including a cylindrical and axially rotatable lock core which is provided with a latch member that is disposed in said catch chamber, said latch member having an end face which is transverse to an axis of said lock core and which is formed with a pin hole that is eccentric to the axis of said lock core;

a key which is insertible into said lock core device via said lock core opening and which is operable for rotating said lock core and said latch member between locking and unlocking positions;

a shackle member having a leg portion which is formed with a shackle groove and which is inserted into said shackle insert hole in said lock body; and a catch member disposed in said catch chamber of said lock body, said catch member having a shackle engaging end portion for engaging said shackle groove in said leg portion of said shackle member, and a latch engaging end portion opposite to said shackle engaging end portion and formed with a pin which extends rotatably into said pin hole in said latch member for engaging said latch member such that said catch member is movable between locking and unlocking positions when said latch member moves between the locking and unlocking positions, said shackle engaging end portion of said catch member extending into said shackle insert hole for engaging said shackle groove in said leg portion of said shackle member when said catch member is disposed in the locking position, said shackle engaging end portion being retracted into said catch chamber for disengaging from said leg portion of said shackle member to permit removal of said shackle member from said shackle insert hole when said catch member is disposed in the unlocking position;

said key having a shank portion with a cross-section formed as a circular sector, and a handle portion connected to said shank portion, said shank portion having first and second radial surfaces that extend along a length of said shank portion, and a curved surface that interconnects said first and second radial surfaces, said first radial surface being planar, said second radial surface being formed with a plurality of key bit portions that are arranged along the length of said shank portion, said key bit portions having radial key bit surfaces that form different angles with said first radial surface to set a code of said key, said shank portion of said key further having a distal end formed as an actuating tip portion;

said lock core device further including a lock casing mounted in said lock core chamber of said lock body, said lock casing having an inner surface which confines a cylindrical chamber and which is formed with an axially extending locking groove;

said lock core including:

a cylindrical inner shell received rotatably in said cylindrical chamber of said lock casing, said inner shell having a rear end mounted with said latch member, and a front end, said inner shell being formed with an axially extending locking slot which is registered with said locking groove when said lock core is in the locking position;

a stack of annular locking plates received in said inner shell, each of said locking plates having an inner periphery that confines a central hole, said central holes of said locking plates cooperatively defining a keyhole that permits insertion of said shank portion of said key thereinto, each of said locking plates further having an outer periphery that is formed with an engaging notch, said engaging notches of said locking plates being misaligned with one another in accordance with the code of said key when said lock core is in the locking position, said engaging notches being aligned with one another when said lock core is in the unlocking position, said inner periphery of each of said locking plates being formed with a radial inward key engaging protrusion which abuts against said key bit surface of a corresponding one of said key bit portions on said key when said key is inserted into said keyhole and is rotated, said locking plates being rotated by different angles according to the code of said key to align said engaging notches when said key is inserted into said keyhole and is rotated for moving said lock core to the unlocking position;

a locking rod received in said locking slot of said inner shell, misalignment of said engaging notches on said locking plates enabling said outer peripheries of said locking plates to force said locking rod to extend into said locking groove in said lock casing in order to hinder rotation of said inner shell relative to said lock casing when said lock core is in the locking position, alignment of said engaging notches on said locking plates enabling said locking rod to disengage said locking groove and to extend into said engaging notches in order to permit rotation of said inner shell relative to said lock casing during unlocking movement of said lock core; and an annular drive plate disposed in said inner shell at said rear end of said inner shell and disposed between said locking plates and said latch member, said drive plate having an inner periphery which confines a key engaging hole and which is formed with a key actuatable projection that projects radially and inwardly, said actuating tip portion of said key being extendible into said key engaging hole for engaging said key actuatable projection so as to enable co-rotation of said drive plate with said key, said drive plate being formed with a drive projection, said latch member having an actuatable section which is driven by said drive projection such that rotation of said drive plate can result in corresponding rotation of said latch member between the locking and unlocking positions;

said lock core device further including a spring-loaded tumbler unit, said lock casing being formed with a first tumbler hole, said inner shell being formed with a second tumbler hole, one of said locking plates being formed with a third tumbler hole, said first, second and third tumbler holes being aligned with one another prior to insertion of said key into said key hole, said tumbler unit including a first tumbler member received in said first tumbler hole, a second tumbler member received in said second tumbler hole, a third tumbler member received in said third tumbler hole, and a first biasing spring for biasing said first, second and third tumbler members to move inwardly to enable said first tumbler member to project into said second tumbler hole in said inner shell so as to hinder rotation of said inner shell relative to said lock casing, to enable said second tumbler member to project into said third tumbler hole in said one of said locking plates so as to hinder rotation of said one of said locking plates within said inner shell, and to enable said third tumbler member to project from said inner periphery of said one of said locking plates, said curved surface on said shank portion of said key being formed with a tumbler recess that is defined by a recessed tumbler push wall, said third tumbler member projecting into said tumbler recess when said key is inserted into said key hole, said third tumbler member being pushed by said tumbler push wall in a direction against biasing action of said first biasing spring so as to retract said second tumbler member into said second tumbler hole in said inner shell, thereby preventing said second tumbler member from hindering rotation of said one of said locking plates relative to said inner shell, and so as to retract said first tumbler member into said first tumbler hole such that said first tumbler member ceases to hinder rotation of said inner shell relative to said lock casing; and said inner shell of said lock core having an inner surface which is formed with a circumferential groove that extends circumferentially along a curved line on said inner surface of said inner shell, said third tumbler hole in said one of said locking plates being provided with a mounting sleeve through which said third tumbler member extends, said tumbler unit further including a second biasing spring received in said mounting sleeve and disposed around said third tumbler member for biasing said third tumbler member to move outwardly, said third tumbler member moving outwardly and extending into said circumferential groove, due to biasing action of said second biasing spring, for disengaging from said key when said key is inserted into said key hole to align said tumbler recess with said tumbler unit and when said key is rotated for moving said lock core to the unlocking position.

2. A lock apparatus comprising:

a lock body formed with a lock core chamber, a lock core opening for access to said lock core chamber, and a shackle insert hole, said lock core chamber having a section formed as a catch chamber which is adjacent to and which is communicated with said shackle insert hole;

a lock core device received in said lock core chamber via said lock core opening, said lock core device including a cylindrical and axially rotatable lock core which is provided with a latch member that is disposed in said catch chamber, said latch member having an end face which is transverse to an axis of said lock core and which is formed with a pin hole that is eccentric to the axis of said lock core;

a key which is insertible into said lock core device via said lock core opening and which is operable for rotating said lock core and said latch member between locking and unlocking positions;

a shackle member having a leg portion which is formed with a shackle groove and which is inserted into said shackle insert hole in said lock body; and a catch member disposed in said catch chamber of said lock body, said catch member having a shackle engaging end portion for engaging said shackle groove in said leg portion of said shackle member, and a latch engaging end portion opposite to said shackle engaging end portion and formed with a pin which extends rotatably into said pin hole in said latch member for engaging said latch member such that said catch member is movable between locking and unlocking positions when said latch member moves between the locking and unlocking positions, said shackle engaging end portion of said catch member extending into said shackle insert hole for engaging said shackle groove in said leg portion of said shackle member when said catch member is disposed in the locking position, said shackle engaging end portion being retracted into said catch chamber for disengaging from said leg portion of said shackle member to permit removal of said shackle member from said shackle insert hole when said catch member is disposed in the unlocking position;

said key having a shank portion with a cross-section formed as a circular sector, and a handle portion connected to said shank portion, said shank portion having first and second radial surfaces that extend along a length of said shank portion, and a curved surface that interconnects said first and second radial surfaces, said first radial surface being planar, said second radial surface being formed with a plurality of key bit portions that are arranged along the length of said shank portion, said key bit portions having radial key bit surfaces that form different angles with said first radial surface to set a code of said key, said shank portion of said key further having a distal end formed as an actuating tip portion;

said lock core device further including a lock casing mounted in said lock core chamber of said lock body, said lock casing having an inner surface which confines a cylindrical chamber and which is formed with an axially extending locking groove;

said lock core including:

a cylindrical inner shell received rotatably in said cylindrical chamber of said lock casing, said inner shell having a rear end mounted with said latch member, and a front end, said inner shell being formed with an axially extending locking slot which is registered with said locking groove when said lock core is in the locking position, a stack of annular locking plates received in said inner shell, each of said locking plates having an inner periphery that confines a central hole, said central holes of said locking plates cooperatively defining a keyhole that permits insertion of said shank portion of said key thereinto, each of said locking plates further having an outer periphery that is formed with an engaging notch, said engaging notches of said locking plates being misaligned with one another in accordance with the code of said key when said lock core is in the locking position, said engaging notches being aligned with one another when said lock core is in the unlocking position, said inner periphery of each of said locking plates being formed with a radial inward key engaging protrusion which abuts against said key bit surface of a corresponding one of said key bit portions on said key when said key is inserted into said keyhole and is rotated, said locking plates being rotated by different angles according to the code of said key to align said engaging notches when said key is inserted into said keyhole and is rotated for moving said lock core to the unlocking position, a locking rod received in said locking slot of said inner shell, misalignment of said engaging notches on said locking plates enabling said outer peripheries of said locking plates to force said locking rod to extend into said locking groove in said lock casing in order to hinder rotation of said inner shell relative to said lock casing when said lock core is in the locking position, alignment of said engaging notches on said locking plates enabling said locking rod to disengage said locking groove and to extend into said engaging notches in order to permit rotation of said inner shell relative to said lock casing during unlocking movement of said lock core, and an annular drive plate disposed in said inner shell at said rear end of said inner shell and disposed between said locking plates and said latch member, said drive plate having an inner periphery which confines a key engaging hole and which is formed with a key actuatable projection that projects radially and inwardly, said actuating tip portion of said key being extendible into said key engaging hole for engaging said key actuatable projection so as to enable co-rotation of said drive plate with said key, said drive plate being formed with a drive projection, said latch member having an actuatable section which is driven by said drive projection such that rotation of said drive plate can result in corresponding rotation of said latch member between the locking and unlocking positions;

said inner shell of said lock core having an inner surface which is formed with a limiting groove that extends along a length of said inner shell and that extends circumferentially on said inner surface along a curved line that has an arc length, said outer periphery of one of said locking plates being formed with a radial limiting projection that projects into said limiting groove in said inner shell to limit rotation of said one of said locking plates within an angle defined by said arc length when said key is inserted into and is rotated in said keyhole; and wherein said arc length is greater than 180°.

3. A lock apparatus comprising:

a lock body formed with a lock core chamber, a lock core opening for access to said lock core chamber, and a shackle insert hole, said lock core chamber having a section formed as a catch chamber which is adjacent to and which is communicated with said shackle insert hole;

a lock core device received in said lock core chamber via said lock core opening, said lock core device including a cylindrical and axially rotatable lock core which is provided with a latch member that is disposed in said catch chamber, said latch member having an end face which is transverse to an axis of said lock core and which is formed with a pin hole that is eccentric to the-axis of said lock core;

a key which is insertible into said lock core device via said lock core opening and which is operable for rotating said lock core and said latch member between locking and unlocking positions;

a shackle member having a leg portion which is formed with a shackle groove and which is inserted into said shackle insert hole in said lock body; and a catch member disposed in said catch chamber of said lock body, said catch member having a shackle engaging end portion for engaging said shackle groove in said leg portion of said shackle member, and a latch engaging end portion opposite to said shackle engaging end portion and formed with a pin which extends rotatably into said pin hole in said latch member for engaging said latch member such that said catch member is movable between locking and unlocking positions when said latch member moves between the locking and unlocking positions, said shackle engaging end portion of said catch member extending into said shackle insert hole for engaging said shackle groove in said leg portion of said shackle member when said catch member is disposed in the locking position, said shackle engaging end portion being retracted into said catch chamber for disengaging from said leg portion of said shackle member to permit removal of said shackle member from said shackle insert hole when said catch member is disposed in the unlocking position;

said key having a shank portion with a cross-section formed as a circular sector, and a handle portion connected to said shank portion, said shank portion having first and second radial surfaces that extend along a length of said shank portion, and a curved surface that interconnects said first and second radial surfaces, said first radial surface being planar, said second radial surface being formed with a plurality of key bit portions that are arranged along the length of said shank portion, said key bit portions having radial key bit surfaces that form different angles with said first radial surface to set a code of said key, said shank portion of said key further having a distal end formed as an actuating tip portion;

said lock core device further including a lock casing mounted in said lock core chamber of said lock body, said lock casing having an inner surface which confines a cylindrical chamber and which is formed with an axially extending locking groove;

said lock core including:

a cylindrical inner shell received rotatably in said cylindrical chamber of said lock casing, said inner shell having a rear end mounted with said latch member, and a front end, said inner shell being formed with an axially extending locking slot which is registered with said locking groove when said lock core is in the locking position, a stack of annular locking plates received in said inner shell, each of said locking plates having an inner periphery that confines a central hole, said central holes of said locking plates cooperatively defining a keyhole that permits insertion of said shank portion of said key thereinto, each of said locking plates further having an outer periphery that is formed with an engaging notch, said engaging notches of said locking plates being misaligned with one another in accordance with the code of said key when said lock core is in the locking position, said engaging notches being aligned with one another when said lock core is in the unlocking position, said inner periphery of each of said locking plates being formed with a radial inward key engaging protrusion which abuts against said key bit surface of a corresponding one of said key bit portions on said key when said key is inserted into said keyhole and is rotated, said locking plates being rotated by different angles according to the code of said key to align said engaging notches when said key is inserted into said keyhole and is rotated for moving said lock core to the unlocking position, a locking rod received in said locking slot of said inner shell, misalignment of said engaging notches on said locking plates enabling said outer peripheries of said locking plates to force said locking rod to extend into said locking groove in said lock casing in order to hinder rotation of said inner shell relative to said lock casing when said lock core is in the locking position, alignment of said engaging notches on said locking plates enabling said locking rod to disengage said locking groove and to extend into said engaging notches in order to permit rotation of said inner shell relative to said lock casing during unlocking movement of said lock core, and an annular drive plate disposed in said inner shell at said rear end of said inner shell and disposed between said locking plates and said latch member, said drive plate having an inner periphery which confines a key engaging hole and which is formed with a key actuatable projection that projects radially and inwardly, said actuating tip portion of said key being extendible into said key engaging hole for engaging said key actuatable projection so as to enable co-rotation of said drive plate with said key, said drive plate being formed with a drive projection, said latch member having an actuatable section which is driven by said drive projection such that rotation of said drive plate can result in corresponding rotation of said latch member between the locking and unlocking positions;

said inner shell of said lock core having an inner surface which is formed with a limiting groove that extends along a length of said inner shell and that extends circumferentially on said inner surface along a curved line that has an arc length, said outer periphery of one of said locking plates being formed with a radial limiting projection that projects into said limiting groove in said inner shell to limit rotation of said one of said locking plates within an angle defined by said arc length when said key is inserted into and is rotated in said keyhole; and wherein said arc length is not greater than 180°.

4. A lock apparatus comprising:

a lock body formed with a lock core chamber, a lock core opening for access to said lock core chamber, and a shackle insert hole, said lock core chamber having a section formed as a catch chamber which is adjacent to and which is communicated with said shackle insert hole;

a lock core device received in said lock core chamber via said lock core opening, said lock core device including a cylindrical and axially rotatable lock core which is provided with a latch member that is disposed in said catch chamber, said latch member having an end face which is transverse to an axis of said lock core and which is formed with a pin hole that is eccentric to the axis of said lock core;

a key which is insertible into said lock core device via said lock core opening and which is operable for rotating said lock core and said latch member between locking and unlocking positions;

a shackle member having a leg portion which is formed with a shackle groove and which is inserted into said shackle insert hole in said lock body; and a catch member disposed in said catch chamber of said lock body, said catch member having a shackle engaging end portion for engaging said shackle groove in said leg portion of said shackle member, and a latch engaging end portion opposite to said shackle engaging end portion and formed with a pin which extends rotatably into said pin hole in said latch member for engaging said latch member such that said catch member is movable between locking and unlocking positions when said latch member moves between the locking and unlocking positions, said shackle engaging end portion of said catch member extending into said shackle insert hole for engaging said shackle groove in said leg portion of said shackle member when said catch member is disposed in the locking position, said shackle engaging end portion being retracted into said catch chamber for disengaging from said leg portion of said shackle member to permit removal of said shackle member from said shackle insert hole when said catch member is disposed in the unlocking position;

said key having a shank portion with a cross-section formed as a circular sector, and a handle portion connected to said shank portion, said shank portion having first and second radial surfaces that extend along a length of said shank portion, and a curved surface that interconnects said first and second radial surfaces, said first radial surface being planar, said second radial surface being formed with a plurality of key bit portions that are arranged along the length of said shank portion, said key bit portions having radial key bit surfaces that form different angles with said first radial surface to set a code of said key, said shank portion of said key further having a distal end formed as an actuating tip portion;

said lock core device further including a lock casing mounted in said lock core chamber of said lock body, said lock casing having an inner surface which confines a cylindrical chamber and which is formed with an axially extending locking groove;

said lock core including:

a cylindrical inner shell received rotatably in said cylindrical chamber of said lock casing, said inner shell having a rear end mounted with said latch member, and a front end, said inner shell being formed with an axially extending locking slot which is registered with said locking groove when said lock core is in the locking position, a stack of annular locking plates received in said inner shell, each of said locking plates having an inner periphery that confines a central hole, said central holes of said locking plates cooperatively defining a keyhole that permits insertion of said shank portion of said key thereinto, each of said locking plates further having an outer periphery that is formed with an engaging notch, said engaging notches of said locking plates being misaligned with one another in accordance with the code of said key when said lock core is in the locking position, said engaging notches being aligned with one another when said lock core is in the unlocking position, said inner periphery of each of said locking plates being formed with a radial inward key engaging protrusion which abuts against said key bit surface of a corresponding one of said key bit portions on said key when said key is inserted into said keyhole and is rotated, said locking plates being rotated by different angles according to the code of said key to align said engaging notches when said key is inserted into said keyhole and is rotated for moving said lock core to the unlocking position, a locking rod received in said locking slot of said inner shell, misalignment of said engaging notches on said locking plates enabling said outer peripheries of said locking plates to force said locking rod to extend into said locking groove in said lock casing in order to hinder rotation of said inner shell relative to said lock casing when said lock core is in the locking position, alignment of said engaging notches on said locking plates enabling said locking rod to disengage said locking groove and to extend into said engaging notches in order to permit rotation of said inner shell relative to said lock casing during unlocking movement of said lock core, and an annular drive plate disposed in said inner shell at said rear end of said inner shell and disposed between said locking plates and said latch member, said drive plate having an inner periphery which confines a key engaging hole and which is formed with a key actuatable projection that projects radially and inwardly, said actuating tip portion of said key being extendible into said key engaging hole for engaging said key actuatable projection so as to enable co-rotation of said drive plate with said key, said drive plate being formed with a drive projection, said latch member having an actuatable section which is driven by said drive projection such that rotation of said drive plate can result in corresponding rotation of said latch member between the locking and unlocking positions;

said inner shell of said lock core having an inner surface which is formed with a limiting groove that extends along a length of said inner shell and that extends circumferentially on said inner surface along a curved line that has an arc length, said outer periphery of one of said locking plates being formed with a radial limiting projection that projects into said limiting groove in said inner shell to limit rotation of said one of said locking plates within an angle defined by said arc length when said key is inserted into and is rotated in said keyhole; and wherein said lock core further including an annular retaining plate disposed in said inner shell adjacent to one of said locking plates that is disposed proximate to said front end of said inner shell, said retaining plate having an inner periphery formed with a radial inward blocking protrusion so as to define a key passage hole with a shape of three quarters of a circle, said shank portion of said key having a retainer section which is formed between said key bit portions and said handle and which has a semi-circular cross-section, said retainer section of said key being disposed in said key passage hole in said retaining plate when said key is inserted into said keyhole, said key bit portions on said key being blocked by said blocking protrusion of said retaining plate to prevent untimely removal of said key from said keyhole during operation of said key within said keyhole.

5. A lock apparatus comprising:

a lock body formed with a lock core chamber, a lock core opening for access to said lock core chamber, and a shackle insert hole, said lock core chamber having a section formed as a catch chamber which is adjacent to and which is communicated with said shackle insert hole;

a lock core device received in said lock core chamber via said lock core opening, said lock core device including a cylindrical and axially rotatable lock core which is provided with a latch member that is disposed in said catch chamber, said latch member having an end face which is transverse to an axis of said lock core and which is formed with a pin hole that is eccentric to the axis of said lock core;

a key which is insertible into said lock core device via said lock core opening and which is operable for rotating said lock core and said latch member between locking and unlocking positions;

a shackle member having a leg portion which is formed with a shackle groove and which is inserted into said shackle insert hole in said lock body; and a catch member disposed in said catch chamber of said lock body, said catch member having a shackle engaging end portion for engaging said shackle groove in said leg portion of said shackle member, and a latch engaging end portion opposite to said shackle engaging end portion and formed with a pin which extends rotatably into said pin hole in said latch member for engaging said latch member such that said catch member is movable between locking and unlocking positions when said latch member moves between the locking and unlocking positions, said shackle engaging end portion of said catch member extending into said shackle insert hole for engaging said shackle groove in said leg portion of said shackle member when said catch member is disposed in the locking position, said shackle engaging end portion being retracted into said catch chamber for disengaging from said leg portion of said shackle member to permit removal of said shackle member from said shackle insert hole when said catch member is disposed in the unlocking position;

said key having a shank portion with a cross-section formed as a circular sector, and a handle portion connected to said shank portion, said shank portion having first and second radial surfaces that extend along a length of said shank portion, and a curved surface that interconnects said first and second radial surfaces, said first radial surface being planar, said second radial surface being formed with a plurality of key bit portions that are arranged along the length of said shank portion, said key bit portions having radial key bit surfaces that form different angles with said first radial surface to set a code of said key, said shank portion of said key further having a distal end formed as an actuating tip portion;

said lock core device further including a lock casing mounted in said lock core chamber of said lock body, said lock casing having an inner surface which confines a cylindrical chamber and which is formed with an axially extending locking groove;

said lock core including:

a cylindrical inner shell received rotatably in said cylindrical chamber of said lock casing, said inner shell having a rear end mounted with said latch member, and a front end, said inner shell being formed with an axially extending locking slot which is registered with said locking groove when said lock core is in the locking position, a stack of annular locking plates received in said inner shell, each of said locking plates having an inner periphery that confines a central hole, said central holes of said locking plates cooperatively defining a keyhole that permits insertion of said shank portion of said key thereinto, each of said locking plates further having an outer periphery that is formed with an engaging notch, said engaging notches of said locking plates being misaligned with one another in accordance with the code of said key when said lock core is in the locking position, said engaging notches being aligned with one another when said lock core is in the unlocking position, said inner periphery of each of said locking plates being formed with a radial inward key engaging protrusion which abuts against said key bit surface of a corresponding one of said key bit portions on said key when said key is inserted into said keyhole and is rotated, said locking plates being rotated by different angles according to the code of said key to align said engaging notches when said key is inserted into said keyhole and is rotated for moving said lock core to the unlocking position, a locking rod received in said locking slot of said inner shell, misaligrunent of said engaging notches on said locking plates enabling said outer peripheries of said locking plates to force said locking rod to extend into said locking groove in said lock casing in order to hinder rotation of said inner shell relative to said lock casing when said lock core is in the locking position, alignment of said engaging notches on said locking plates enabling said locking rod to disengage said locking groove and to extend into said engaging notches in order to permit rotation of said inner shell relative to said lock casing during unlocking movement of said lock core, and an annular drive plate disposed in said inner shell at said rear end of said inner shell and disposed between said locking plates and said latch member, said drive plate having an inner periphery which confines a key engaging hole and which is formed with a key actuatable projection that projects radially and inwardly, said actuating tip portion of said key being extendible into said key engaging hole for engaging said key actuatable projection so as to enable co-rotation of said drive plate with said key, said drive plate being formed with a drive projection, said latch member having an actuatable section which is driven by said drive projection such that rotation of said drive plate can result in corresponding rotation of said latch member between the locking and unlocking positions; and wherein said lock core further including an annular positioning plate fixed to said front end of said inner shell for positioning said locking plates in said inner shell, said positioning plate being welded to said inner shell at said front end of said inner shell.

6. A lock apparatus comprising:

a lock body formed with a lock core chamber, a lock core opening for access to said lock core chamber, and a shackle insert hole, said lock core chamber having a section formed as a catch chamber which is adjacent to and which is communicated with said shackle insert hole;

a lock core device received in said lock core chamber via said lock core opening, said lock core device including a cylindrical and axially rotatable lock core which is provided with a latch member that is disposed in said catch chamber, said latch member having an end face which is transverse to an axis of said lock core and which is formed with a pin hole that is eccentric to the axis of said lock core;

a key which is insertible into said lock core device via said lock core opening and which is operable for rotating said lock core and said latch member between locking and unlocking positions;

a shackle member having a leg portion which is formed with a shackle groove and which is inserted into said shackle insert hole in said lock body; and a catch member disposed in said catch chamber of said lock body, said catch member having a shackle engaging end portion for engaging said shackle groove in said leg portion of said shackle member, and a latch engaging end portion opposite to said shackle engaging end portion and formed with a pin which extends rotatably into said pin hole in said latch member for engaging said latch member such that said catch member is movable between locking and unlocking positions when said latch member moves between the locking and unlocking positions, said shackle engaging end portion of said catch member extending into said shackle insert hole for engaging said shackle groove in said leg portion of said shackle member when said catch member is disposed in the locking position, said shackle engaging end portion being retracted into said catch chamber for disengaging from said leg portion of said shackle member to permit removal of said shackle member from said shackle insert hole when said catch member is disposed in the unlocking position;

said key having a shank portion with a cross-section formed as a circular sector, and a handle portion connected to said shank portion, said shank portion having first and second radial surfaces that extend along a length of said shank portion, and a curved surface that interconnects said first and second radial surfaces, said first radial surface being planar, said second radial surface being formed with a plurality of key bit portions that are arranged along the length of said shank portion, said key bit portions having radial key bit surfaces that form different angles with said first radial surface to set a code of said key, said shank portion of said key further having a distal end formed as an actuating tip portion;

said lock core device further including a lock casing mounted in said lock core chamber of said lock body, said lock casing having an inner surface which confines a cylindrical chamber and which is formed with an axially extending locking groove;

said lock core including:

a cylindrical inner shell received rotatably in said cylindrical chamber of said lock casing, said inner shell having a rear end mounted with said latch member, and a front end, said inner shell being formed with an axially extending locking slot which is registered with said locking groove when said lock core is in the locking position, a stack of annular locking plates received in said inner shell, each of said locking plates having an inner periphery that confines a central hole, said central holes of said locking plates cooperatively defining a keyhole that permits insertion of said shank portion of said key thereinto, each of said locking plates further having an outer periphery that is formed with an engaging notch, said engaging notches of said locking plates being misaligned with one another in accordance with the code of said key when said lock core is in the locking position, said engaging notches being aligned with one another when said lock core is in the unlocking position, said inner periphery of each of said locking plates being formed with a radial inward key engaging protrusion which abuts against said key bit surface of a corresponding one of said key bit portions on said key when said key is inserted into said keyhole and is rotated, said locking plates being rotated by different angles according to the code of said key to align said engaging notches when said key is inserted into said keyhole and is rotated for moving said lock core to the unlocking position, a locking rod received in said locking slot of said inner shell, misalignment of said engaging notches on said locking plates enabling said outer peripheries of said locking plates to force said locking rod to extend into said locking groove in said lock casing in order to hinder rotation of said inner shell relative to said lock casing when said lock core is in the locking position, alignment of said engaging notches on said locking plates enabling said locking rod to disengage said locking groove and to extend into said engaging notches in order to permit rotation of said inner shell relative to said lock casing during unlocking movement of said lock core, and an annular drive plate disposed in said inner shell at said rear end of said inner shell and disposed between said locking plates and said latch member, said drive plate having an inner periphery which confines a key engaging hole and which is formed with a key actuatable projection that projects radially and inwardly, said actuating tip portion of said key being extendible into said key engaging hole for engaging said key actuatable projection so as to enable co-rotation of said drive plate with said key, said drive plate being formed with a drive projection, said latch member having an actuatable section which is driven by said drive projection such that rotation of said drive plate can result in corresponding rotation of said latch member between the locking and unlocking positions;

said lock core further including an annular positioning plate fixed to said front end of said inner shell for positioning said locking plates in said inner shell; and wherein said front end of said inner shell being formed with angularly displaced stop members which are bent to extend radially and inwardly for retaining said positioning plate in said inner shell.

7. A lock apparatus comprising:

a lock body formed with a lock core chamber, a lock core opening for access to said lock core chamber, and a shackle insert hole, said lock core chamber having a section formed as a catch chamber which is adjacent to and which is communicated with said shackle insert hole;

a lock core device received in said lock core chamber via said lock core opening, said lock core device including a cylindrical and axially rotatable lock core which is provided with a latch member that is disposed in said catch chamber, said latch member having an end face which is transverse to an axis of said lock core and which is formed with a pin hole that is eccentric to the axis of said lock core;

a key which is insertible into said lock core device via said lock core opening and which is operable for rotating said lock core and said latch member between locking and unlocking positions;

a shackle member having a leg portion which is formed with a shackle groove and which is inserted into said shackle insert hole in said lock body; and a catch member disposed in said catch chamber of said lock body, said catch member having a shackle engaging end portion for engaging said shackle groove in said leg portion of said shackle member, and a latch engaging end portion opposite to said shackle engaging end portion and formed with a pin which extends rotatably into said pin hole in said latch member for engaging said latch member such that said catch member is movable between locking and unlocking positions when said latch member moves between the locking and unlocking positions, said shackle engaging end portion of said catch member extending into said shackle insert hole for engaging said shackle groove in said leg portion of said shackle member when said catch member is disposed in the locking position, said shackle engaging end portion being retracted into said catch chamber for disengaging from said leg portion of said shackle member to permit removal of said shackle member from said shackle insert hole when said catch member is disposed in the unlocking position; and wherein said pin hole in said latch member o f said lock core is circular in shape and has an axis that is offset from and parallel to the axis of said lock core.

8. A lock apparatus comprising:

a lock body formed with a lock core chamber, a lock core opening for access to said lock core chamber, and a shackle insert hole, said lock core chamber having a section formed as a catch chamber which is adjacent to and which is communicated with said shackle insert hole;

a lock core device received in said lock core chamber via said lock core opening, said lock core device including a cylindrical and axially rotatable lock core which is provided with a latch member that is disposed in said catch chamber, said latch member having an end face which is transverse to an axis of said lock core and which is formed with a pin hole that is eccentric to the axis of said lock core;

a key which is insertible into said lock core device via said lock core opening and which is operable for rotating said lock core and said latch member between locking and unlocking positions;

a shackle member having a leg portion which is formed with a shackle groove and which is inserted into said shackle insert hole in said lock body; and a catch member disposed in said catch chamber of said lock body, said catch member having a shackle engaging end portion for engaging said shackle groove in said leg portion of said shackle member, and a latch engaging end portion opposite to said shackle engaging end portion and formed with a pin which extends rotatably into said pin hole in said latch member for engaging said latch member such that said catch member is movable between locking and unlocking positions when said latch member moves between the locking and unlocking positions, said shackle engaging end portion of said catch member extending into said shackle insert hole for engaging said shackle groove in said leg portion of said shackle member when said catch member is disposed in the locking position, said shackle engaging end portion being retracted into said catch chamber for disengaging from said leg portion of said shackle member to permit removal of said shackle member from said shackle insert hole when said catch member is disposed in the unlocking position; and wherein said pin hole includes a curved hole section that extends along a curved line on said end face of said latch member and that has opposite first and second ends, said pin being disposed in said first end of said curved hole section when said latch member is disposed in the unlocking position and being disposed in said second end of said curved hole section when said latch member is disposed in the locking position.

9. The lock apparatus as claimed in claim 8, wherein said latch member has a curved pushing surface transverse to said end face for pushing said catch member to move to said locking position when said lock core is operated to rotate said latch member to the locking position.

10. The lock apparatus as claimed in claim 9, wherein said latch member is formed integrally with a plunger which projects from said latch member in a transverse direction transverse to an axis of said lock core.

11. The lock apparatus as claimed in claim 8, further comprising a biasing spring-disposed in said catch chamber for biasing said catch member to move to the locking position.

12. The lock apparatus as claimed in claim 11, wherein said pin hole further includes a straight hole section that extends along a straight line on said end face of said latch member and that extends transversely from said second end of said curved hole section, said catch member being depressed by said leg portion of said shackle member and being forced to retract into said catch chamber against biasing action of said biasing spring to enable said pin to move into said straight hole section of said pin hole when said leg portion of said shackle member is inserted into said shackle insert hole to push said catch member while said lock core is in the locking position, said biasing spring expanding to enable said shackle engaging end portion of said catch member to extend into said shackle insert hole and into said shackle groove and to enable said pin to move back to said second end of said curved hole section when said leg portion of said shackle member is inserted into said shackle insert hole to register said shackle groove with said catch chamber.

13. The lock apparatus as claimed in claim 12, wherein said straight hole section of said pin hole includes wider and narrower hole portions which extend along a length of said straight hole section, said pin including wider and narrower sections which are respectively disposed in said wider and narrower hole portions of said straight hole section of said pin hole when said pin extends into said straight hole section.

14. The lock apparatus as claimed in claim 11, wherein said pin hole further includes a straight hole section that extends along a straight line on said end face of said latch member and that extends transversely from said second end of said curved hole section, said straight hole section of said pin hole including wider and narrower hole portions which extend along a length of said straight hole section, said pin having a cross-section larger than a size of said narrower hole portion and thus being prevented from moving into said straight hole section, thereby preventing retraction of said catch member into said catch chamber and preventing insertion of said leg portion of said shackle member into said shackle insert hole when said lock core is in the locking position.

15. A lock apparatus comprising:

a lock body formed with a lock core chamber, a lock core opening for access to said lock core chamber, and a shackle insert hole, said lock core chamber having a section formed as a catch chamber which is adjacent to and which is communicated with said shackle insert hole;

a lock core device received in said lock core chamber via said lock core opening, said lock core device including a cylindrical and axially rotatable lock core which is provided with a latch member that is disposed in said catch chamber, said latch member having an end face which is transverse to an axis of said lock core and which is formed with a pin hole that is eccentric to the axis of said lock core;

a key which is insertible into said lock core device via said lock core opening and which is operable for rotating said lock core and said latch member between locking and unlocking positions;

a shackle member having a leg portion which is formed with a shackle groove and which is inserted into said shackle insert hole in said lock body; and a catch member disposed in said catch chamber of said lock body, said catch member having a shackle engaging end portion for engaging said shackle groove in said leg portion of said shackle member, and a latch engaging end portion opposite to said shackle engaging end portion and formed with a pin which extends rotatably into said pin hole in said latch member for engaging said latch member such that said catch member is movable between locking and unlocking positions when said latch member moves between the locking and unlocking positions, said shackle engaging end portion of said catch member extending into said shackle insert hole for engaging said shackle groove in said leg portion of said shackle member when said catch member is disposed in the locking position, said shackle engaging end portion being retracted into said catch chamber for disengaging from said leg portion of said shackle member to permit removal of said shackle member from said shackle insert hole when said catch member is disposed in the unlocking position; and wherein said lock body being provided with a protective sleeve in said catch chamber for receiving said catch member, said protective sleeve having an inner surface formed with a pair of confronting slide grooves, said catch member having two opposite side walls which are formed respectively with sliding blocks, each of said sliding blocks extending into a respective one of said slide grooves and being slidable along the respective one of said slide grooves when said catch member moves between the locking and unlocking position.

16. A lock apparatus comprising:

a lock body formed with a lock core chamber, a lock core opening for access to said lock core chamber, and a shackle insert hole, said lock core chamber having a section formed as a catch chamber which is adjacent to and which is communicated with said shackle insert hole;

a lock core device received in said lock core chamber via said lock core opening, said lock core device including a cylindrical and axially rotatable lock core which is provided with a latch member that is disposed in said catch chamber, said latch member having an end face which is transverse to an axis of said lock core and which is formed with a pin hole that is eccentric to the axis of said lock core;

a key which is insertible into said lock core device via said lock core opening and which is operable for rotating said lock core and said latch member between locking and unlocking positions;

a shackle member having a leg portion which is formed with a shackle groove and which is inserted into said shackle insert hole in said lock body; and a catch member disposed in said catch chamber of said lock body, said catch member having a shackle engaging end portion for engaging said shackle groove in said leg portion of said shackle member, and a latch engaging end portion opposite to said shackle engaging end portion and formed with a pin which extends rotatably into said pin hole in said latch member for engaging said latch member such that said catch member is movable between locking and unlocking positions when said latch member moves between the locking and unlocking positions, said shackle engaging end portion of said catch member extending into said shackle insert hole for engaging said shackle groove in said leg portion of said shackle member when said catch member is disposed in the locking position, said shackle engaging end portion being retracted into said catch chamber for disengaging from said leg portion of said shackle member to permit removal of said shackle member from said shackle insert hole when said catch member is disposed in the unlocking position; and further comprising a cover unit which includes a mounting seat that is mounted on said lock body adjacent to said lock core opening and that is provided with a spring-loaded ball member, arid a cover flap having a hinge end portion hinged to said lock body such that said cover flap is pivotable toward said lock core opening to a closed position for covering said lock core opening and away from said lock core opening to an open position to permit access to said lock core opening, said hinge end portion having an annular outer periphery formed with angularly displaced ball engaging grooves for engaging resiliently said ball member so as to retain said cover flap releasably at a selected one of said open and closed positions.

* * * * *